US010753718B1

(12) United States Patent
Compton

(10) Patent No.: US 10,753,718 B1
(45) Date of Patent: Aug. 25, 2020

(54) COLORED CARTRIDGE PACKAGING

(71) Applicant: Vista Outdoor Operations LLC, Farmington, UT (US)

(72) Inventor: Daniel Compton, Princeton, MN (US)

(73) Assignee: Vista Outdoor Operations LLC, Anoka, MN (US)

( * ) Notice: Subject to any disclaimer, the term of this patent is extended or adjusted under 35 U.S.C. 154(b) by 0 days.

(21) Appl. No.: 15/972,058

(22) Filed: May 4, 2018

Related U.S. Application Data

(63) Continuation-in-part of application No. 29/640,827, filed on Mar. 16, 2018, now Pat. No. Des. 857,523.

(51) Int. Cl.

| | |
|---|---|
| ***B65D 5/02*** | (2006.01) |
| ***F42B 39/26*** | (2006.01) |
| ***B65D 5/42*** | (2006.01) |
| ***B65D 5/20*** | (2006.01) |
| ***B65D 85/00*** | (2006.01) |

(52) U.S. Cl.
CPC ..... *F42B 39/26* (2013.01); *B65D 5/2033* (2013.01); *B65D 5/4204* (2013.01); *B65D 85/00* (2013.01)

(58) Field of Classification Search
CPC .. F42B 39/26; F42B 5/025; F42B 5/02; F42B 5/32; F42B 11/14; B65D 5/4204; B65D 5/42; B65D 5/20; B65D 5/2033
USPC ..... 206/3
See application file for complete search history.

(56) References Cited

U.S. PATENT DOCUMENTS

| | | | |
|---|---|---|---|
| D81,033 | S | 4/1930 | Tourtois |
| 2,507,665 | A | 5/1950 | Ford |
| 3,340,216 | A | 9/1967 | Mack |
| 3,363,561 | A | 1/1968 | Irons |
| 3,553,804 | A | 1/1971 | Kopsch et al. |
| 3,580,178 | A | 5/1971 | Kopsch |
| 3,833,165 | A | 9/1974 | Hoiles |
| 3,976,241 | A | 8/1976 | Bemiss |
| 4,080,899 | A | 3/1978 | Luban |

(Continued)

FOREIGN PATENT DOCUMENTS

| | | |
|---|---|---|
| BE | 1000457 A3 | 12/1988 |
| DE | 583097 | 8/1933 |

(Continued)

OTHER PUBLICATIONS

"$0.06! Eggleston munitions Polymer coated 9mm bullets—YouTube" downloaded from the internet at: http://www.egglestonmunitions.com published on Apr. 15, 2015 (5 pages).

(Continued)

*Primary Examiner* — Bryon P Gehman
(74) *Attorney, Agent, or Firm* — Reed Smith LLP; Matthew P. Frederick; Cheryl L. Gastineau

(57) ABSTRACT

Cartridge packaging comprising a container having a plurality of loose rimfire cartridges contained in an unordered state therein. The bullets of the rimfire cartridges each having a polymer coating, and the bullets are of two or more colors. The container comprises a non-rectangular opening in a front panel of the container defining a window with a transparent material spanning the opening, such that the different colored bullets of the rimfire cartridges are viewable through the window when the container is on a retail store shelf.

14 Claims, 53 Drawing Sheets

(56) References Cited

U.S. PATENT DOCUMENTS

| | | | | |
|---|---|---|---|---|
| 4,196,670 | A | 4/1980 | Vatsvog | |
| 4,328,750 | A | 5/1982 | Oberg et al. | |
| 4,454,175 | A | 6/1984 | Martin | |
| D293,211 | S | 12/1987 | DePaul et al. | |
| 4,731,189 | A | 3/1988 | Gregg, Jr. | |
| D310,965 | S | 10/1990 | Capuano | |
| D318,222 | S | 7/1991 | Hsiung | |
| 5,038,684 | A | 8/1991 | Petrovich | |
| 5,062,974 | A | 11/1991 | Van Meter | |
| 5,105,744 | A | 4/1992 | Petrovich | |
| 5,216,199 | A * | 6/1993 | Bjerke | F42B 5/32 102/204 |
| 5,275,108 | A | 1/1994 | Chernicky et al. | |
| 5,535,495 | A | 7/1996 | Gutowski | |
| 5,592,986 | A | 1/1997 | Auger et al. | |
| 5,910,345 | A | 6/1999 | Luban | |
| 6,090,756 | A | 7/2000 | Brown | |
| 6,279,214 | B1 | 8/2001 | Kassuelke et al. | |
| 6,550,066 | B1 | 4/2003 | Brassey | |
| D503,614 | S | 4/2005 | Sax et al. | |
| 7,032,492 | B2 | 4/2006 | Meshirer | |
| D656,018 | S | 3/2012 | Hablutzel et al. | |
| D664,042 | S | 7/2012 | Kurpis | |
| 8,561,542 | B2 | 10/2013 | Authement, Sr. | |
| 8,752,484 | B2 | 6/2014 | Burczynski | |
| D712,275 | S | 9/2014 | Irek | |
| D712,276 | S | 9/2014 | Irek | |
| 8,939,350 | B2 * | 1/2015 | Valencia | B65D 5/4204 229/103.3 |
| 8,950,333 | B2 | 2/2015 | Burczynski et al. | |
| D733,252 | S | 6/2015 | Burczynski et al. | |
| D733,834 | S | 7/2015 | Burczynski et al. | |
| D733,835 | S | 7/2015 | Burczynski et al. | |
| D733,836 | S | 7/2015 | Burczynski et al. | |
| 9,108,760 | B2 * | 8/2015 | Begim | B65D 5/4204 |
| D739,084 | S | 9/2015 | Hall | |
| 9,150,327 | B2 * | 10/2015 | Begim | B65D 5/4208 |
| 9,207,052 | B2 | 12/2015 | Burczynski | |
| 9,254,503 | B2 | 2/2016 | Ward | |
| 9,404,719 | B1 * | 8/2016 | Bowers | F42B 5/025 |
| 9,879,954 | B2 * | 1/2018 | Hajjar | F42B 5/02 |
| D817,777 | S | 5/2018 | Duan et al. | |
| 10,336,479 | B2 * | 7/2019 | Deutschle | B65D 5/68 |
| 2003/0078170 | A1 | 4/2003 | Brown | |
| 2003/0101891 | A1 | 6/2003 | Amick | |
| 2004/0050284 | A1 | 3/2004 | Piela | |
| 2005/0211126 | A1 | 9/2005 | Hurley | |
| 2005/0257308 | A1 | 11/2005 | Willis | |
| 2007/0095241 | A1 | 5/2007 | Rice et al. | |
| 2009/0254171 | A1 | 10/2009 | Heikkila | |
| 2010/0037794 | A1 | 2/2010 | Authement, Sr. | |
| 2011/0139862 | A1 * | 6/2011 | Bowman | B65D 5/2047 229/114 |
| 2012/0199033 | A1 * | 8/2012 | Bybee | F42B 5/02 102/442 |
| 2014/0023800 | A1 | 1/2014 | Webster | |
| 2014/0263600 | A1 * | 9/2014 | Valencia | B65D 5/244 229/155 |
| 2016/0107830 | A1 * | 4/2016 | Baryshyan | B65D 5/4204 229/126 |
| 2016/0313102 | A1 | 10/2016 | Motyka et al. | |
| 2016/0377397 | A1 | 12/2016 | Winge | |

FOREIGN PATENT DOCUMENTS

| | | | |
|---|---|---|---|
| DE | 3116175 | A1 | 11/1982 |
| DE | 3802002 | A1 | 8/1989 |
| DE | 3822775 | A1 | 2/1990 |
| DE | 102012023398 | A1 | 6/2014 |
| DE | 20 2014 103 662 | U1 | 10/2014 |
| EP | 49613 | B1 | 9/1990 |
| EP | 0989381 | | 3/2000 |
| FR | 420390 | | 1/1911 |
| GB | 6588 | | 12/1896 |
| GB | 8301 | | 10/1909 |
| RU | 2003033 | C1 | 11/1993 |
| RU | 2010140449 | A | 4/2012 |
| RU | 2010140457 | | 4/2012 |
| RU | 2469259 | | 12/2012 |
| WO | WO9720185 | | 6/1997 |
| WO | WO0102794 | A1 | 1/2001 |
| WO | WO01/20245 | A1 | 3/2001 |

OTHER PUBLICATIONS

"CCI 2016 Catalog" (17 pages).
Ammunition Reloading Explosives Shooting "21 years of ARES casted bullets" downloaded from the internet at: http://www.ares-gun.sk on Jul. 15, 2018 (11 pages).
AR15.com Blue Bullets Anyone Used These? Forum posted Jul. 2014 (19 pages).
"Federal Top Gun Wounded Warrior Ammunition 12 Gauge 2¾" 1⅛ oz #8 Shot" Reviews printed on Jul. 15, 2018 (6 pages).
"Happy Bullet Easter!" downloaded from the internet at: https://www.thefirearmblog.com/blog/2016/03/30/happy-bullet-easter/ on Jul. 15, 2018 (14 pages).
Lotnut "CCI .22 LR Ammo" downloaded from the internet at: http://www.lotnut.com/app/item.html?guid=1026364c-6503-4deb-8a91-970d78667bfe on Jul. 16, 2018 (2 pages).
Robert Farago "New From Federal Ammunition: American Eagle Syntech Ammunition—The Truth About Guns" downloaded from the internet at: http://www.thetruthaboutguns.com/2016/04/robert-farago/new-federal-ammunition on Jul. 16, 2018 (16 pages).
"New Federal Syntech Ammo With Polymer-Encased Bullets" *Polymer Daily Bulletin* published on Apr. 5, 2016 (14 pages).
Pinterest "Discover ideas about Bullets for Sale" Polymer coated reloading component bullets for sale downloaded from the internet at: https://www.pinterest.com/pin/78601955975244525/ on Jul. 15, 2018 (3 pages).
YouTubeVideo Powder Coat Bullets in half the time. Promise! News downloaded from the internet at: https://www.youtube.com/watch?v=MRBXic3-ztE published on Apr. 9, 2016 (7 pages).
Cast Boolits Forum "Powder Coated Bullets pics only" downloaded from the internet at: http://castboolits.gunloads.com/showthread.php?251956-Powder-coated-bullets-pics-only/page15 Feb. 2016 (29 pages).
"9mm—124 Grain HST JHP—Federal Premium—20 Rounds" Premium Defensive 9mm Ammo for Sale—124 gr JHP—Federal HST Ammunition in Stock—20 Rounds *Lucky Gunner* downloaded from the internet at: https://www.luckygunner.com/9mm-124-grain-jhp-hst-federal-premium-20-rounds#rid=ppt on Jul. 15, 2018 (3 pages).
"Rimfire Ammo & Reloading Ammunition" downloaded from the internet at: https://www.basspro.com/shop/en/rimfire-ammo#facet:&productBenginIndex:0&facetLimit:&orderBy:&pageView:grid&minPrice:&maxPrice:&pageSize:& on Jul. 15, 2018 (31 pages).
David MacCar "All About Polymer-Coated Bullets" downloaded from the internet at: https://www.range365.com/all-about-polymer-coated-bullets (Mar. 9, 2017) 2 pages.
"Best Hard Cast Lead Bullets Polymer Coated Bullets" downloaded from the internet at: https://www.badmanbullets.com/OnlineStore/index.php on Feb. 20, 2018 (5 pages).
"Coated vs plated bullets [Archive]—Calguns.net" Discussion Thread downloaded from the internet at: http://www.calguns.net/calgunforum/archive/index.php/t-978753.html on Feb. 2, 2018 (1 page).
Brad Miller, Ph.D. "Coated Bullets: The future of lead bullets for handloaders?" *Shooting Sports USA* (Mar. 7, 2017) (7 pages).
"The VEPR Forum—A Guide to Powder Coating Bullets—Polymer Jacketed Lead" Discussion and Thread downloaded from the internet at: http://vepr.org/viewtopic.php?f=56&t=2668 on Feb. 2, 2018 (17 pages).
"Some Ramblins and Questions About Bullet Coating" Discussion and Thread downloaded from the internet at: http://castboolits.gunloads.com/archive/index.php/t-200280.html on Feb. 1, 2018 (4 pages).

* cited by examiner

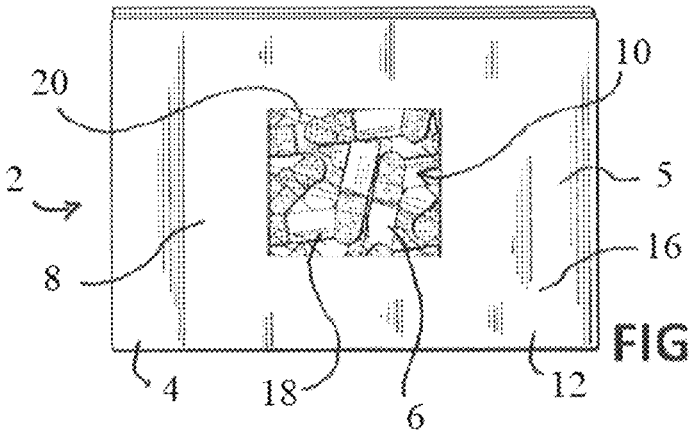
FIG. 1A
FIG. 1B
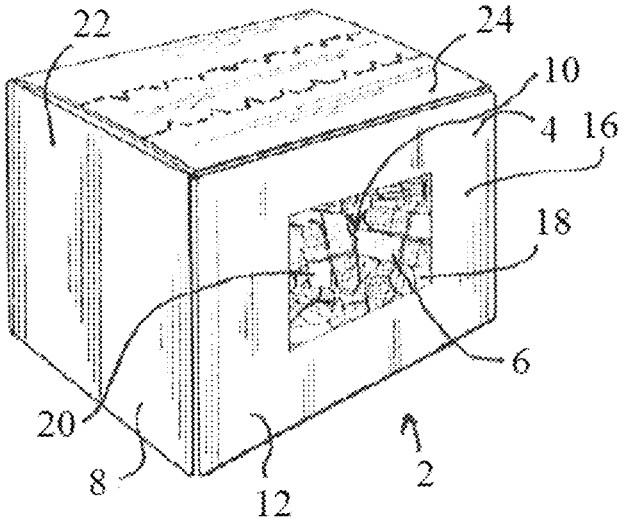
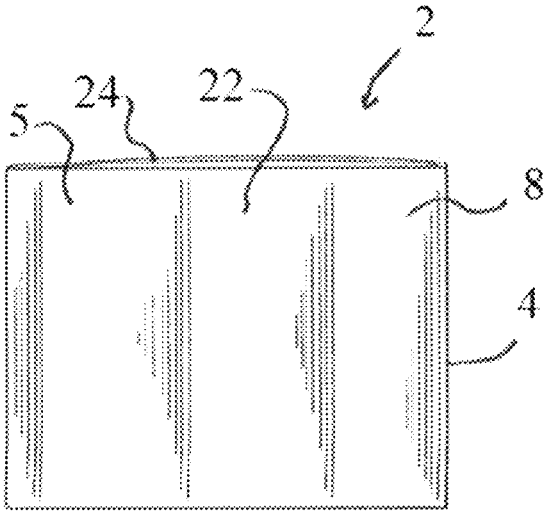
FIG. 1C

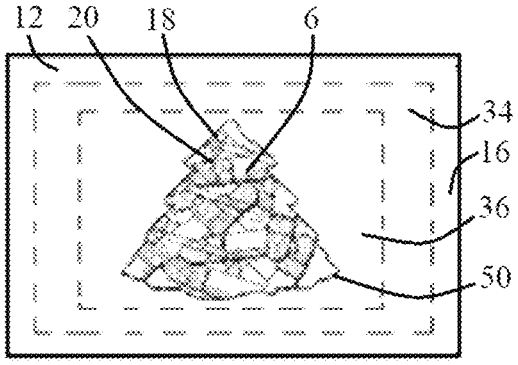
FIG. 7A
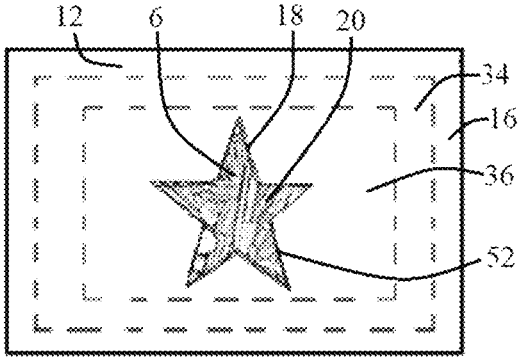
FIG. 7B1
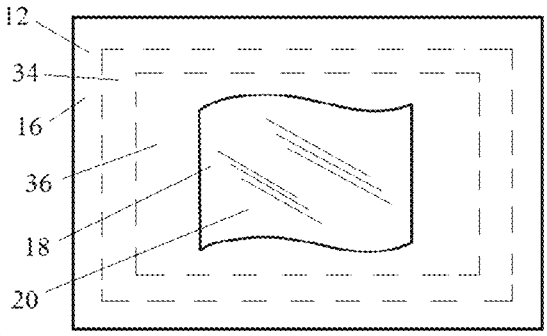
FIG. 7B2
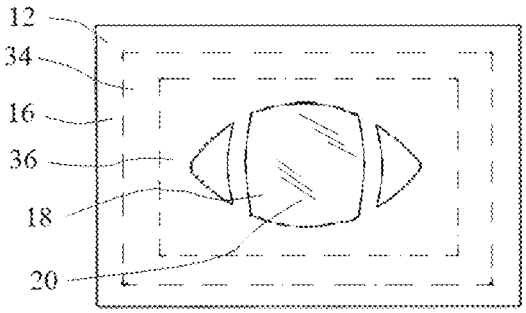
FIG. 7C1
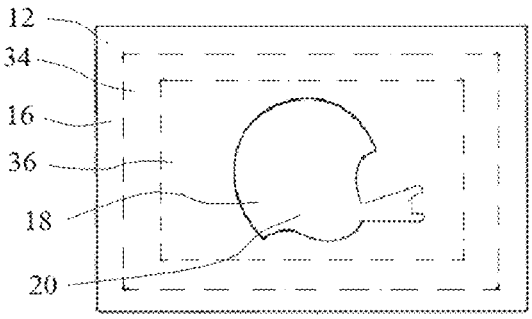
FIG. 7C2

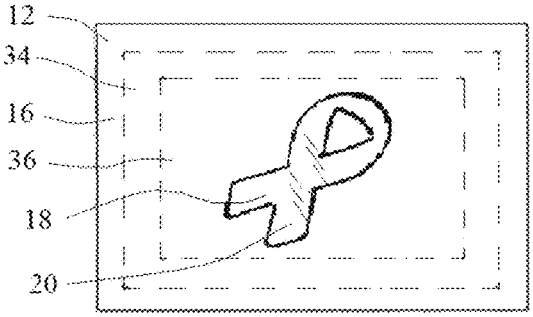
FIG. 7D
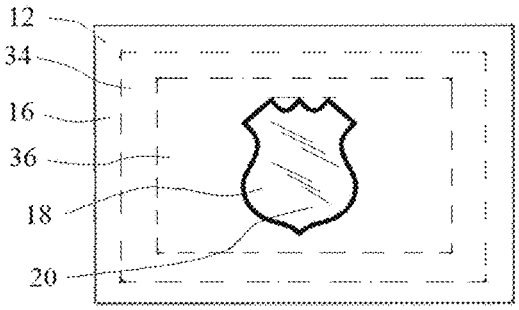
FIG. 7E
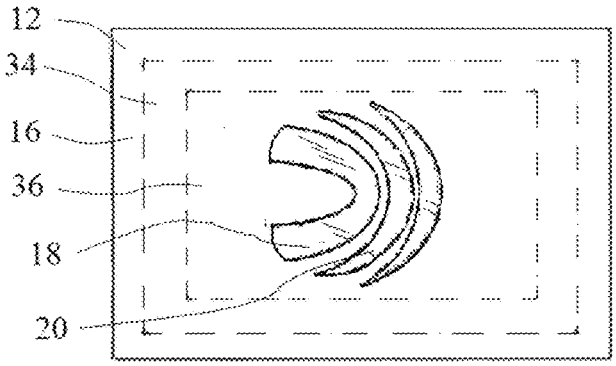
FIG. 7F
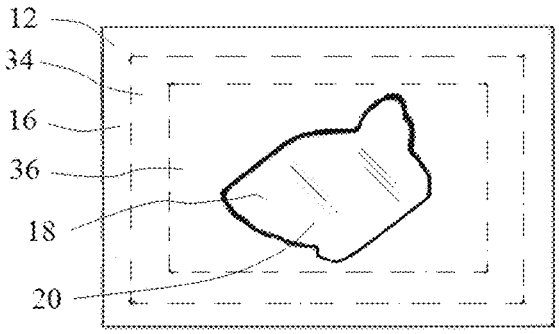
FIG. 7G1
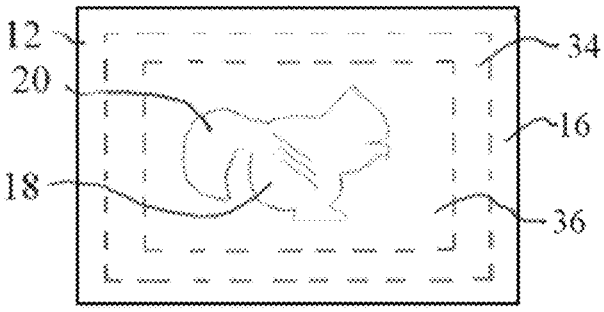
FIG. 7G2

COLORED CARTRIDGE PACKAGING

CROSS-REFERENCE TO RELATED APPLICATIONS

This application is a continuation-in-part application of and claims the benefit of U.S. Design Application No.: 29/640,827, filed Mar. 16, 2018, the entire contents of which is incorporated by reference herein.

FIELD OF THE INVENTION

This invention is related to cartridge packaging containing bullet cartridges and methods of making such packaging.

BACKGROUND OF THE INVENTION

Ammunition comes in a vast array of calibers and brands. Retail display of ammunition will often include dozens of different products. The consumer will enter the ammunition area of a store and typically know the size ammunition that he wants to purchase and may or may not be loyal to a particular brand. The most common caliber of ammunition sold on a retail level is, by far, 22 caliber long rifle ammunition. The cartridges in almost all cases having a brass case and gray or copper colored bullet, reflecting the exposed material of the bullet, either lead or copper (or copper alloys). Packaging for 22 caliber ammunition is primarily cardboard boxes with the cartridges packaged in orderly rows and columns. Typically the box has the bullets in a plastic tray having a matrix of receiving holes for the cartridges. The cartridges are protected from damage from one another by the securement of the bullets in the holes and their separation from contact with one another. Typically, viewing the actual product is not possible without opening the package. Some brands of 22 caliber long rifle ammunition may be sold in transparent or translucent polymer cases where some of the rows of the cartridges are partially visible. Such ammunition may also be sold in bulk, in loose packed boxes and polymer tubs. 22 caliber long rifle cartridges are seen as a commodity, they are very inexpensive compared to other cartridges, often less than ten cents per cartridge. The performance of different brands of 22 caliber long rifle cartridges are for many buyers, practicably indistinguishable. Price, innovative packaging, and any product innovation that is apparent by way of the innovative packaging, may turn the purchasing decision toward that particular packaged ammunition at retail establishments.

For such retail settings, particularly stores, the packaging must be easily manageable by the store employees and by the customers, that is, easily graspable and not too heavy. Additionally the package needs to be adequately marked and/or the product displayed to assure the customer they are purchasing what they want.

Considering the numerous brands of such ammunition, and the conventional box packaging, any new packaging particularly associated with the display of a new product that is cost effective, and generates greater sales for that new product would be welcome by the particular brand or manufacturer of said new product. Moreover, to the extent that such packaging is environmentally friendly that would also be an advantage.

SUMMARY OF THE INVENTION

In embodiments, cartridge packaging comprising a six sided cardboard box having a multiplicity of 22 caliber rimfire cartridges loosely contained and randomly mixed therein. The bullets of the bullet cartridges each having one of at least two color coatings. The cartridge casings comprising conventional brass coloring. The cardboard box comprises an opening in a front panel of the container and a transparent material covering the opening, such that the plurality of colored bullet cartridges when put on a retail store's shelves, are directly viewable to the customer through the opening. In embodiments, the shape of the opening may be a particular shape of a thing or animal, such as game animals. In embodiments, the bullet coloration corresponding to coloration on graphics on the exterior of the box. Graphics on the box can also identify a particular game animal suitable for use or objects or things associated with a particular theme, the theme may also be associated with colors of the bullets. The transparent material may also have graphics thereon that continue or supplement the shape defined by the periphery of the window. In embodiments, the cardboard may have strips traversing the transparent materially defining window panes.

In at least some embodiments, the container is a box having the front panel and left, right, rear, top and bottom sides. The opening is in the front panel, opposite the rear side. The box can be formed from a box preform and can further include a perforated tab for easy opening. In embodiments, the capacity of the box is between about 150 cartridges and 550 cartridges. In some embodiments, the opening is in the shape of a rectangle and, in other embodiments non-rectangular and in the shape or silhouette of a thing or an animal. In embodiments, the shape of the opening may be a pine tree and the colors can include red and green.

In an embodiment, a method for packaging bullet cartridges for sale. The method can include forming a plurality of bullet cores; coating a first batch of the plurality of bullet cores with a first polymer coating of a first color and coating a second batch of the plurality of bullet cores with a first polymer coating of a second color. Methods can further include providing a plurality of cartridge cases and assembling a first batch of bullet cartridges with the first batch of bullets of the first color and a second batch of bullet cartridges with bullets of the second color. Bullet cartridges from the first and second batches of bullet cartridges are then loaded into containers, such that each container comprises a plurality of bullet cartridges of the first color and a plurality of bullet cartridges of the second color. The containers are then sealed. The containers include an opening in a front panel covered by a transparent material, providing a view of the enclosed bullet cartridges.

In embodiments, a method of manufacturing bullets comprises selecting a theme that is associated with the theme specific objects or things and specific colors, putting the specific colors on multiplicity of bullets, assembling the bullets into a multiplicity of 22 caliber rimfire cartridges of two or more colors, providing viewing of the packaged bullets, placing images of objects on a printing cardboard box preforms with an object or thing associated with the theme, cutting an opening for a window into the cardboard, providing a clear transparent material to form the window at the opening, forming the preform into a box, loading in a random disordered state quantities of the multiplicity of the 22 caliber cartridges into the box so that the disordered state is viewable through the window including the colored bullets of the rimfire cartridges. In embodiments, the shape of the window may be of the image or object associated with the theme.

In at least some embodiments, the shape of the opening in the front panel correlates with box graphics, and with the colors of the bullets in the container with respect to a common theme. In embodiments, one or more of the colors of the bullets in the container are also included in the graphics on the box.

Advantages and features include a more economically friendly form of packaging bullet cartridges, particularly 22 caliber bullet cartridges, where the customer can directly see cartridges with uniquely colored bullets through a non-rectangular window facing forward, the cartridges and box packaging having correlation colors and a theme, the cartridges contained in the box displayed in a disordered arrangement. In embodiments, a feature and advantage is the box weight between about 1 pound and about 3½ pounds and is shaped to have an internal volume for the 22 caliber cartridges of 12 cu. in. to about 36 cu. in. In embodiments the internal volume is from about 10 cu. in. to about 42 cu. in. A feature and advantage of such packaged cartridges is that they sell more than conventionally packaged cartridges.

In embodiments, a selected theme can be a charity that has an associated color and object, the bullets of the 22 caliber cartridges are all of the color, and the window shape and/or objects contained in the box graphics are associated with the charity.

In embodiments, a selected theme can be a sports team that has two associated colors. The window shape and/or objects contained in the box graphics are of objects or things associated with the specific sports team and/or objects or things associated with the specific sport that the sports team plays.

A feature and advantage is that the polymer coating provides a protective resilient layer that facilitates loose packing of the cartridges while inhibiting damage to the bullets from engagement with one another in the packaging. Such protection may be particularly of advantage when there are structural features on the bullet such as a hollow point. Moreover, the polymer coating allows the bullets to be loosely put in other compartments or storage compartments between unpackaging and firing with protection from damage.

In embodiments of the invention, the colors of the bullets in the cartridges may be selected from the following colors: black, gray, white, pink, red, orange, yellow, green, blue, purple, brown, and azure. In embodiments of the invention, usage of a plurality of such colors of bullets of cartridges are randomly present in a box and viewable through a window integral with the box.

In embodiments, the window is a visually recognizable shape of an object or animal. In embodiments, the shape of the window and the coloration of the bullets of the cartridges are a part of a publically known theme. For example, red, white, and blue bullets in association with a patriotic theme with the widow being a flag, or a silhouette of a soldier, or of a military vehicle. And the packaging can have one or more of the red, white, and blue as part of the graphics thereon.

A feature and advantage of embodiments is that a new feature, cartridges with a polymer coating that has coloration, where in the cartridges are displayed through a window in the box, and wherein said coloration is carried over to the graphics on the box.

A feature and advantage of embodiments is packaged bullets in a disorganized array In embodiments of the invention, for example the cardboard box will have a camouflage graphic and the cartridges therein with have bullets with a polymer coatings including a green polymer coating and a brown polymer coating, the colored coatings corresponding to the colors in the camouflage graphic.

A feature and advantage of embodiments is that the packaging is environmentally friendly in that it does not use plastic trays that create refuse or that need to be recycled. Rather, only there is only the easily recyclable cardboard box having a window allowing the customer to confirm at the retail level the contents of the box, loosely packed 22 caliber cartridges and no trays.

BRIEF DESCRIPTION OF THE DRAWINGS

The invention together with the above and other objects and advantages will be best understood from the following detailed description of the preferred embodiment of the invention shown in the accompanying drawings, wherein:

FIG. 1A is a front plan view of cartridge packaging according to embodiments of the invention.

FIG. 1B is a front, side and top perspective view of the cartridge packaging of FIG. 1 according to embodiments of the invention.

FIG. 1C is a left side plan view of the cartridge packaging of FIG. 1 according to embodiments of the invention.

FIGS. 7A-7L are front plan views of cartridge packaging showing the front panel according to embodiments of the invention.

Figure 1D:
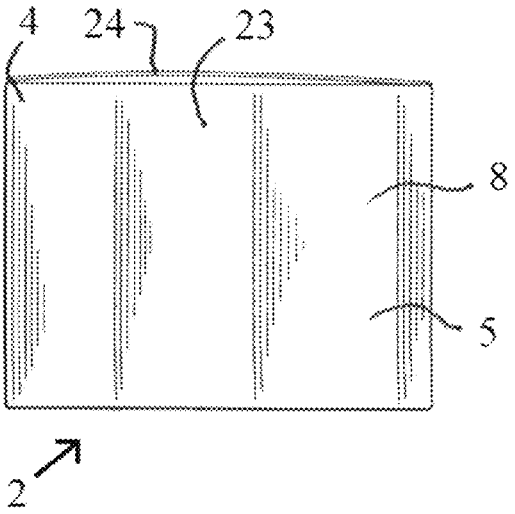
FIG. 1D is a right side plan view of the cartridge packaging of FIG. 1 according to embodiments of the invention.
Figure 1E:
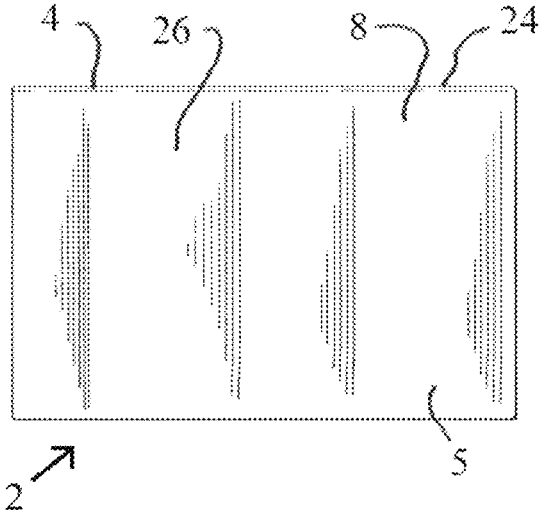
FIG. 1E is a rear plan view of the cartridge packaging of FIG. 1 according to embodiments of the invention.

The foregoing summary, as well as the following detailed description of certain embodiments of the present invention, will be better understood when read in conjunction with the appended drawings.

DETAILED DESCRIPTION

The present disclosure includes bullet cartridge packaging comprising a cardboard box and containing bullet cartridges with polymer coated bullets of two or more colors, wherein the packaging includes a forward facing window portion making the multi-colored bullets viewable when on the shelf by a customer and further includes methods of assembling such bullet cartridge packaging for transport and sale and presenting such cartridges to customers.

Referring to FIGS. 1A-1G, in at least some embodiments, bullet cartridge packaging 2 comprising a container 4 containing a plurality of bullet cartridges 6. The container is closed and includes an outer wall 8 defining and enclosing an interior 10, which is at least partially filled with the plurality of bullet cartridges 6. The outer wall 8 comprises a front panel 12 having an opening 18. The opening 18 is covered by a sheet of transparent material 20, such that a portion of the plurality of bullet cartridges 6 in the interior 10 are viewable from the outside of the container.

Figure 1F:
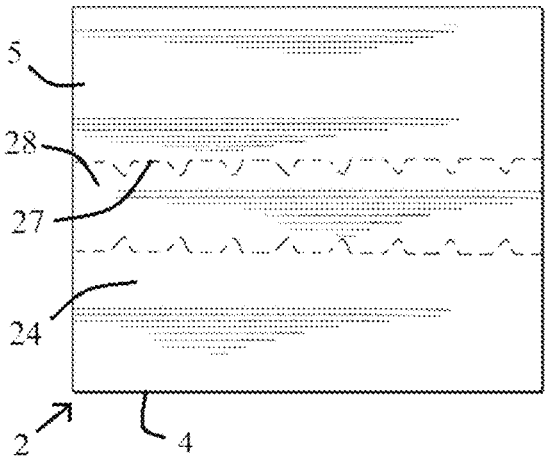
FIG. 1F is a top plan view of the cartridge packaging of FIG. 1 according to embodiments of the invention.
Figure 1G:
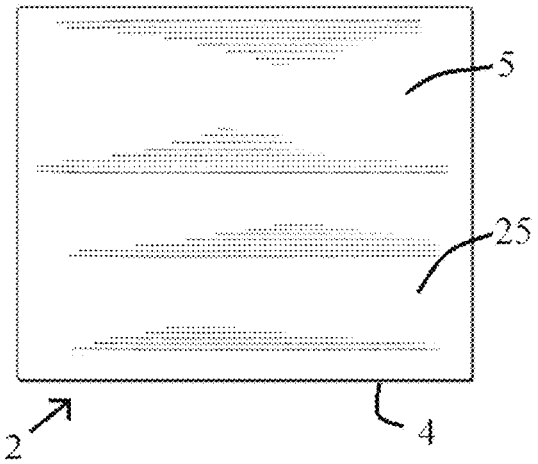
FIG. 1G is a bottom plan view of the cartridge packaging of FIG. 1 according to embodiments of the invention.

In at least some embodiments, as further shown in FIGS. 1B-1G, the container 4 can be a box 5 having the front panel 12, left and right sides 22, 23 (FIGS. 1C-1D), a rear side 26 (FIG. 1E), and top and bottom sides 24, 25 (FIGS. 1F-1G). In at least some embodiments, the top side may contain perforated paths 27 defining a strip 28, which can be pulled and removed to open the box 5 for access to the bullet cartridges, Referring to FIGS. 2A-2B, the container 4 can be a box 5 constructed from a box 5 preform 30. The preform 30 includes the front panel 12 and left 22, right 23, rear 26, top 24 and bottom 25 sides. In the embodiment shown, the top side 24 can be formed from a first top panel 24*a*, which includes the pull strip 28, overlapping a second top panel 24*b* having locking tabs 29. Also, the bottom side 25 can be formed from a first bottom panel 25*a* overlapping a second bottom panel 25*b*. The preform 30 further includes tabs 32*a*-32*e* that are folded and secured to adjacent sides as the box 5 is formed to secure and seal the box 5 together.

Figure 2A:
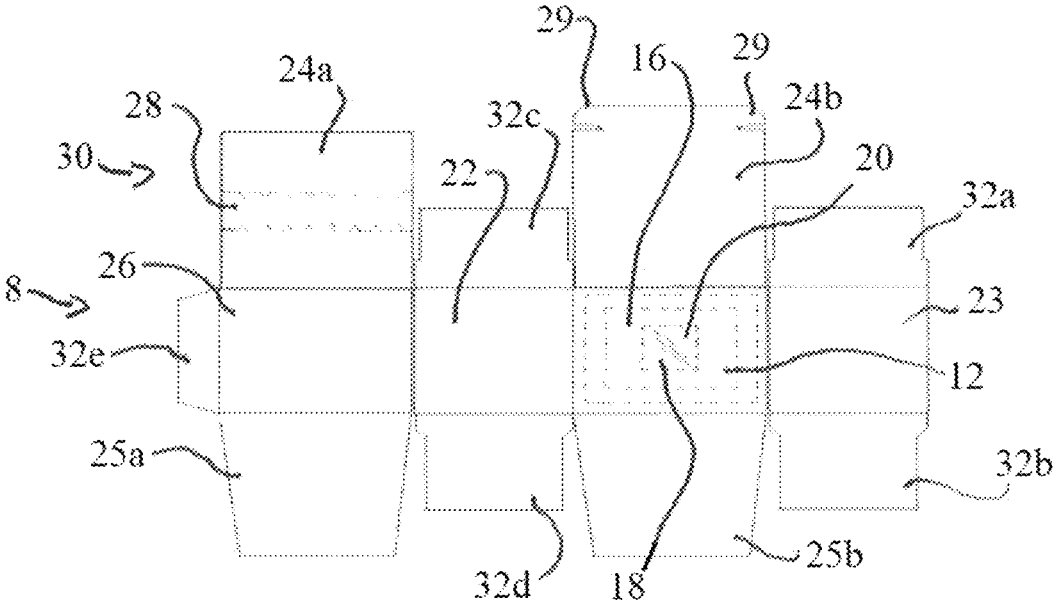
FIG. 2A is a plan view of the outer side of the container preform according to embodiments of the invention.
Figure 2B:
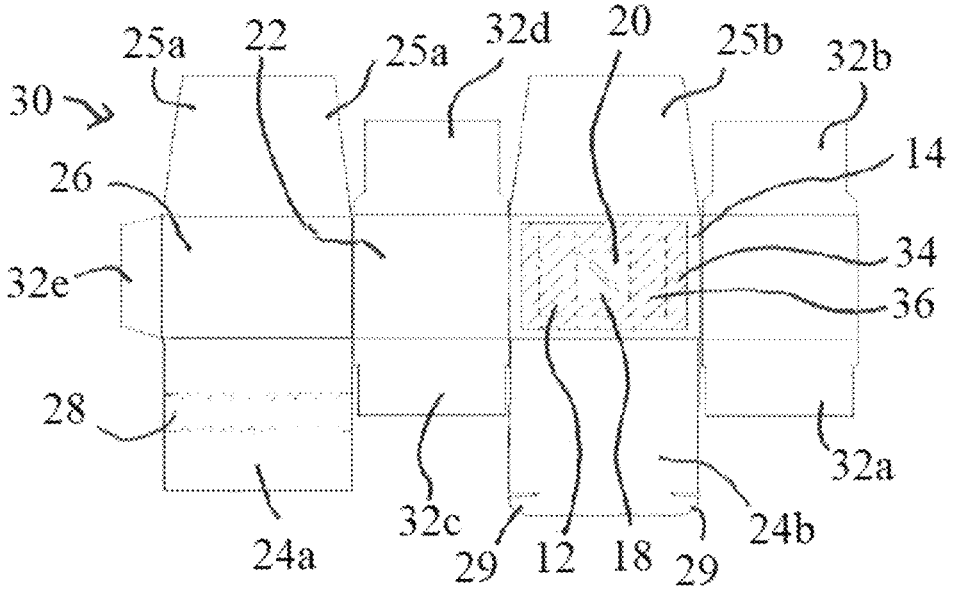
FIG. 2B is a plan view of the inner side of the container preform of FIG. 2A according to embodiments of the invention.
Figure 3:
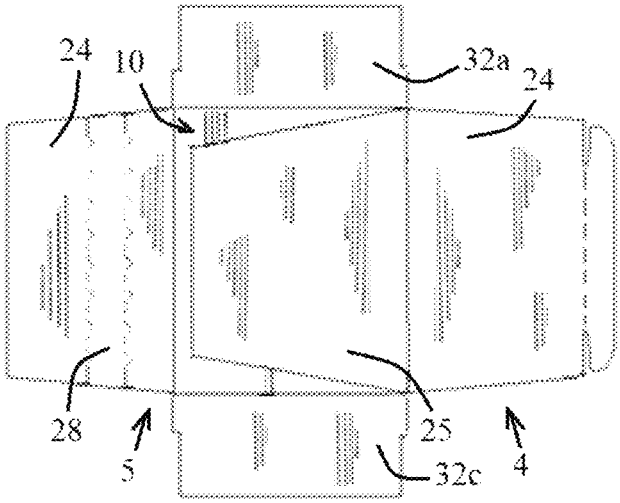
FIG. 3 s a top plan view of an opened assembled container according to embodiments of the invention.

FIG. 2A shows the outer surface of the outer wall 8. The opening 18 is shown in the front panel 12 covered by the transparent material 20. FIG. 2B shows the inner surface of the outer wall 8. The transparent material 20 is connected by any suitable means, including, for example, adhesion, to the inner surface 14 of the front panel 12 at least around its periphery 34. FIG. 3 shows a top plan view of the box 5 folded together and opened, showing the interior 10.

The transparent material 20 can be any suitable material used in packaging. Examples of transparent material include, but are not limited to, High-density polyethylene (HDPE or PEHD), Polyethylene Terephthalate (PET), Recycled PET, Polyvinyl chloride (PVC) and polypropylene (PP).

Figure 4A:
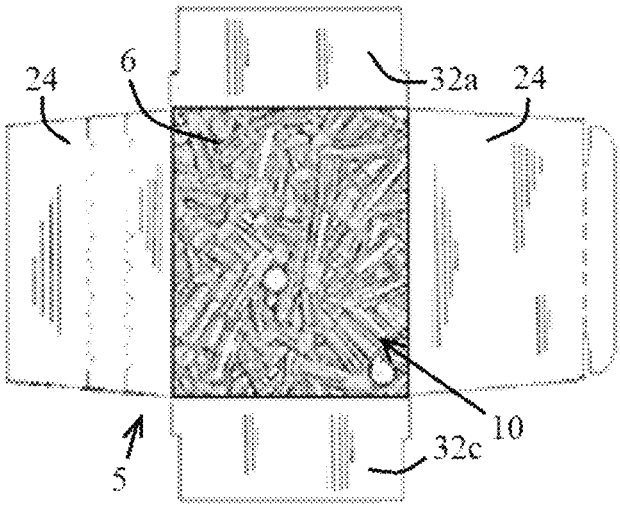
FIG. 4A is a top plan view of the opened assembled container of FIG. 3 filled with bullet cartridges comprising bullets of two or more colors according to embodiments of the invention.
Figure 4B:
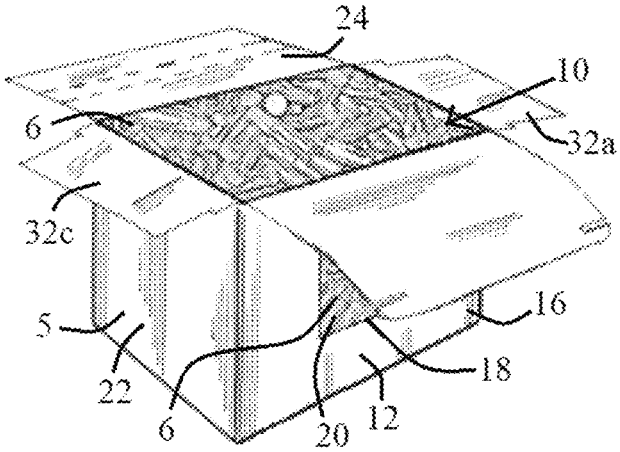
FIG. 4B is a front, side and top perspective view of the opened assembled container of FIG. 4A according to embodiments of the invention.

In at least some embodiments, an allotted quantity of bullet cartridges 6 comprising bullets of two or more colors is loosely deposited into the container 4, such that the bullet cartridges 6 are randomly mixed in the interior 10 of the container 4. FIGS. 4A and 4B show a box 5 filled with loose bullet cartridges 6 with bullets of two or more different colors, randomly mixed. The container 2, for example box 5, is then closed and sealed, as shown in FIG. 1B.

Figure 5:
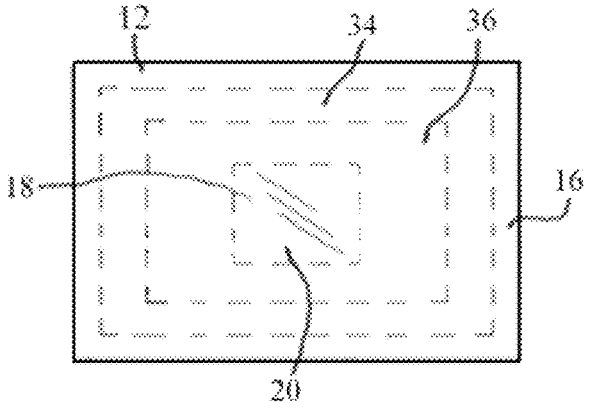
FIG. 5 is a front plan view of cartridge packaging showing the front panel according to embodiments of the invention.

Referring to FIG. 5, in at least some embodiments, the front panel 12 comprises a window portion 36, which has an outline shown in broken lines. The opening 18, which is also shown in broken lines, can be any shape and size that is confined within the window portion 36. It is contemplated herein that the present disclosure includes embodiments including a front panel 12 comprising an opening 18 of various shapes and sizes within the window portion 36.

Figure 6A:
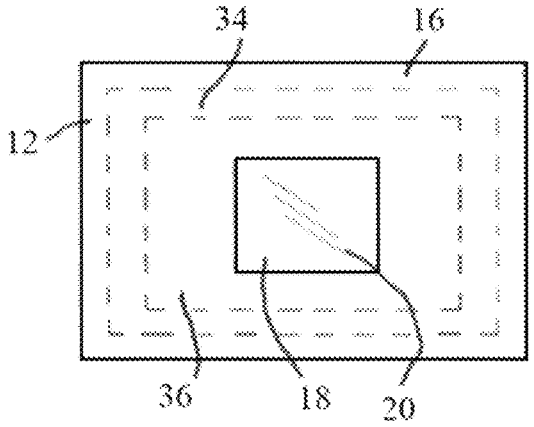
FIGS. 6A-6C are front plan views of cartridge packaging showing the front panel according to embodiments of the invention.
Figure 6B:
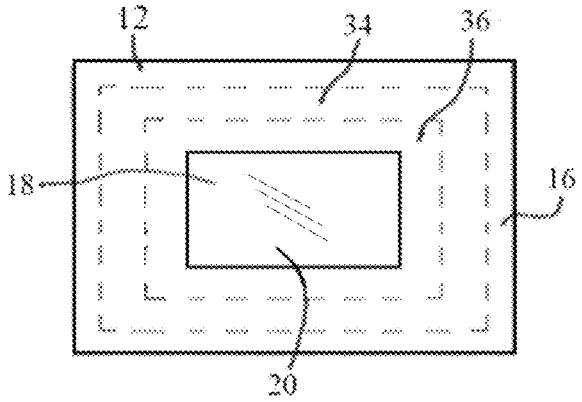
Figure 6C:
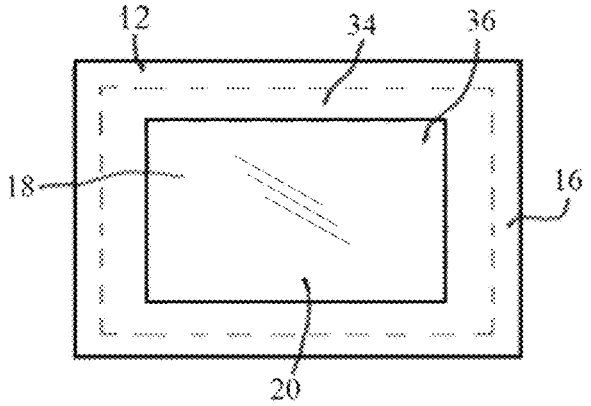

FIGS. 6A-6C illustrate embodiments showing varying sizes of the opening 18 within the window portion 36. FIG. 6A shows the opening 18 as a rectangle centrally located in the window portion 36. FIG. 6B shows the opening 18 as a larger rectangle centrally located in the window portion 36. FIG. 6C shows the opening 18 as a larger rectangle that substantially encompasses the window portion 36. These are examples of opening sizes. The opening 18 is not limited to the size and shape shown, just that there is an opening within the window portion 36. The opening 18 can also be located in other positions within the window portion and does not have to be centrally located. The opening 18 is also not limited the shape of a rectangle and can be any shape.

Figure 7I:
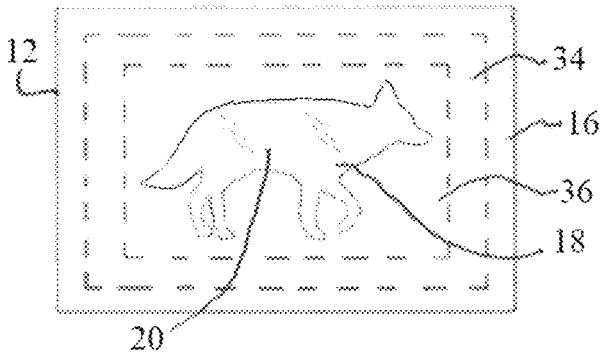
Figure 7I:
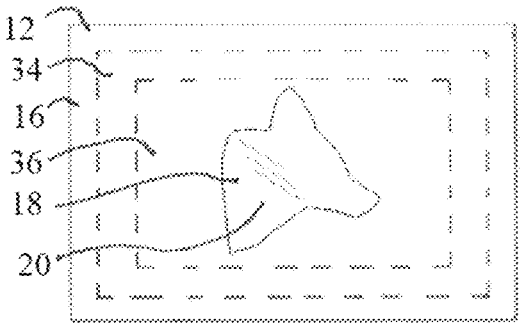
Figure 7I:
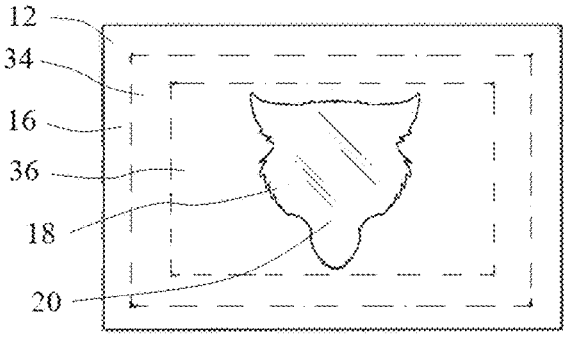
Figure 7I:
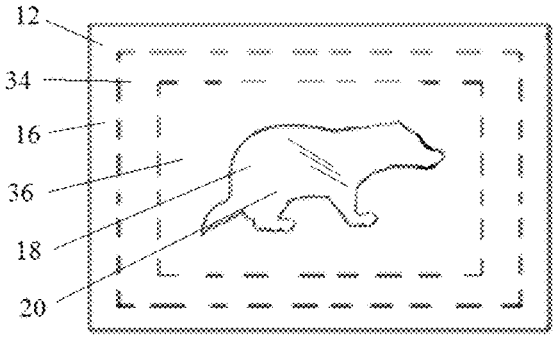

FIGS. 7A-7L illustrate examples of front panels 12 having openings 18 of different shapes. The shape of opening 18 can reflect a thing or an animal. FIG. 7A shows an opening 18 in the shape of a tree, FIG. 7B1 shows an opening 18 in the shape of a star 52 and FIG. 7B2 shows an opening 18 in the shape of a flag. Other examples of shapes include, but are not limited, the outline of animals, for example a squirrel or other rodent, a badger or a coyote, as seen in FIGS. 7G1-7K. Embodiments are not limited to the opening shapes and sizes shown. It is further contemplated herein embodiments where a front panel comprises two or more openings.

In at least some embodiments, a shape of the opening 18, designs, images, text, writing, indicia and/or colors on the container or box and/or color(s) of the bullets 38 correlate, is associated with, relates to or is connected with a concept, idea, cause, profession, sport, activity, entity or theme. For example one theme may be Christmas, the colors of the bullets are selected to be green and red, colors traditionally associated with Christmas, and the shape of the opening on the package is of a tree, specifically the shape of a Christmas tree. One theme may a patriotic theme with the bullets colored associated with the colors associated with the flag of a specific country and the opening the shape of a flag, or of the geographic shape of the country. For example, the country could be the U.S., the colors red, white, and blue, and the shape of the opening may be a flag or of the outline of the continental U.S. For example, the country could be Canada, with the colors of the bullets red and white, and with a flag graphic on the box colored red and white, and As an example, the opening 18 can be in the shape of a pine tree, as shown in FIG. 7A, and the container can have designs, images, text, writing, and/or colors associated or connected with a holiday or season. In this example, the colors of the bullets can include green and red. As another example, the container can have designs, images, text, writing, and/or colors associated or connected with a national holiday and the opening can be in the shape of a star or a flag, as shown in FIGS. 7B1 and 7B2. In these examples, the colors of the bullets can include blue, white and red. FIGS. 10A-10H illustrate bullet packaging, wherein the opening 18 is in the shape of a pine tree and the designs, images, text, writing, and/or colors on the box are associated or connected with a holiday or season. The bullets 38 of the bullet cartridges 6 are green and red.

As a further example, the correlation or theme can be a sport, activity or entity, such as football and/or a particular team. In such a case, the opening 18 can be in the shape of a football, helmet or logo (FIGS. 7C1-7C2) and the container and bullets can comprise colors, designs and indicia related or corresponding to the sport of football and/or a particular team or entity.

The opening 18, the color of the bullets and the designs, images, text, writing, and/or colors can be related or correspond in terms of a cause or promotion. The opening 18 can be in the shape of a ribbon (FIG. 7D), which is used for many causes, such as breast cancer, the box can comprise colors, designs and indicia related or corresponding to the cause and the bullet cartridges 6 can have bullets 38 of a color that correlates to the cause. For example, using pink as the color for the box and bullets.

As a further example, the opening 18, the color of the bullets and the designs, images, text, writing, and/or colors on the box can be related in terms of a profession or business entity. The opening 18 can be in the shape of a badge (FIG. 7E) with appropriate colors for the bullets and the box to correspond to the profession of law enforcement or a business logo (FIG. 7F) to correspond to a business entity.

Figure 7K:
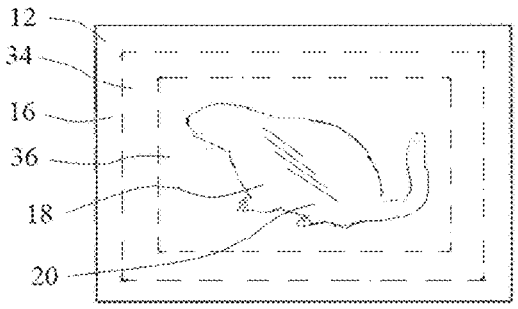
Figure 7K:
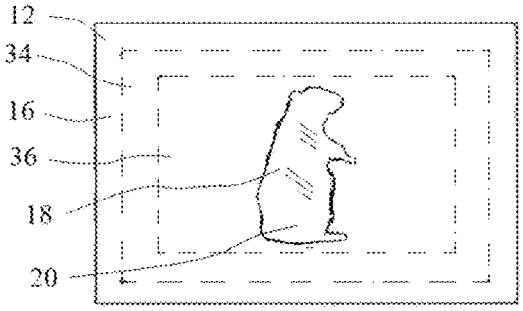
Figure 7K:
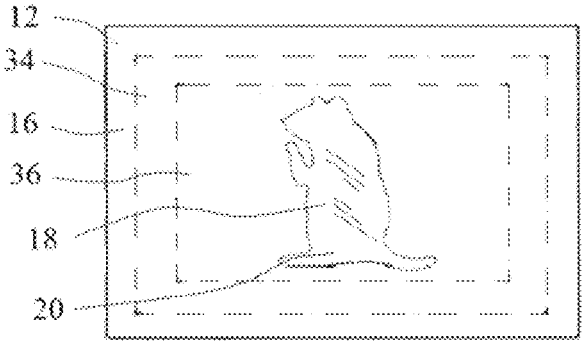
Figure 7L:
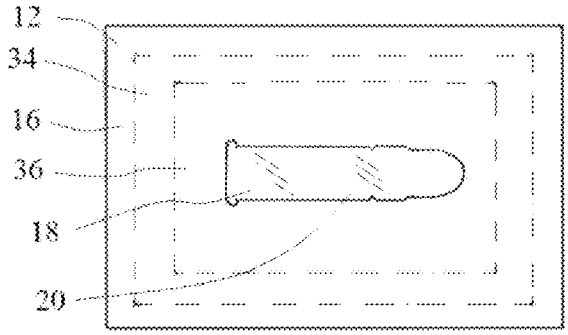

The shape of the opening 18 can correlate to a type, gauge or size of bullet cartridges in the container and/or a target or an animal associated with the use of the type, gauge or size of bullet cartridges (FIG. 7L). The shape of the opening can be an outline of the animal. In an example, the opening 18 can have the shape of a rodent or raccoon (FIGS. 7G1-7G2) if the bullet cartridges are useful for targeting such animals or the shape of a bullseye or crosshairs if the bullet cartridges are useful for target practice. The shape of the opening can also reflect the shape of the bullet cartridges or bullets inside the container. Further examples of animal outlines are shown in FIGS. 7H1-7K, which includes coyote (FIGS. 7H1-H3), badger (FIG. 7I), woodchuck (FIGS. 7J1-7J2) and prairie dog (FIG. 7K).

Figure 8:
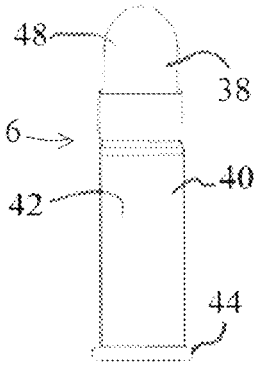
FIG. 8 is a front plan view of a bullet cartridge according to embodiments of the invention.
Figure 9:
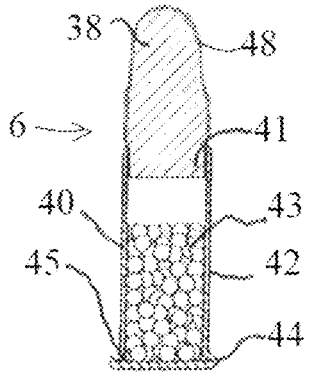
FIG. 9 is a front cross-sectional view of a bullet cartridge according to embodiments of the invention.
Figure 10A:
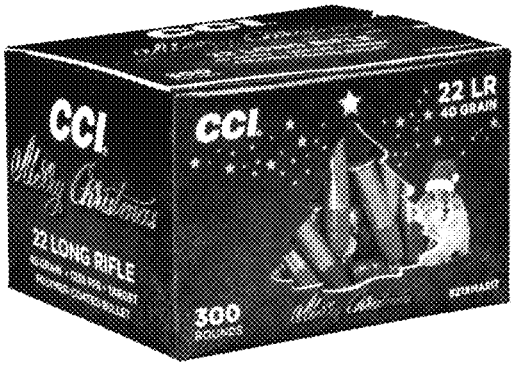
FIG. 10A is a front, side and top perspective view of a cartridge packaging according to embodiments of the invention.
Figure 10B:
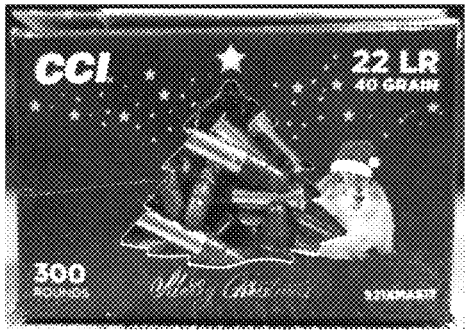
FIG. 10B is a front plan view of the cartridge packaging of FIG. 10A according to embodiments of the invention.
Figure 10C:
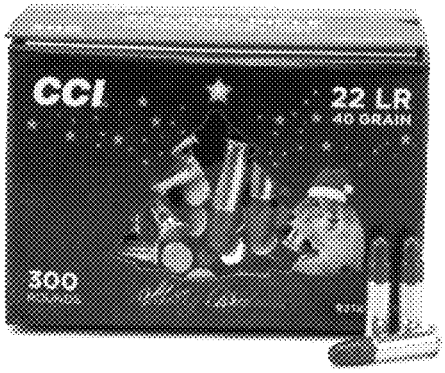
FIG. 10C is a front perspective view of the cartridge packaging of FIG. 10A with bullet cartridges having green and red bullets in the foreground according to embodiments of the invention.
Figure 10D:
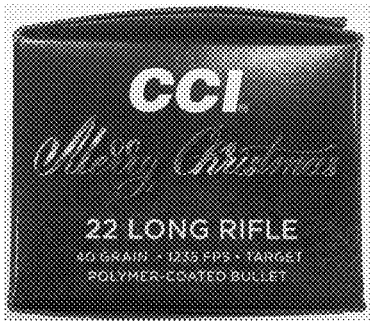
FIG. 10D is a left side plan view of the cartridge packaging of FIG. 10A according to embodiments of the invention.
Figure 10E:
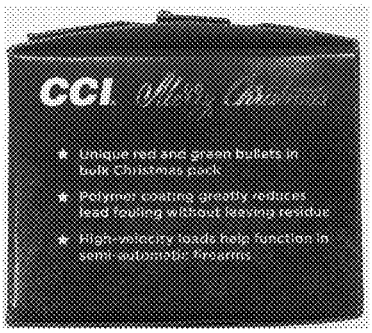
FIG. 10E is a right side plan view of the cartridge packaging of FIG. 10A according to embodiments of the invention.
Figure 10F:
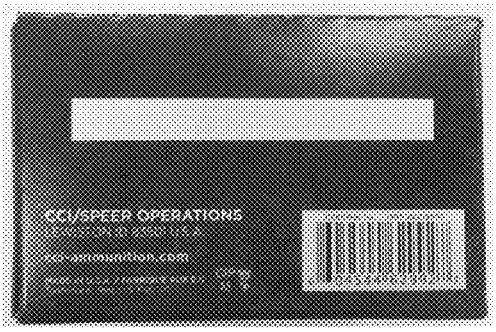
FIG. 10F is a rear plan view of the cartridge packaging of FIG. 10A according to embodiments of the invention.
Figure 10G:
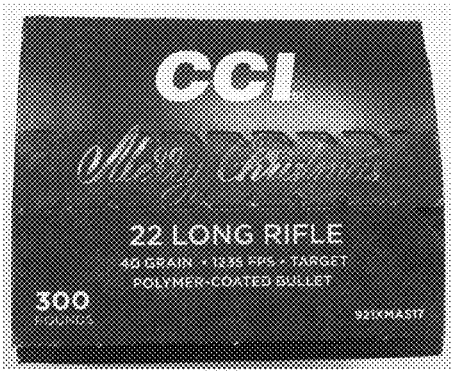
FIG. 10G is a top plan view of the cartridge packaging of FIG. 10A according to embodiments of the invention.
Figure 10H:
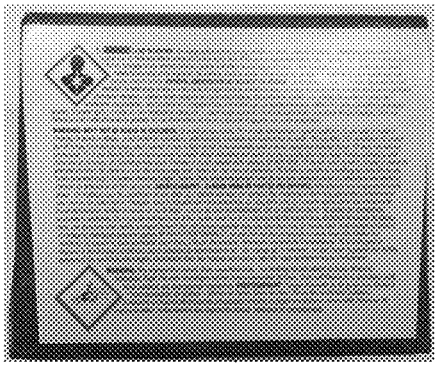
FIG. 10H is a bottom plan view of the cartridge packaging of FIG. 10A according to embodiments of the invention.

FIGS. 8-9 illustrate an example of a bullet cartridges 6 that can be used herein. There is shown a bullet cartridge 6 comprising a bullet 38 seated and crimped in the mouth 41 of a case 40. The case 40 includes a case wall 42 containing propellant 43 and a rim 44 containing a primer compound 45 in a rim cavity to ignite the propellant in cooperation with the firing pin of the weapon. The bullet cartridge shown conforms to a rimfire .22 LR cartridge, but the current invention is not limited to such cartridges and can include the use of bullet cartridges and bullets (alone) of various sizes. The bullet 38 includes a polymer coating or outer layer 48 covering and conforming to at least the exposed shape of the bullet core 46, and, in some embodiments. Each of the bullet cartridges has an outer polymer coating having a color and the plurality of bullet cartridges comprise bullets of two or more different colors. Examples of bullet colors include, but are not limited to, red, green, aqua green, gray, blue, navy blue, white, black, yellow, purple, maroon, gold, silver, pink, brown and orange.

More specifically, particular themes and associated colors may be as follows:

Patriotic Theme. Window shape and/or box graphic may be a flag, a bell, a patriot, bullet, muskets, geographic shape of country. Bullet colors and colors of the box graphics may be red, white, and blue with respect to the United States. Other colors for other countries.

Sports Team or Sport. Window shape and/or graphic on box may be a player, sport equipment and balls. For example, baseball bats, baseball gloves, footballs, baseballs, football helmets, baseball helmets, players wearing the equipment. Colors of the bullets and/or box graphic colors may two or three colors selected from the following: red, green, aqua green, gray, blue, navy blue, white, black, yellow, purple, maroon, gold, silver, pink, brown and orange. The colors may be colors affiliated with a specific sport team in college sports, the MLB, NFL, and NBA. The sport may be auto racing, with the window shape and/or box graphic being an automobile or other racing vehicle, the bullet and/or box graphics being colors associated with a specific racing team for example.

Hunting. Window shape and/or graphic may be an animal or animal head, particularly a game animal, a mountain landscape, a target of concentric circles, a riflescope image with cross hairs, cartridges, firearms, or ATV's. A logo of a ammunition manufacturer, letters or a word. In embodiments, the box graphic may include camouflage. Bullet colors and box graphic colors may be green, brown, and white. In embodiments also red, aqua green, blue, navy blue, black, yellow, purple, maroon, gold, silver, pink, and orange.

Charitable cause. Window shape and/or graphic can be a ribbon assembly, bullet and/or box graphic color can be pink.

Holiday. The bullet and/or box graphic colors may be red and green. The window shape and/or box graphics may be a Christmas tree, a Santa Clause, a reindeer, or a sled. The holiday may be Halloween, with the bullet and/or box colors be orange and black. The window opening shape may be a pumpkin, a monster, or a ghost.

Figure 12:
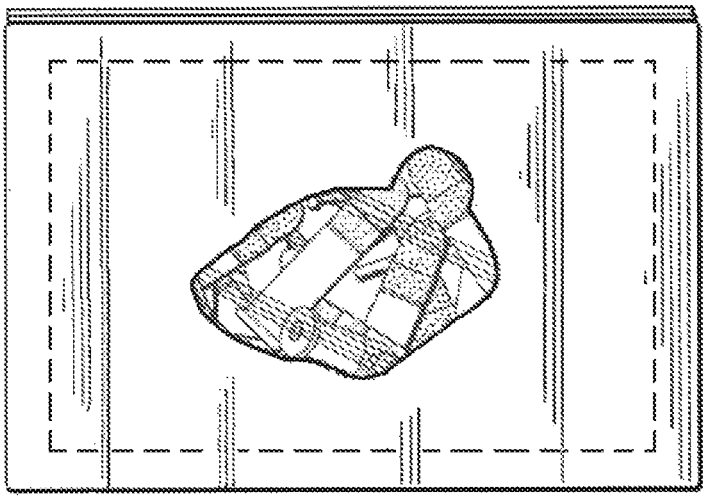
FIGS. 12-24 are front plan views of cartridge packaging containing cartridges according to embodiments of the invention.
Figure 13:
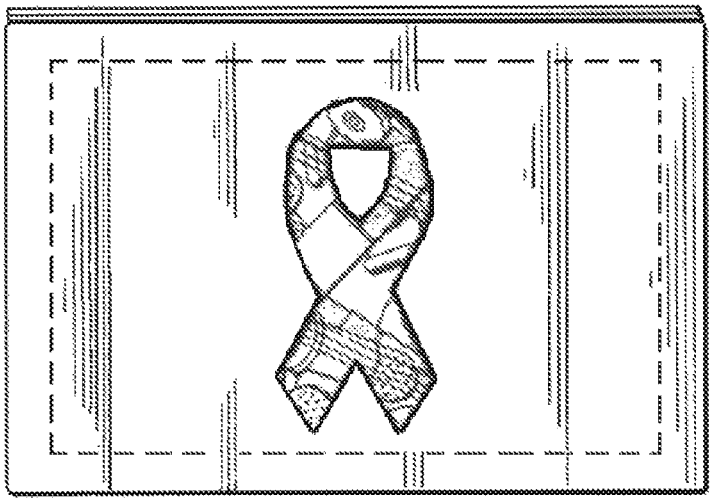
Figure 14:
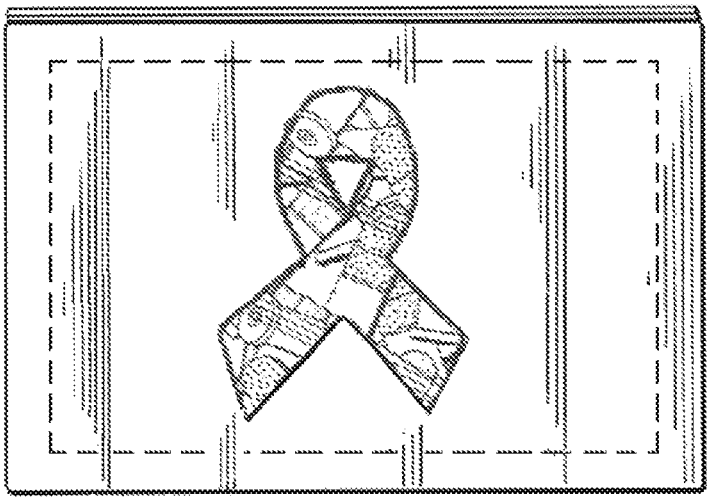
Figure 15:
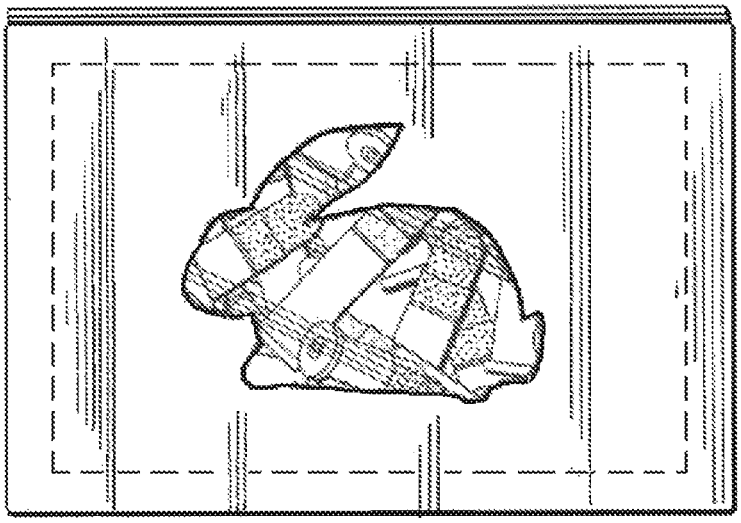
Figure 16:
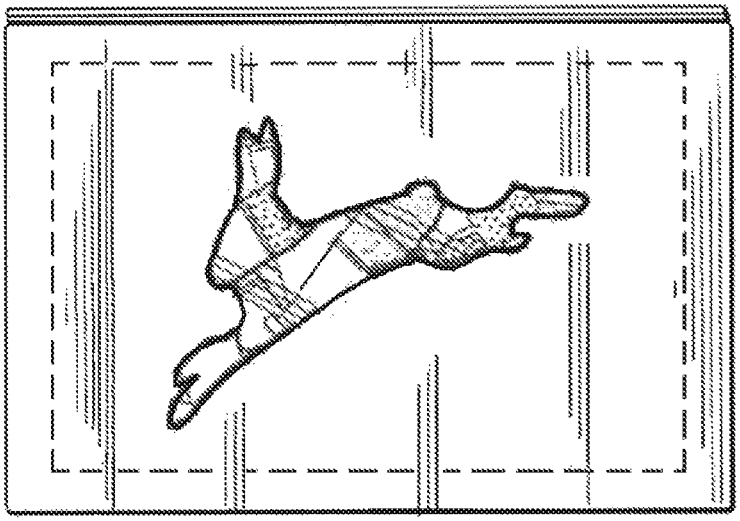
Figure 17:
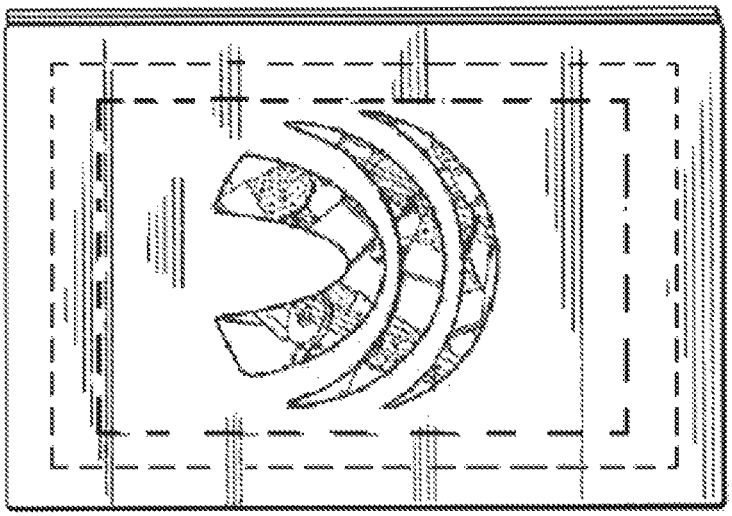
Figure 18:
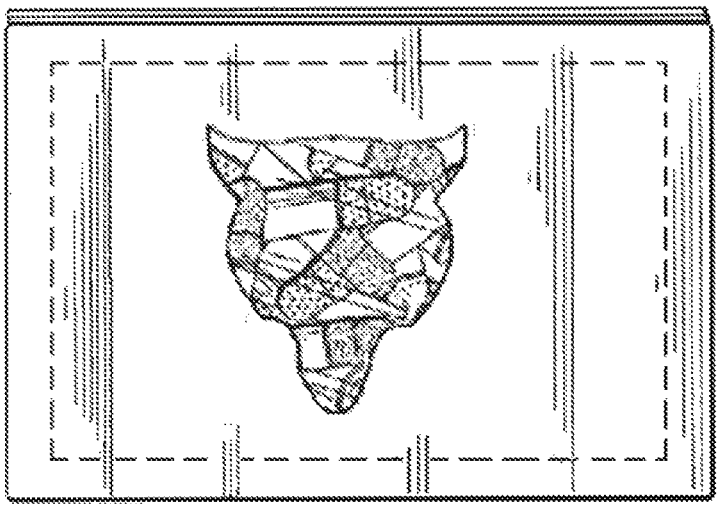
Figure 19:
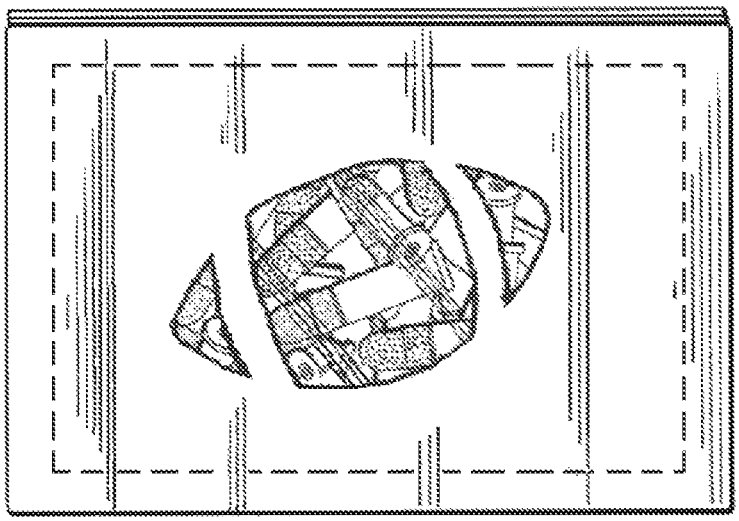
Figure 20:
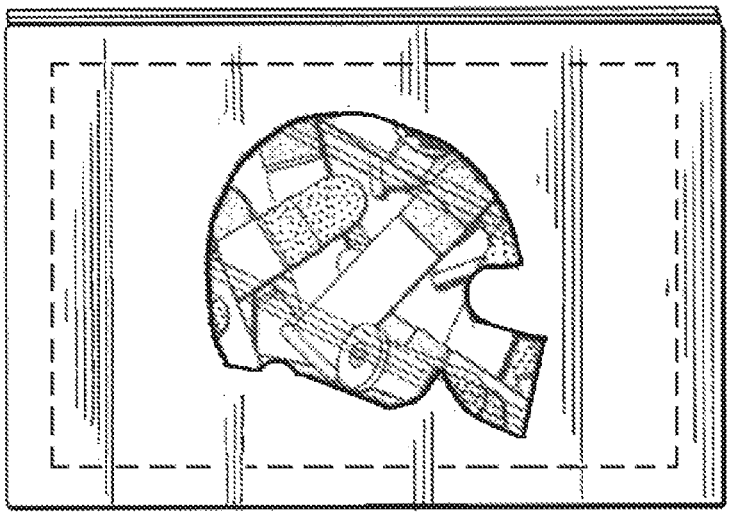
Figure 21:
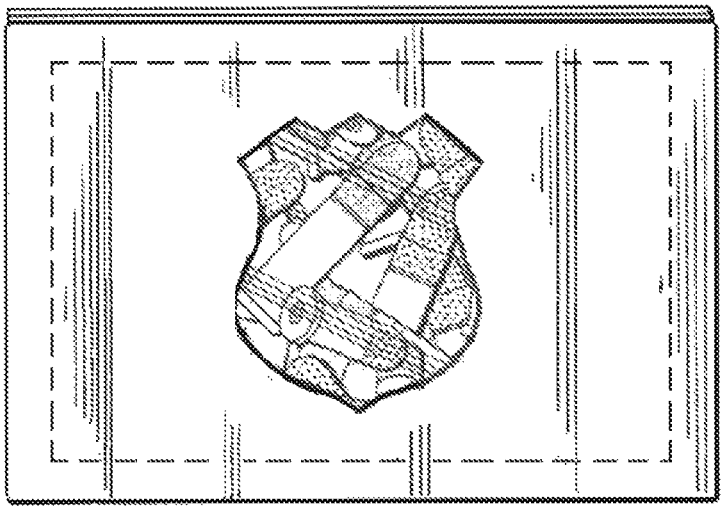
Figure 22:
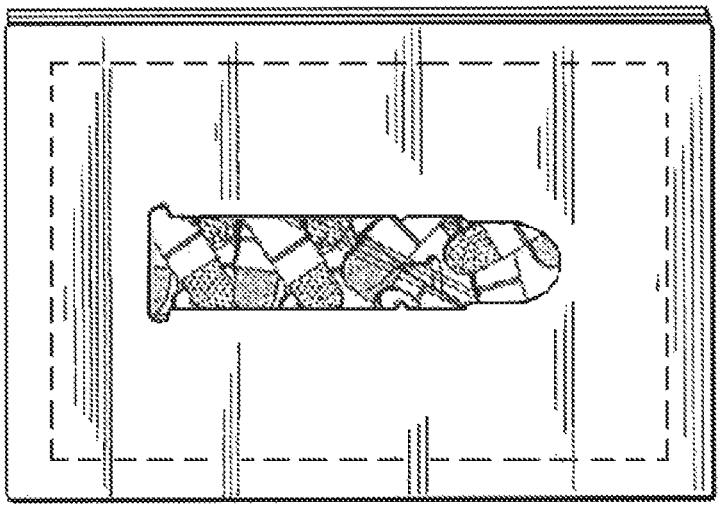
Figure 23:
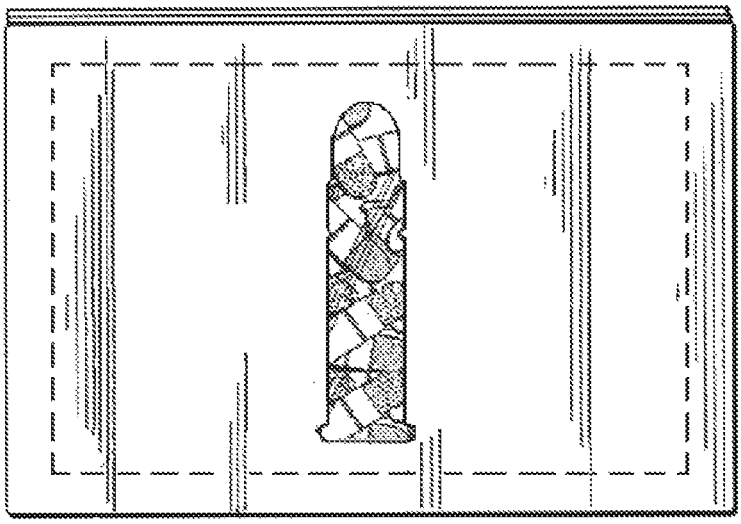
Figure 24:
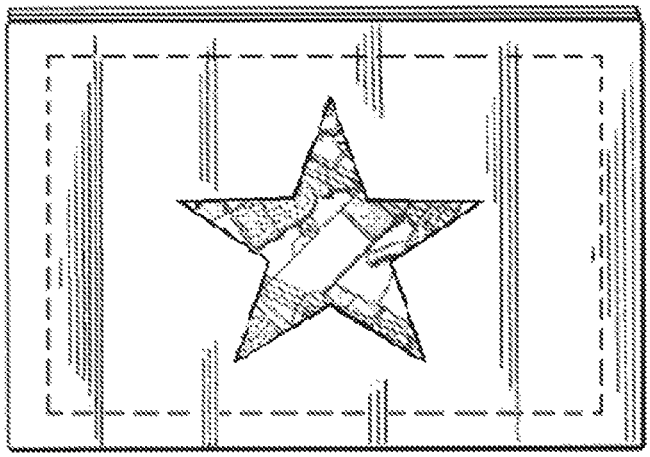
Figure 25:
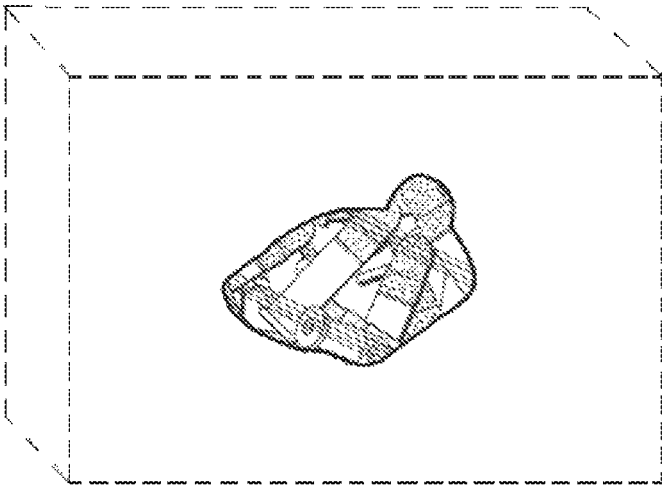
FIGS. 25-37 are front, left, top perspective views of cartridge packaging containing cartridges according to various embodiments of the invention.
Figure 26:
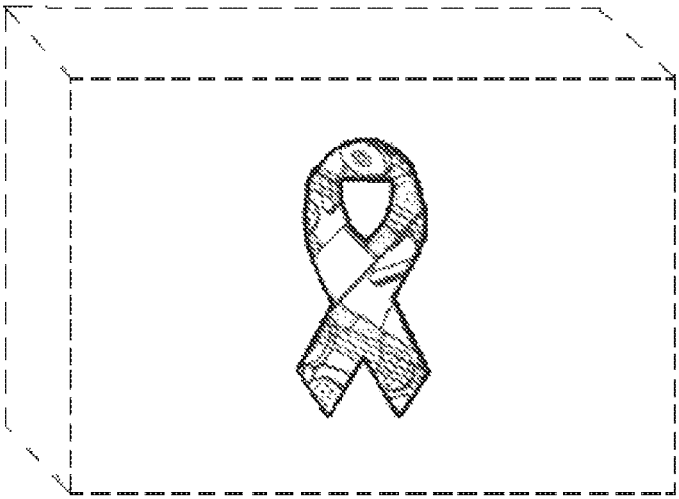
Figure 27:
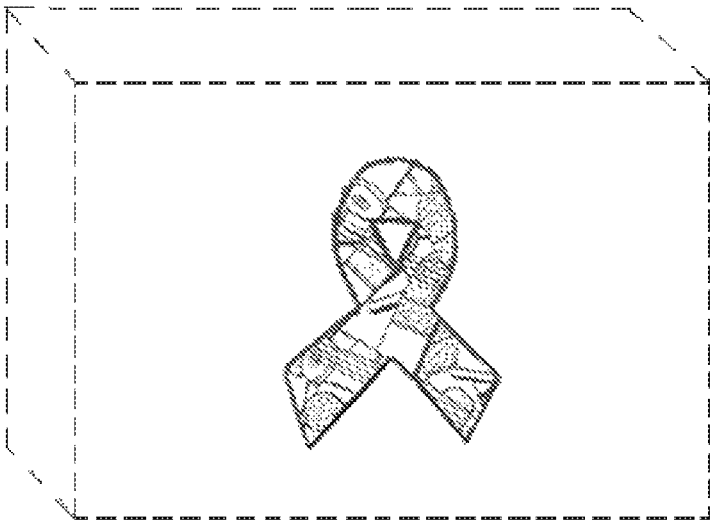
Figure 28:
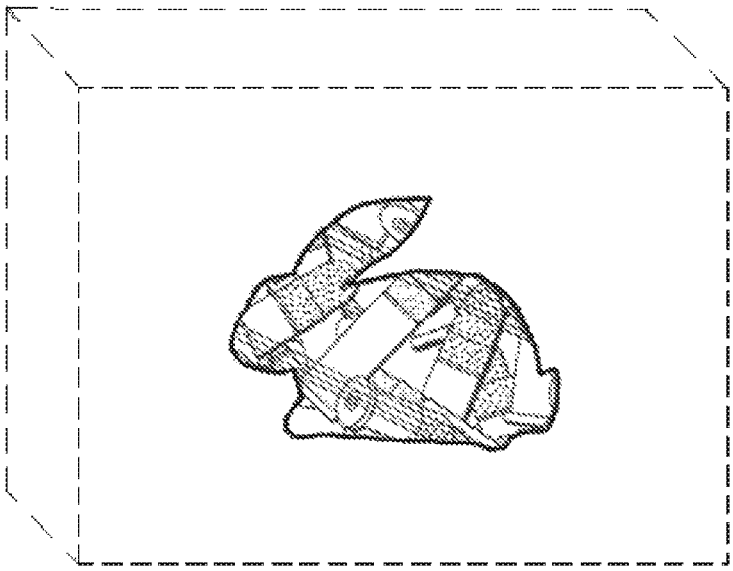
Figure 29:
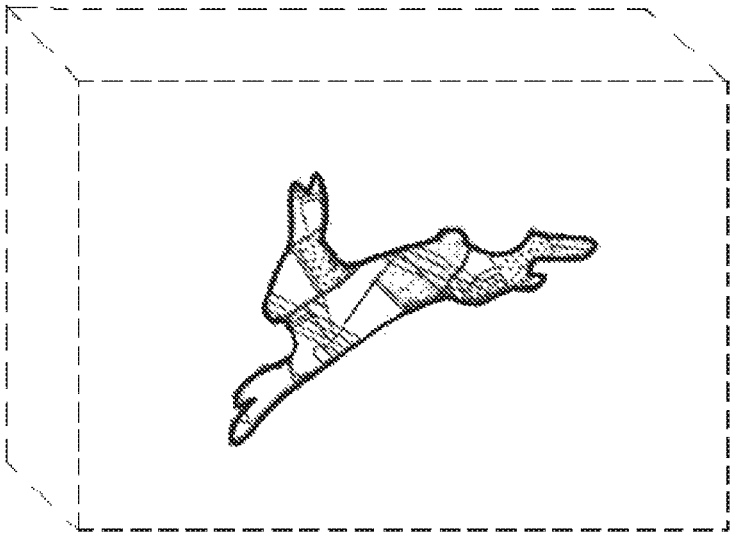
Figure 30:
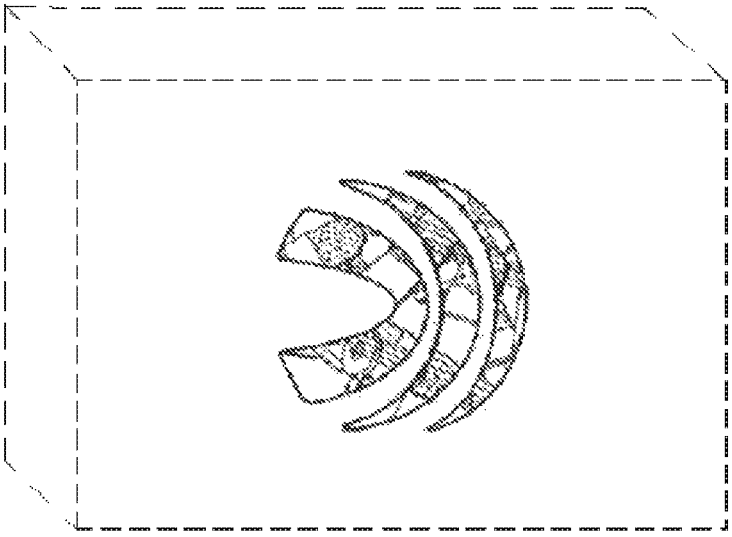
Figure 31:
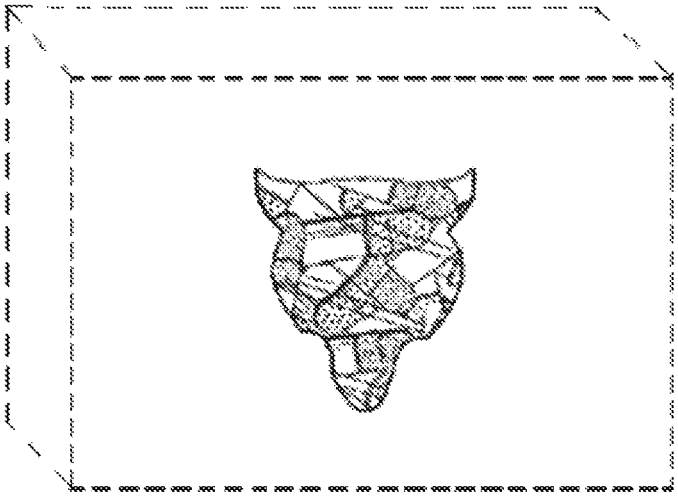
Figure 32:
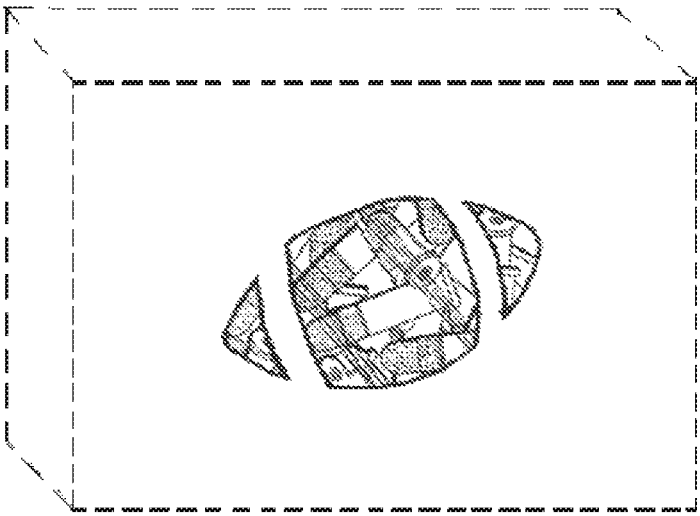
Figure 33:
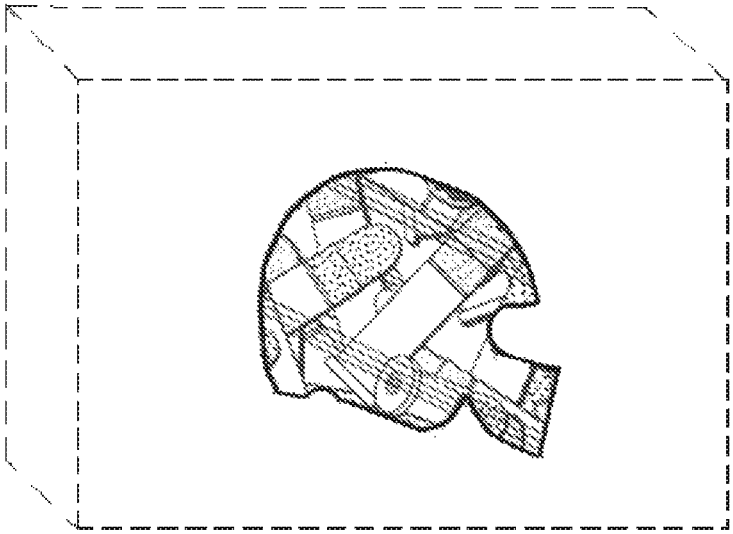
Figure 34:
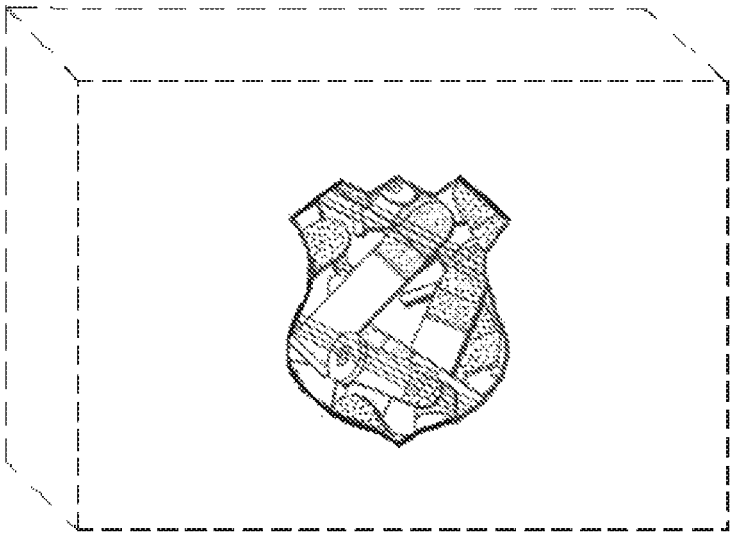
Figure 35:
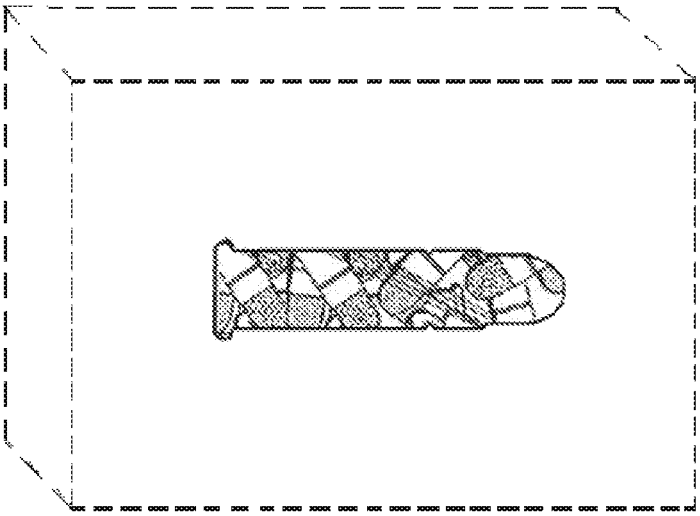
Figure 36:
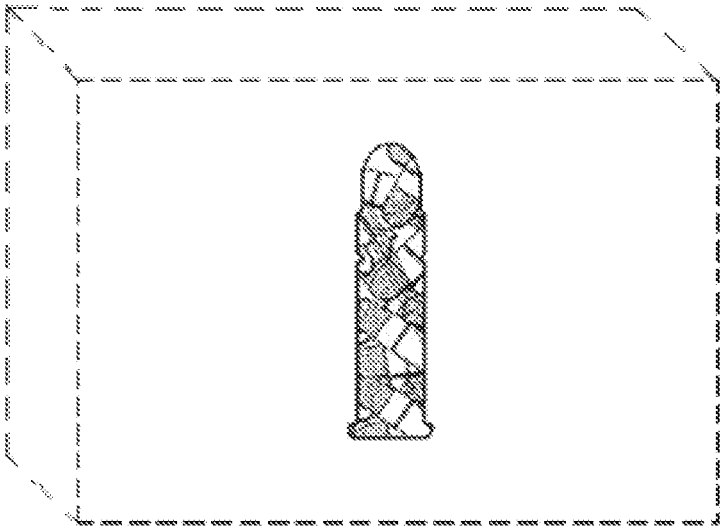
Figure 37:
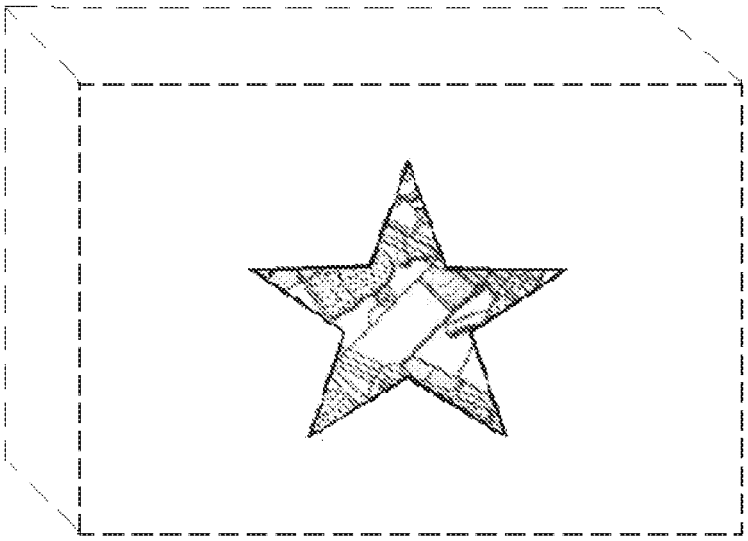
Figure 131:
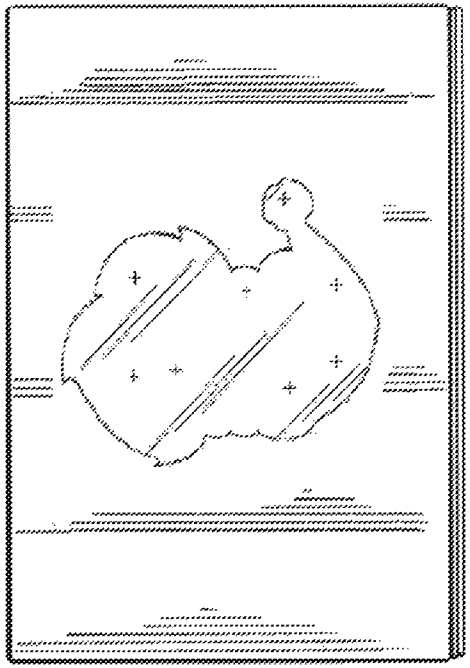

FIGS. 12-131 illustrate cartridge packaging according to embodiments of the invention. Broken lines shown in the drawings illustrate the environment of the claimed design and form no part of the claimed design. Applicant reserves the right to claim the ornamental designs for cartridge packaging as shown in one more design patent applications. Further examples of opening 18 shapes are shown in FIGS. 12-131.

FIGS. 12-24 and 87-131 are front plan views of cartridge packaging containing cartridges according to various embodiments of the invention. The figures show the front panel of the packaging. The packaging is a box having the front panel and left, right, rear, top and bottom sides, as described above. Views of the further sides can be seen in FIGS. 3-7.

In FIGS. 12-24, the broken lines near the outer margin of the front panel forming a rectangle in this view (as described above) indicate the outline of a sheet of transparent material attached to the inside of the front of the cartridge packaging.

FIGS. 25-37 and 42-86 show front, left top perspective views of cartridge packaging containing cartridges according to various embodiments of the invention. In FIGS. 25-37 and 42-86, the broken lines indicate that the window of the front panel is one a box without limitation to the specific size and shape of the box.

Figure 40:
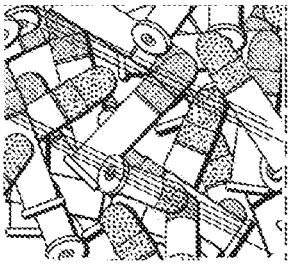
FIGS. 40 and 41 show cartridges as seen through the respective windows of cartridge packaging according to various embodiments of the invention.
Figure 41:
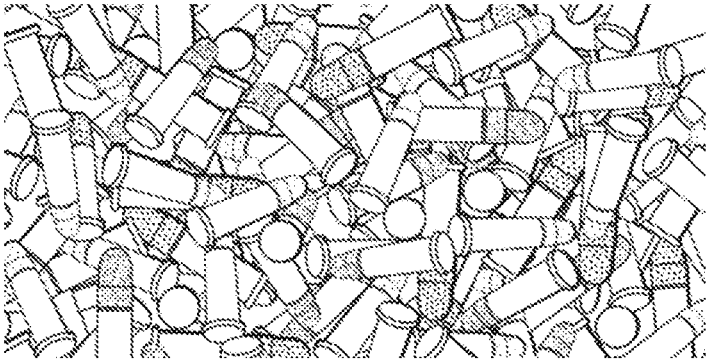
Figure 42:
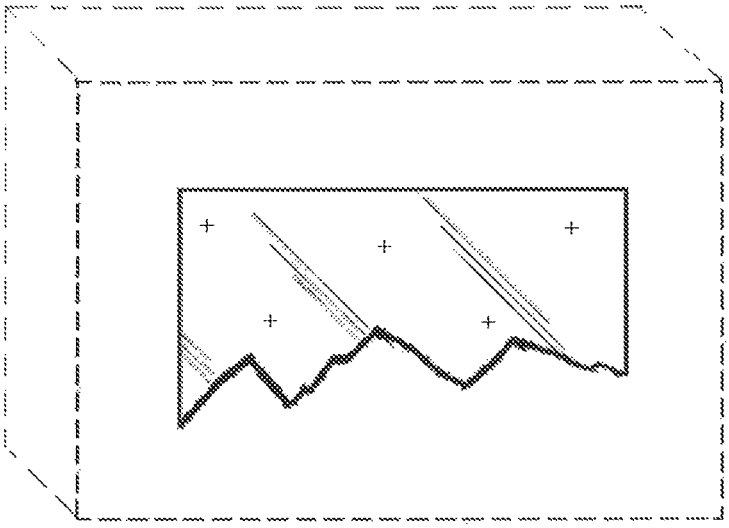
FIGS. 42-86 are front, left, top perspective views of cartridge packaging containing cartridges according to various embodiments of the invention.
Figure 43:
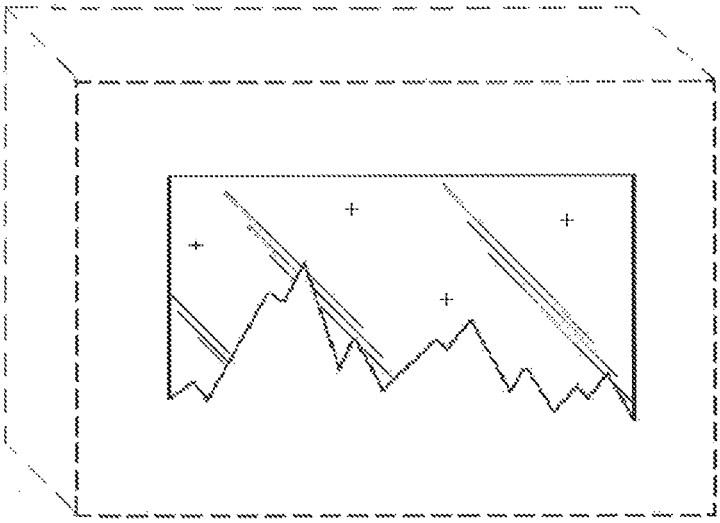
Figure 44:
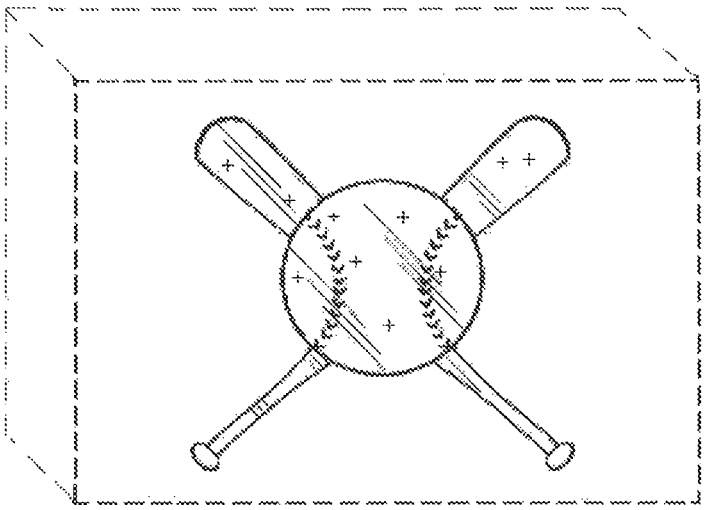
Figure 45:
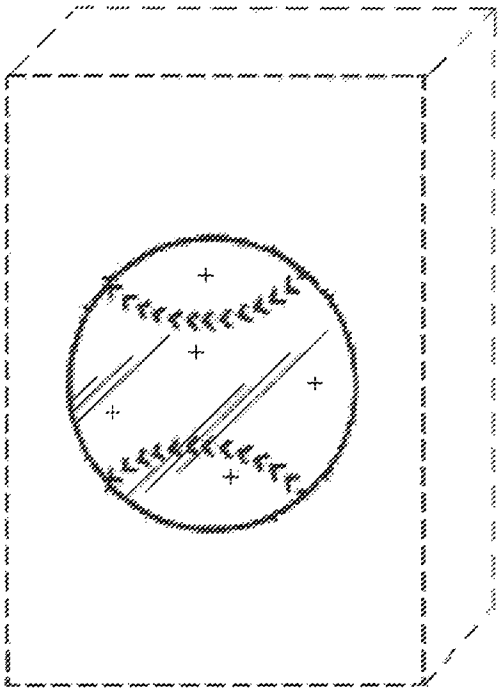
Figure 46:
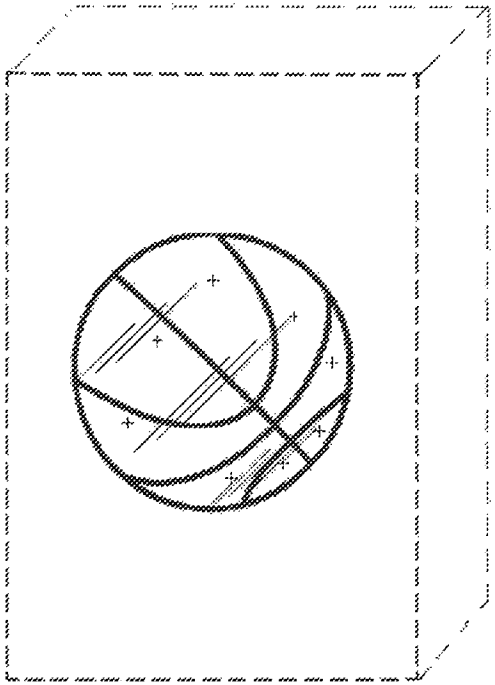
Figure 47:
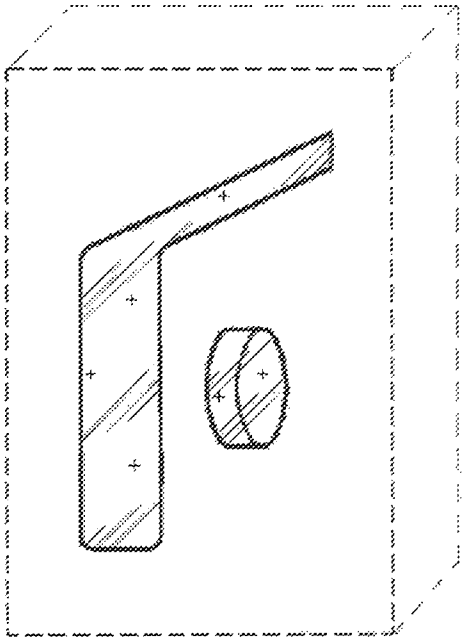
Figure 48:
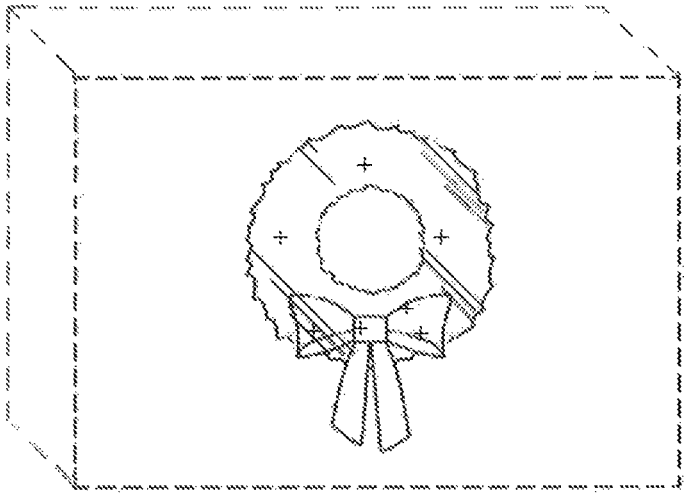
Figure 49:
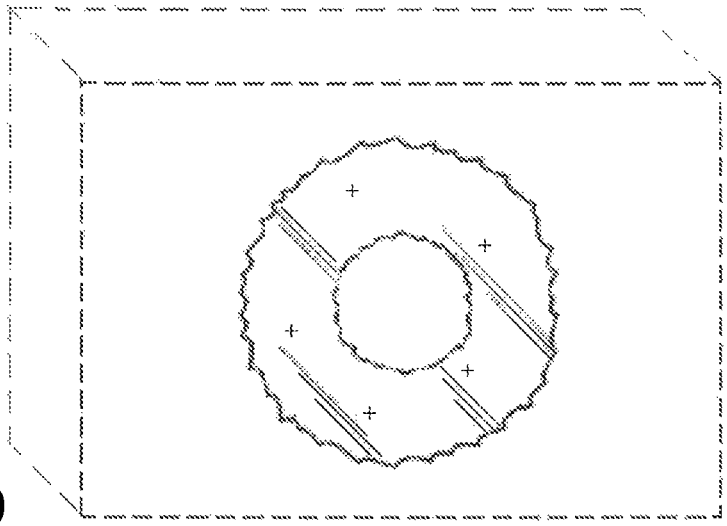
Figure 50:
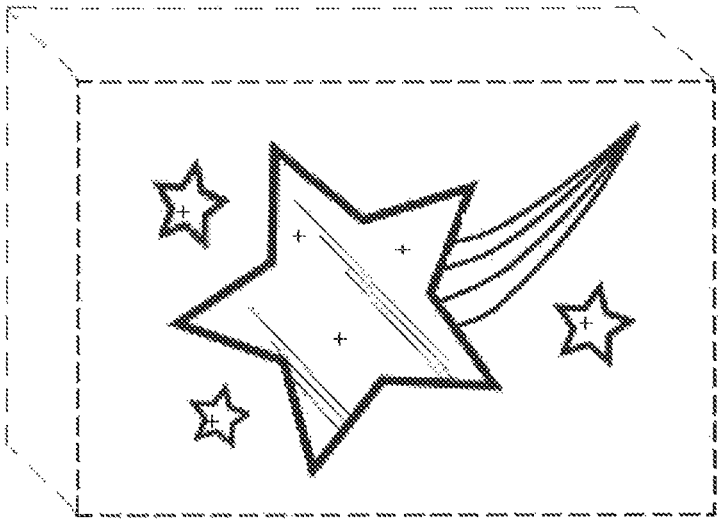
Figure 51:
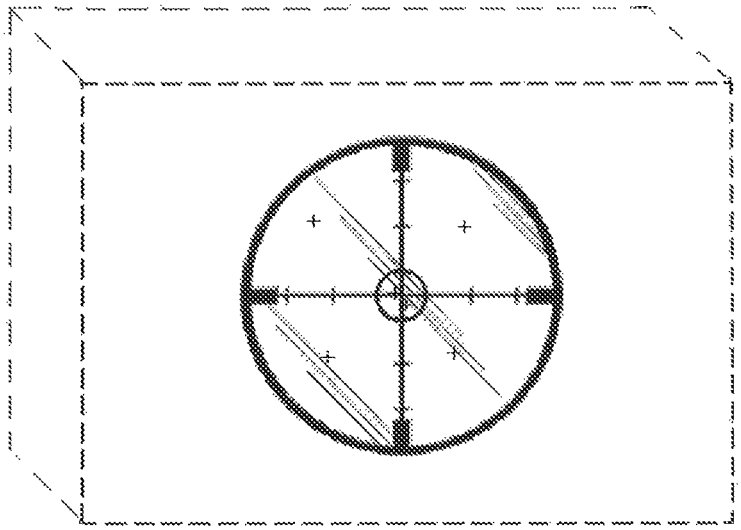
Figure 52:
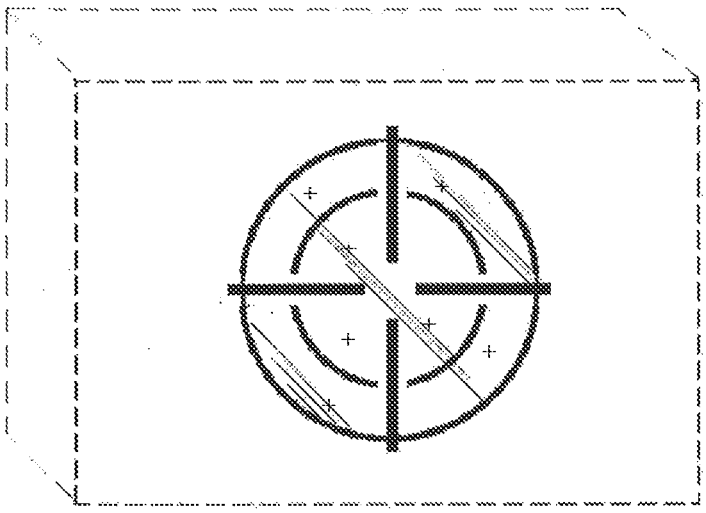
Figure 53:
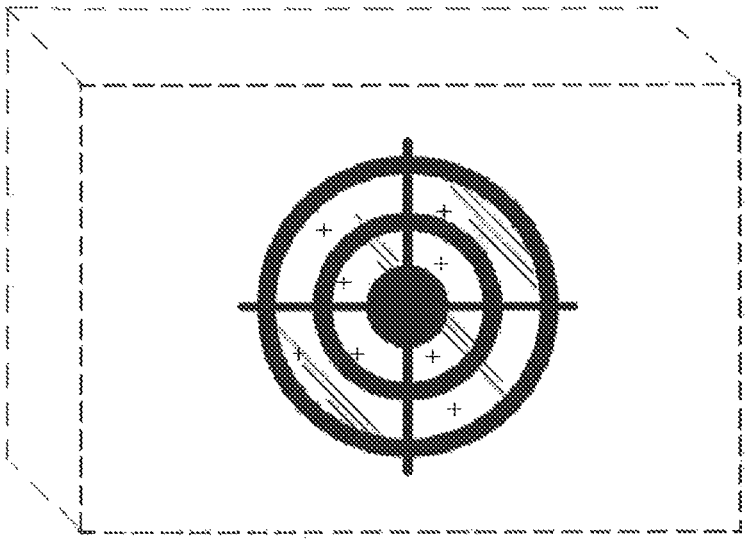
Figure 54:
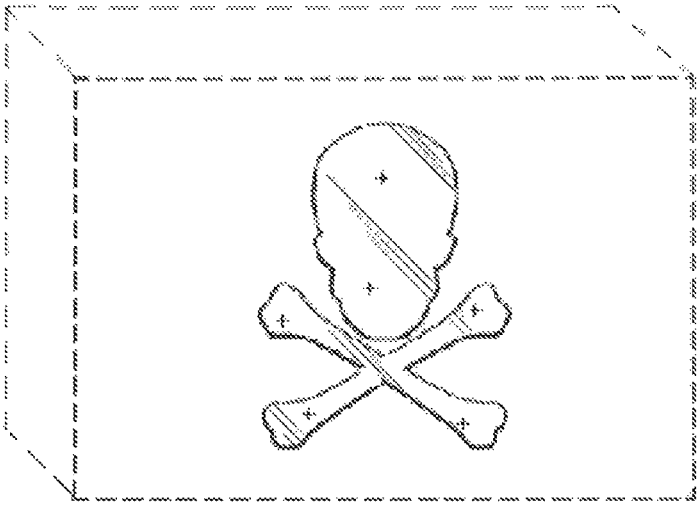
Figure 55:
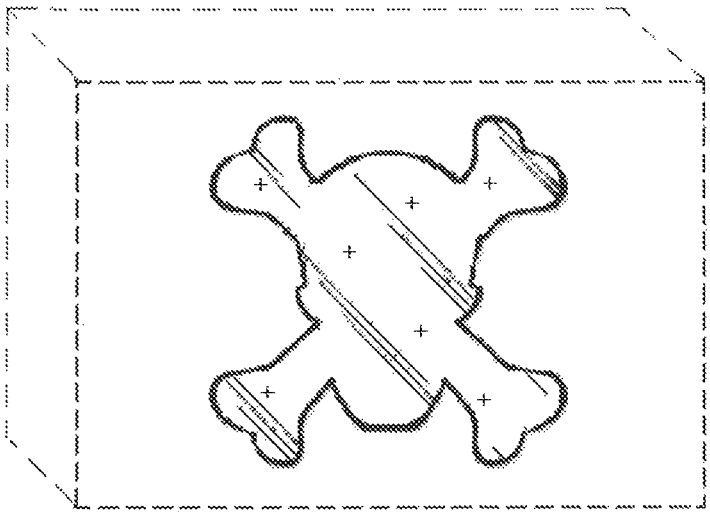
Figure 56:
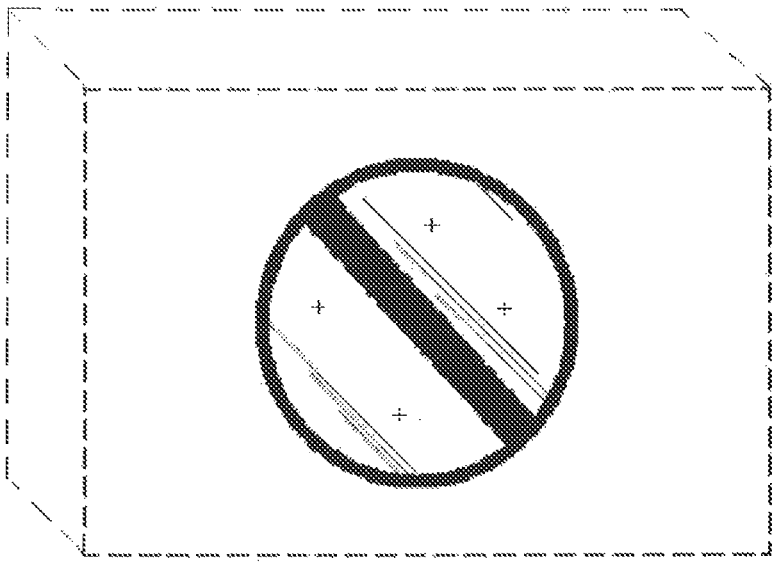
Figure 57:
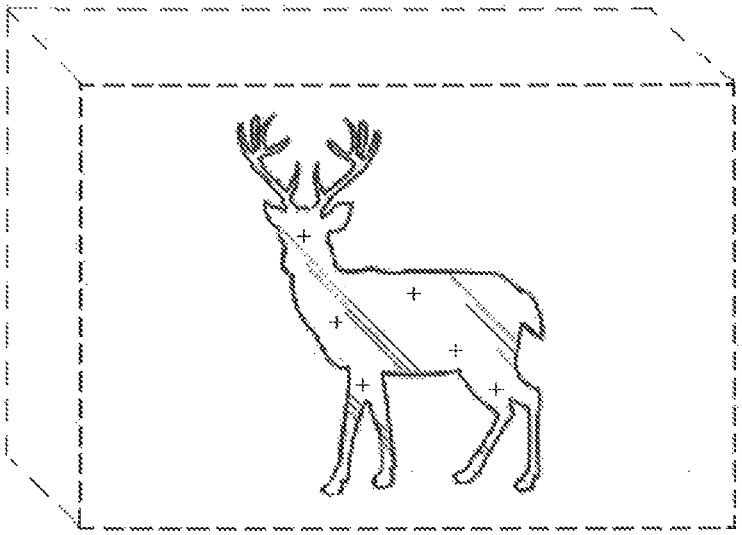
Figure 58:
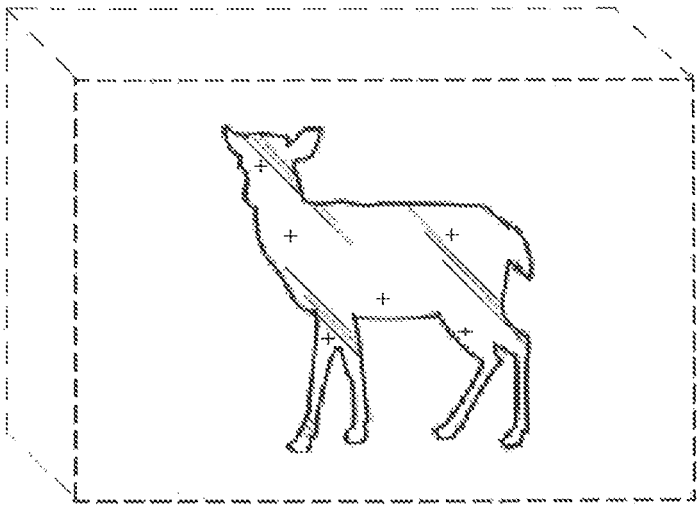
Figure 59:
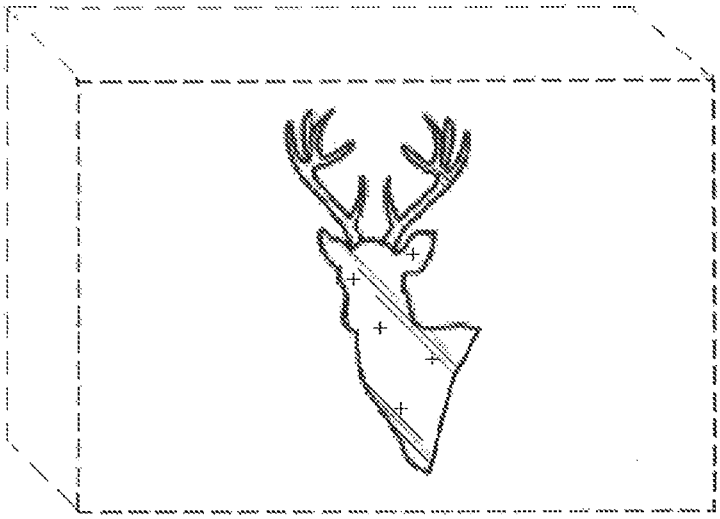
Figure 60:
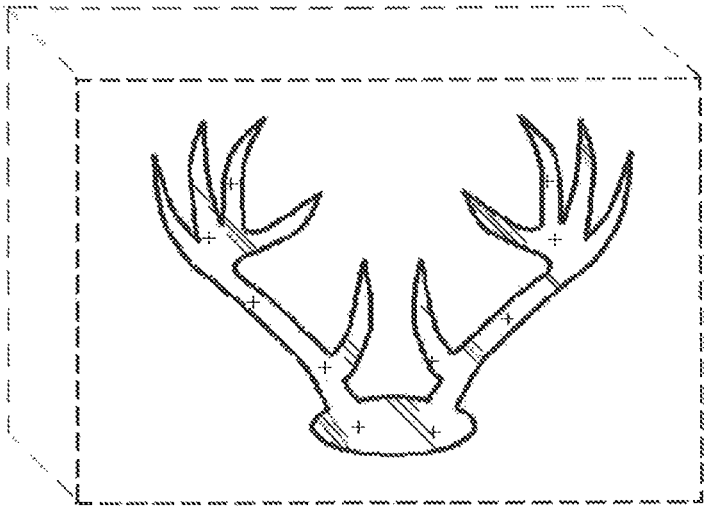
Figure 61:
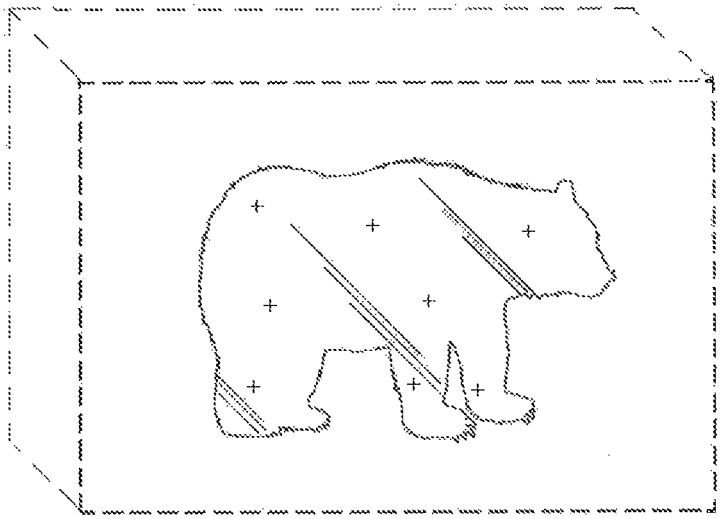
Figure 62:
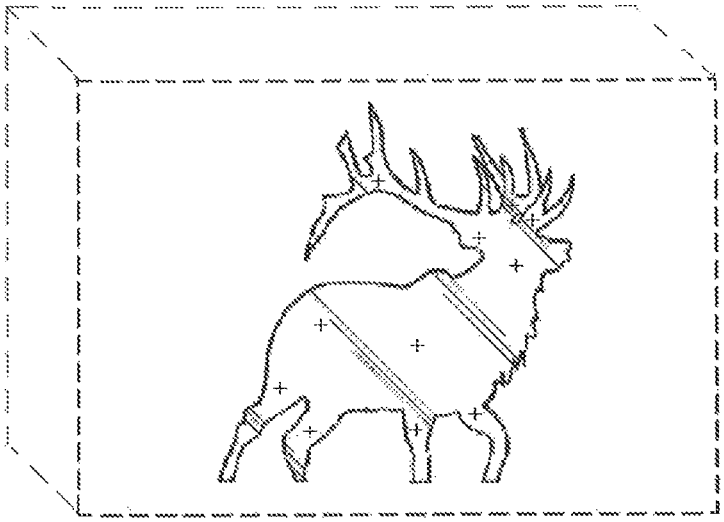
Figure 63:
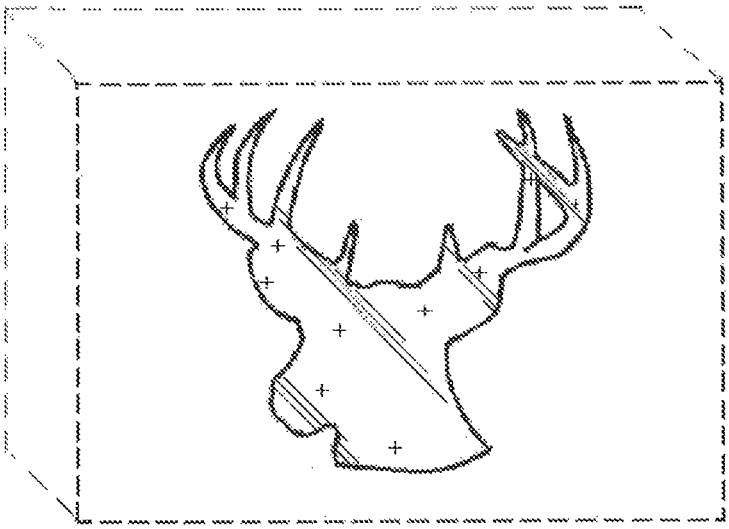
Figure 64:
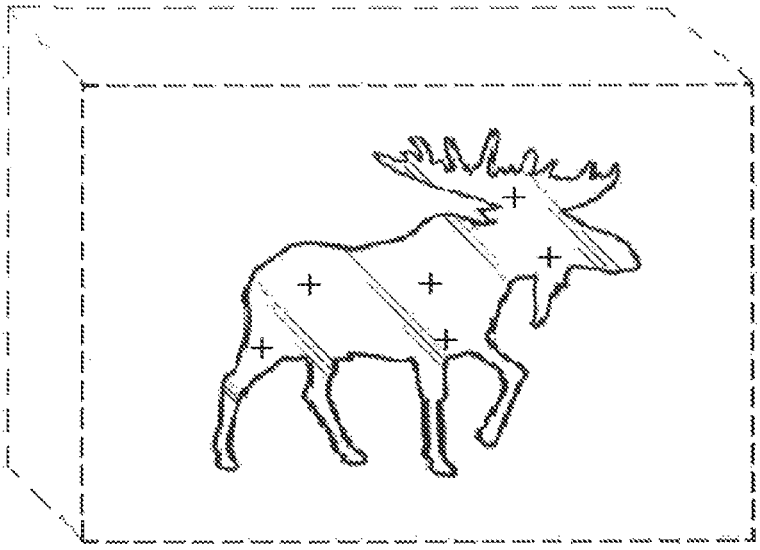
Figure 65:
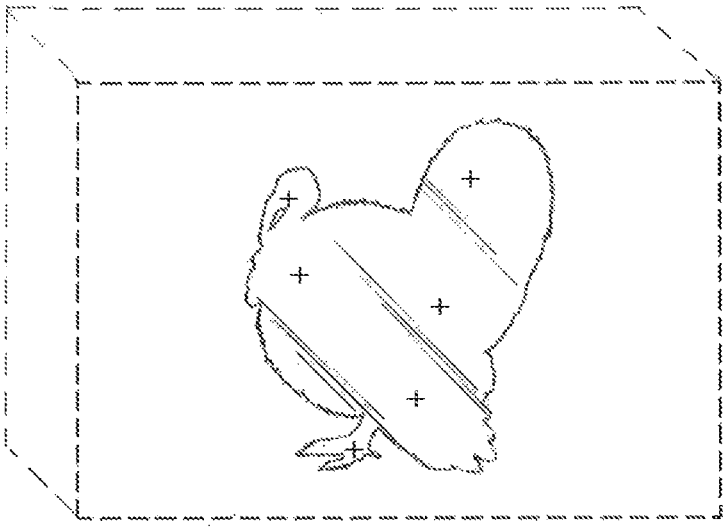
Figure 66:
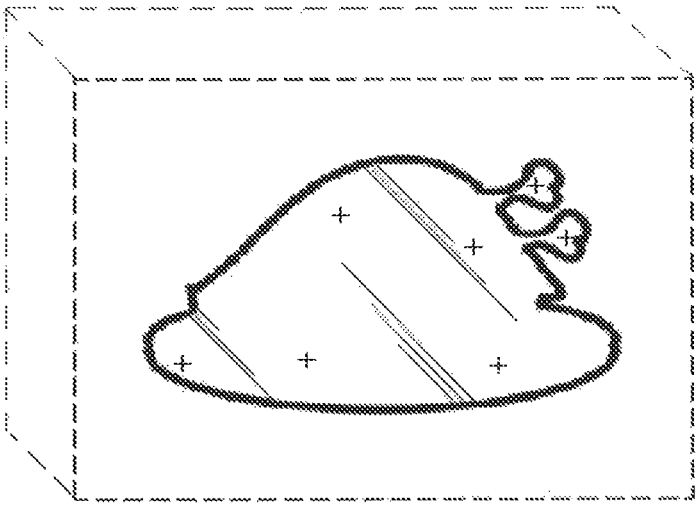
Figure 67:
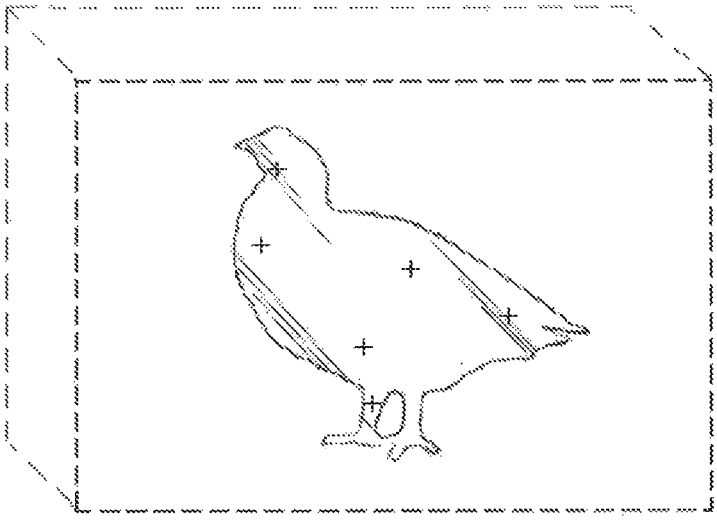
Figure 68:
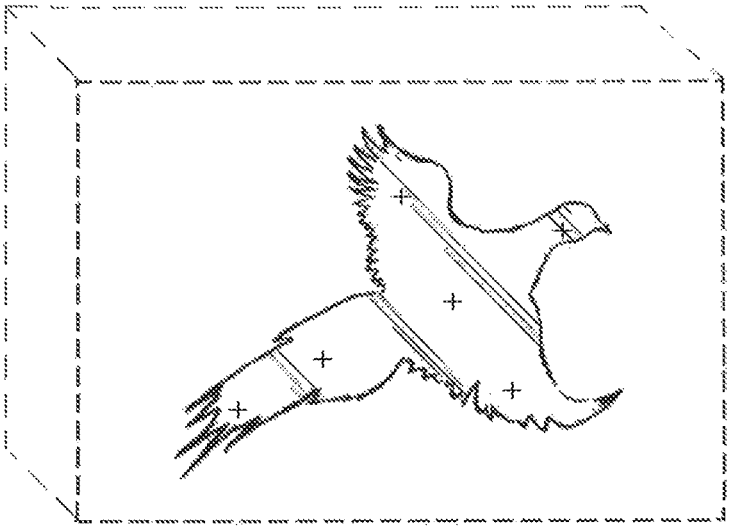
Figure 69:
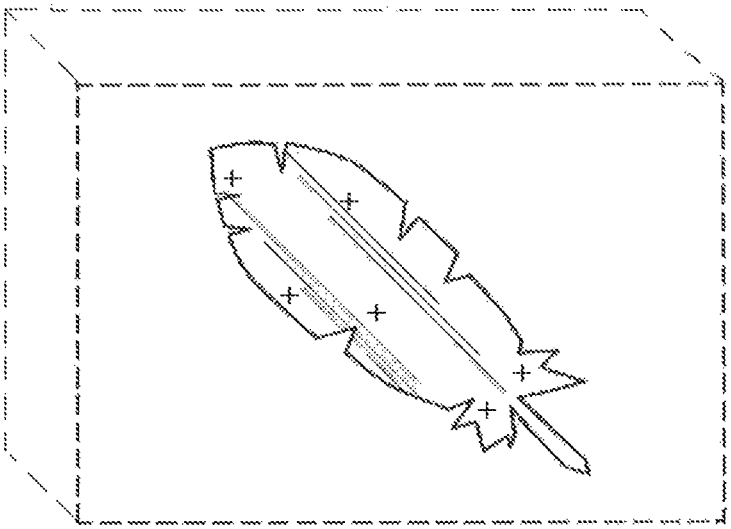
Figure 70:
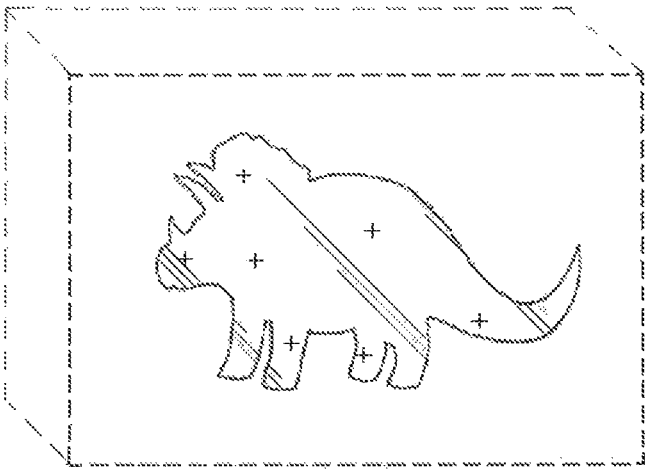
Figure 71:
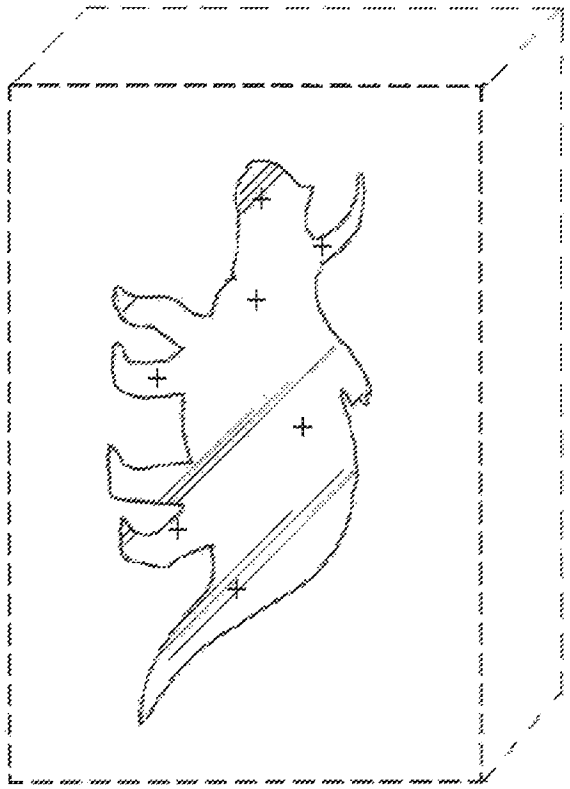
Figure 72:
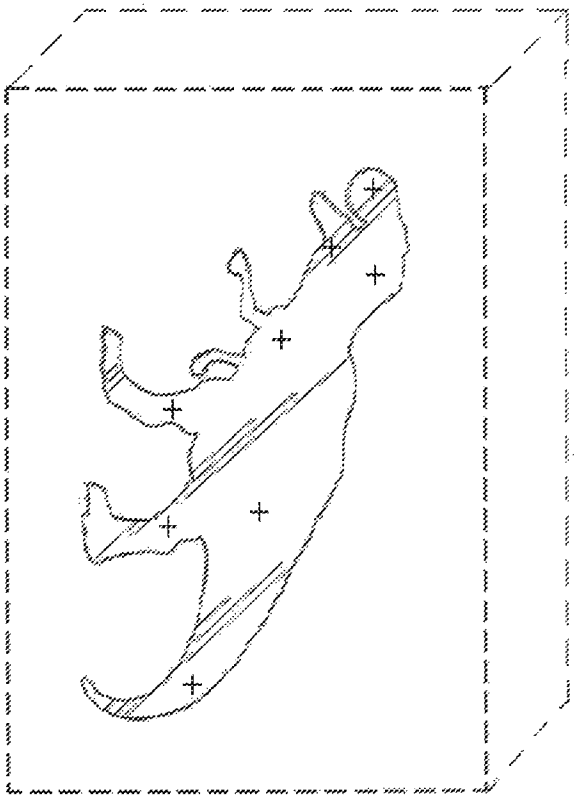
Figure 73:
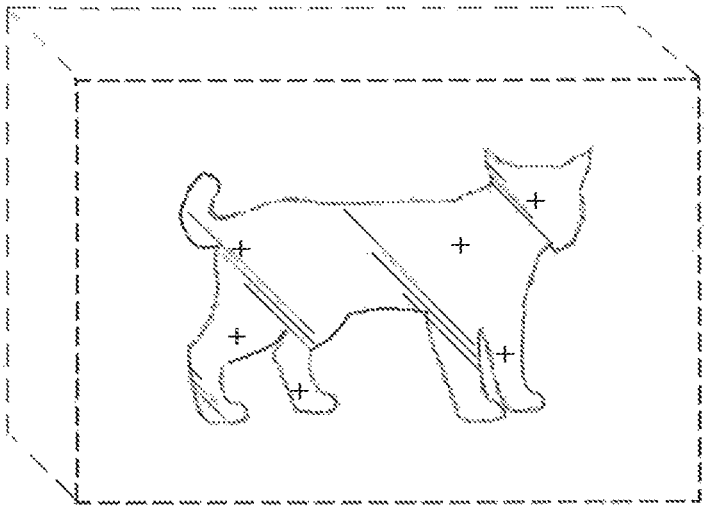
Figure 74:
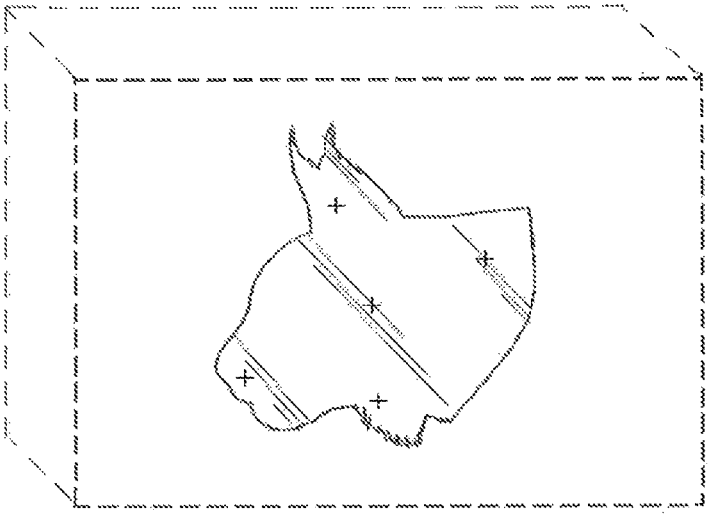
Figure 75:
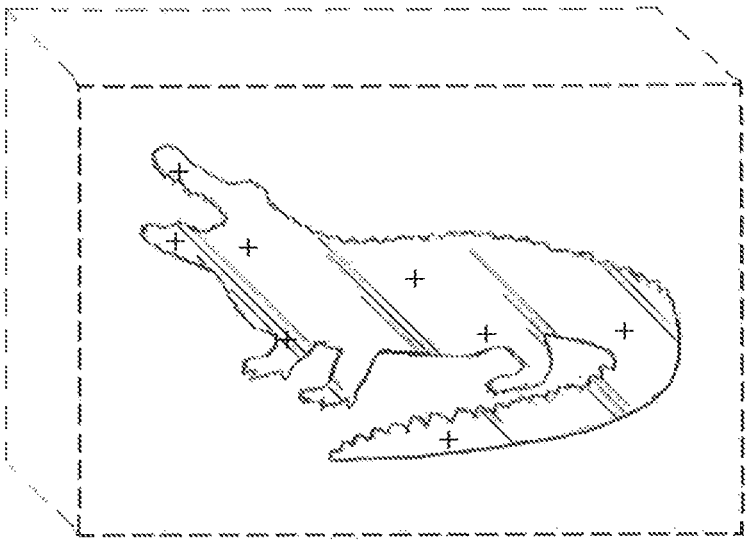
Figure 76:
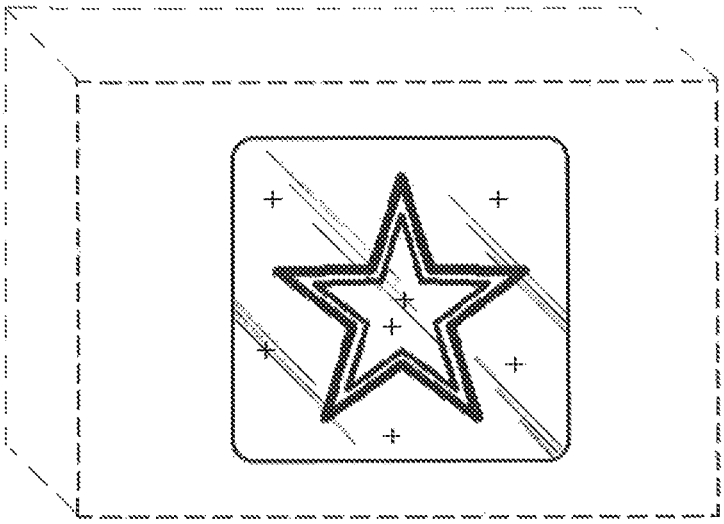
Figure 77:
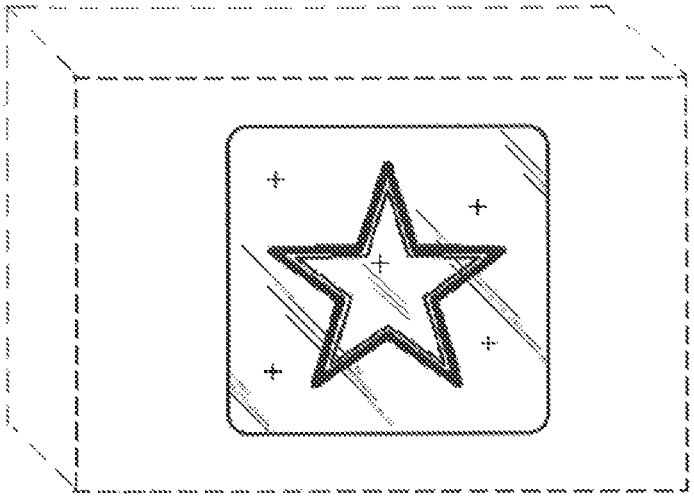
Figure 78:
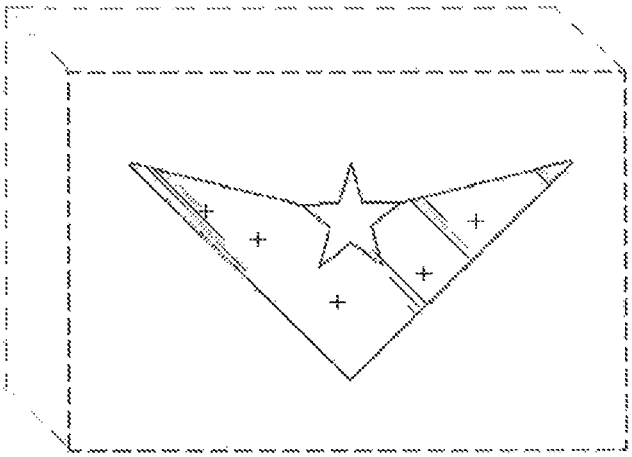
Figure 79:
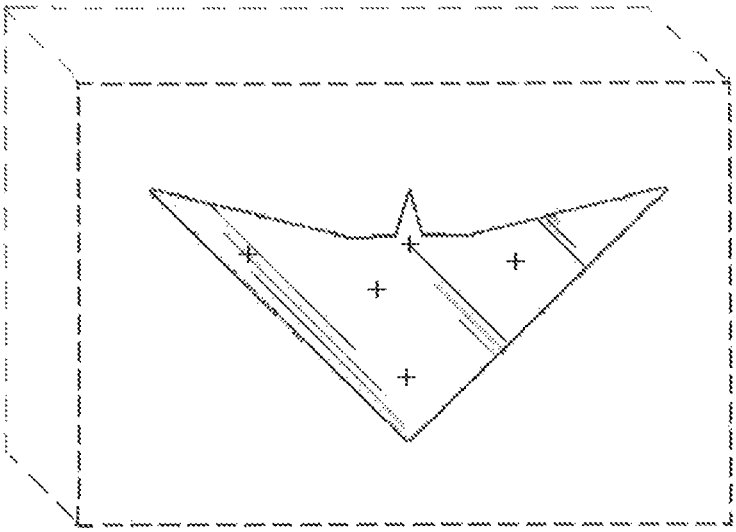
Figure 80:
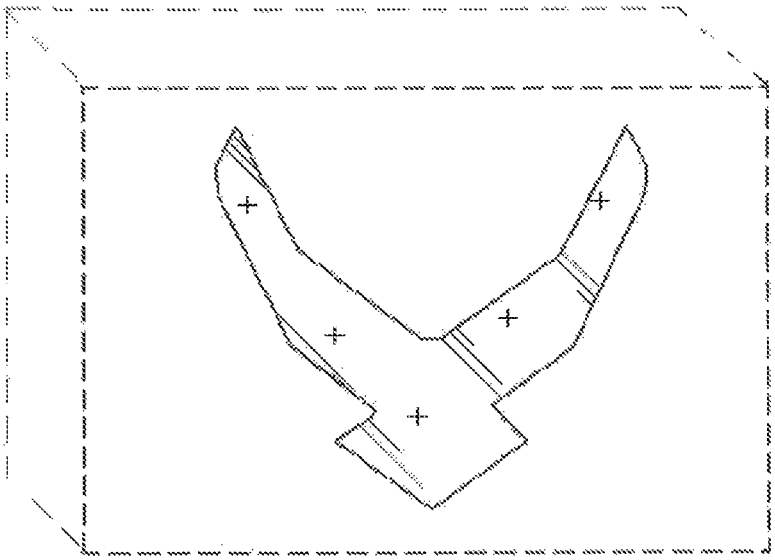
Figure 81:
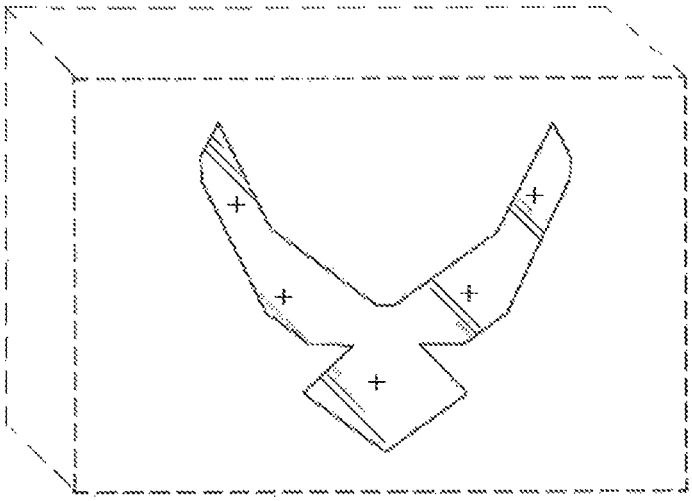
Figure 82:
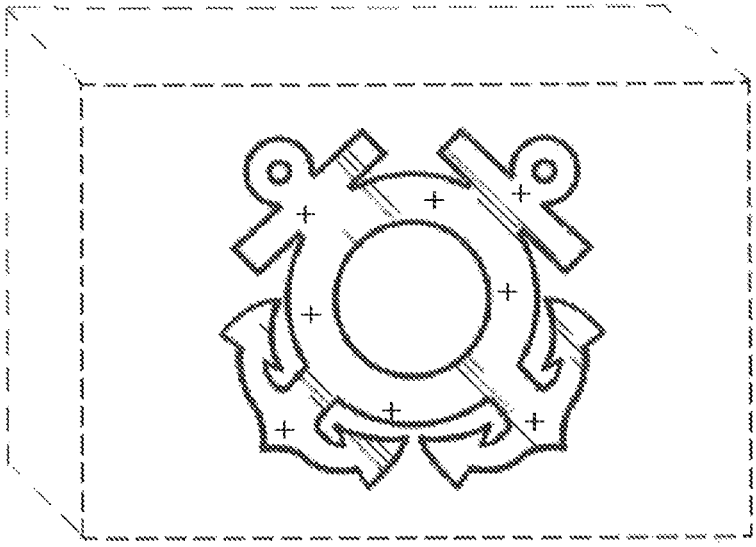
Figure 83:
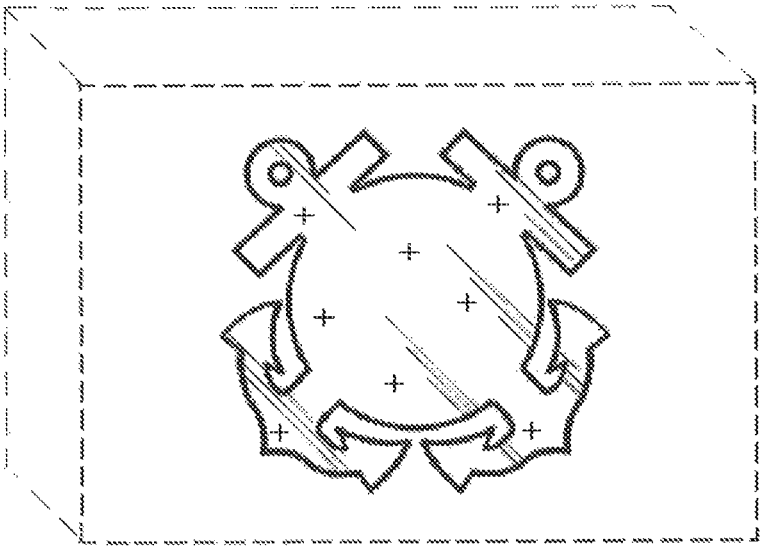
Figure 84:
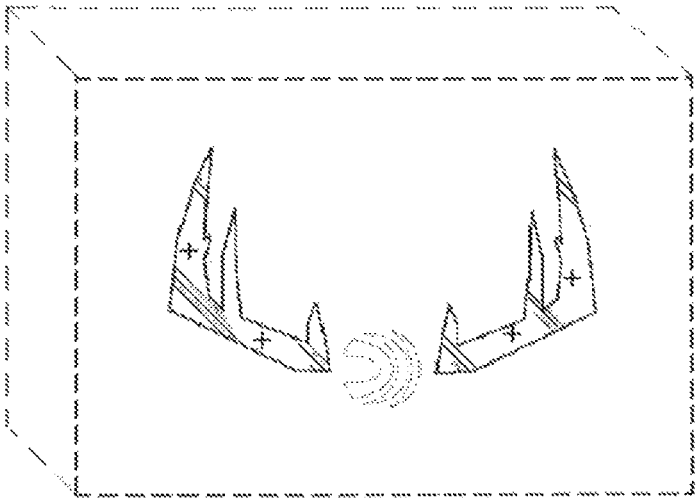
Figure 85:
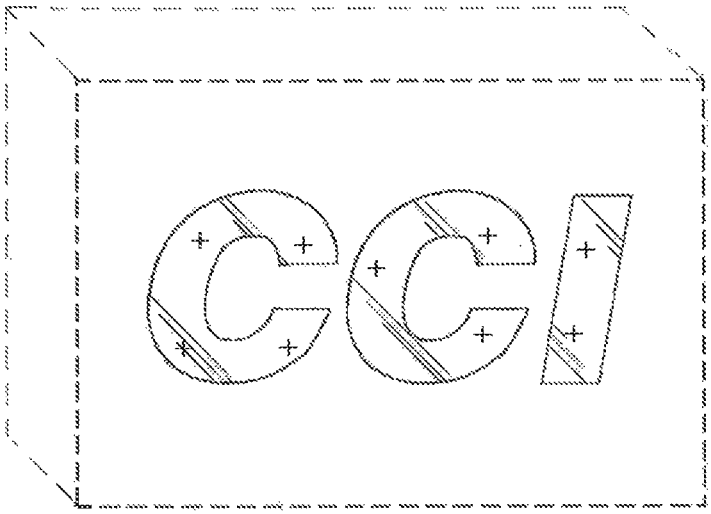
Figure 86:
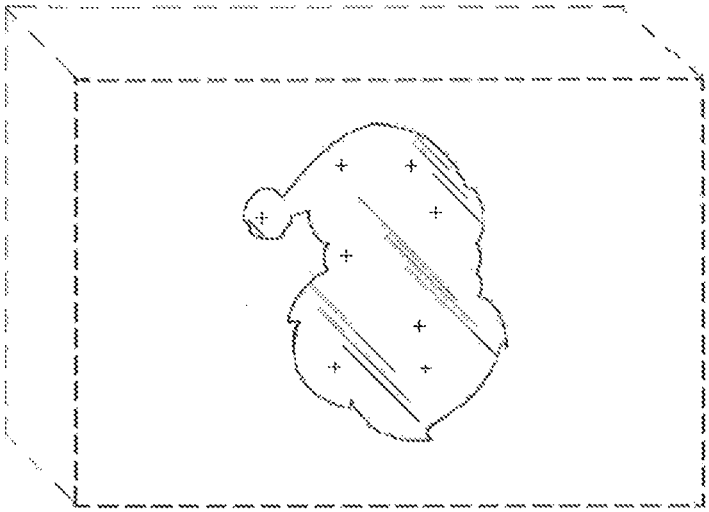
Figure 87:
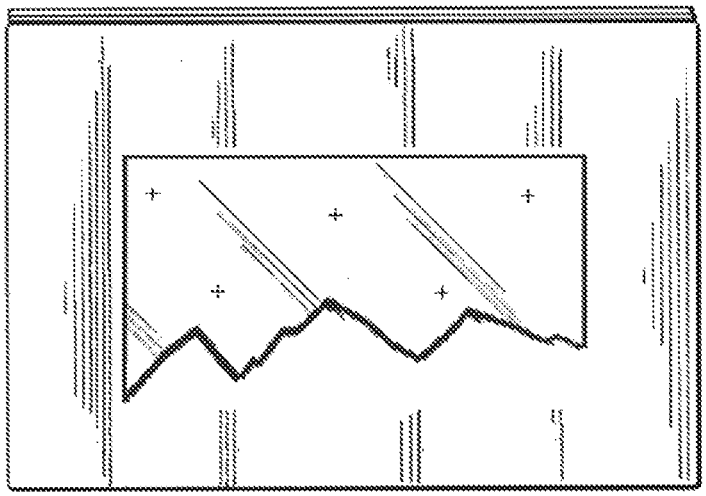
FIGS. 87-131 are front plan views of cartridge packaging according to embodiments of the invention.
Figure 88:
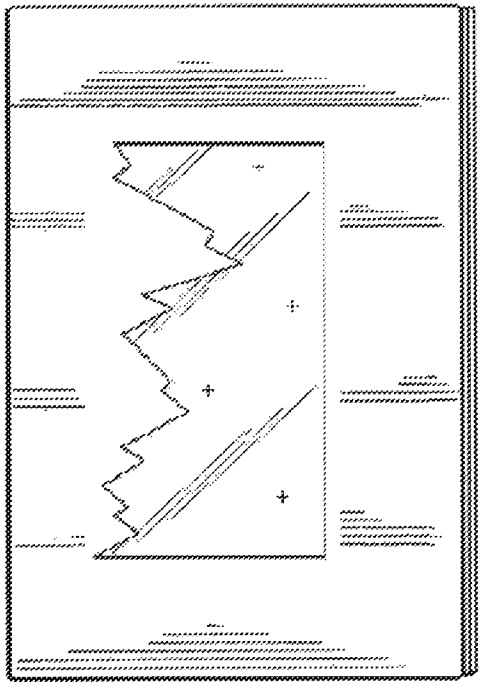
Figure 89:
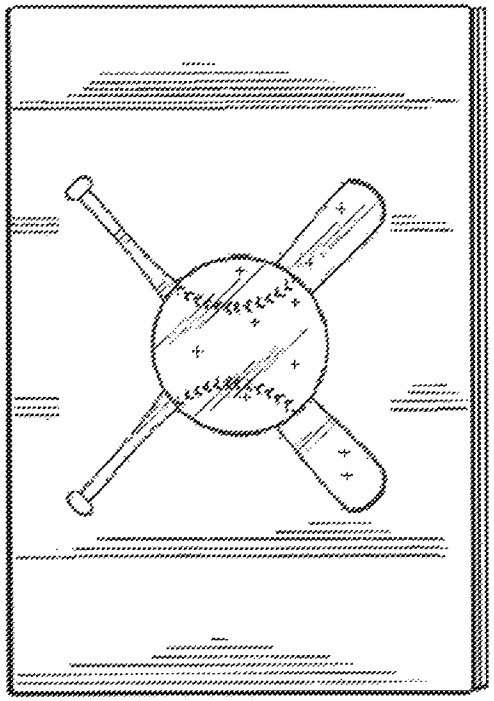
Figure 90:
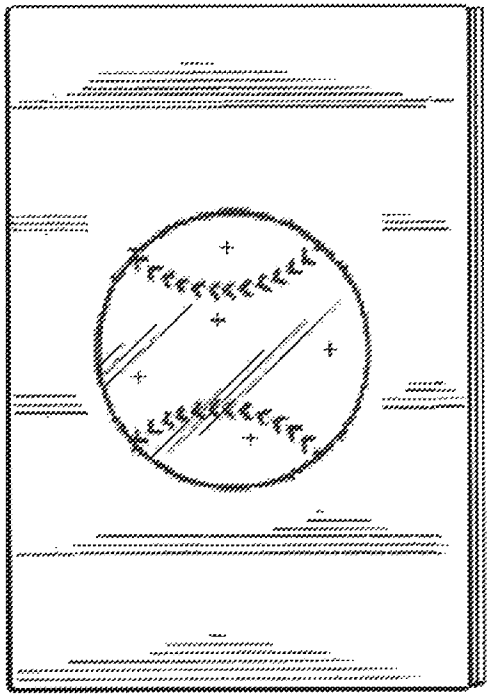
Figure 91:
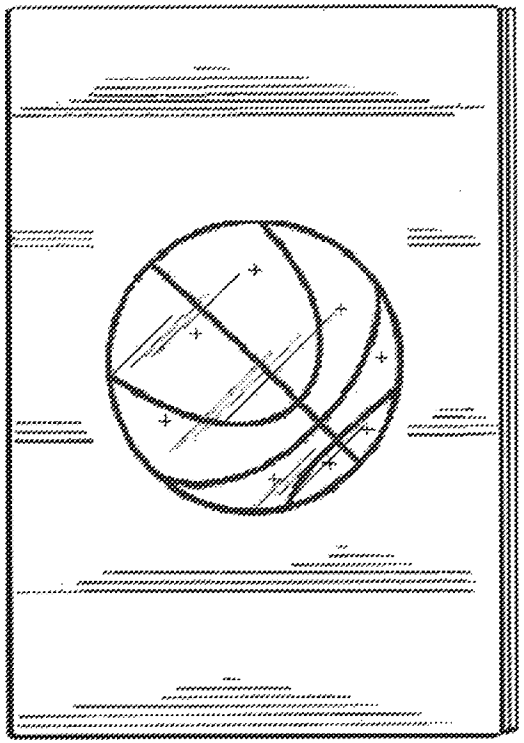
Figure 92:
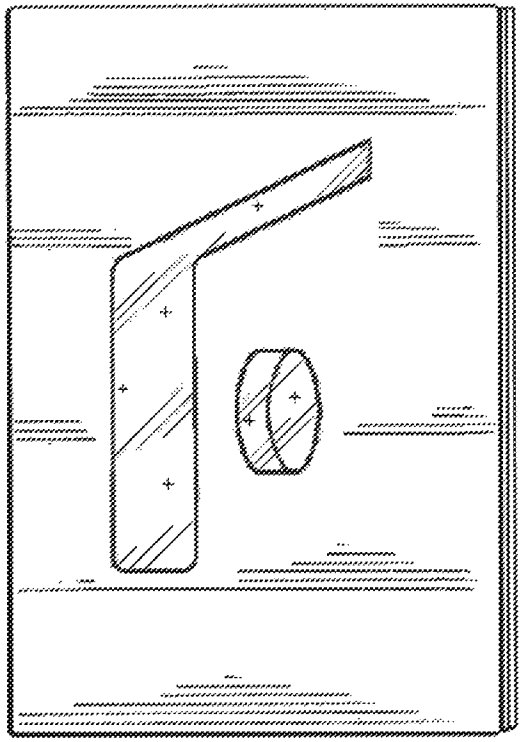
Figure 93:
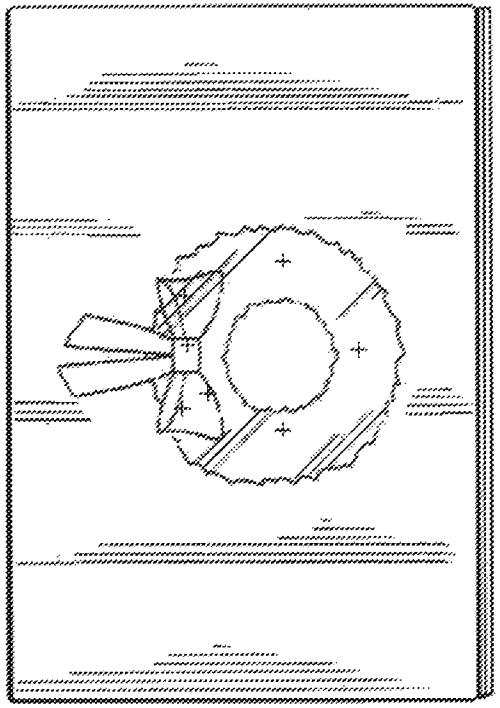
Figure 94:
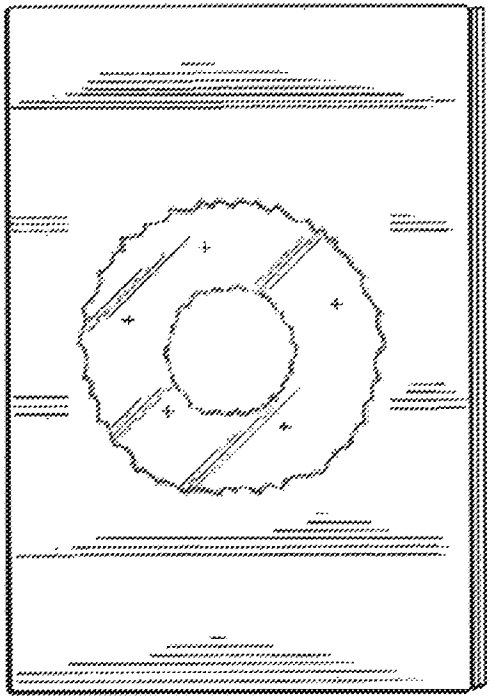
Figure 95:
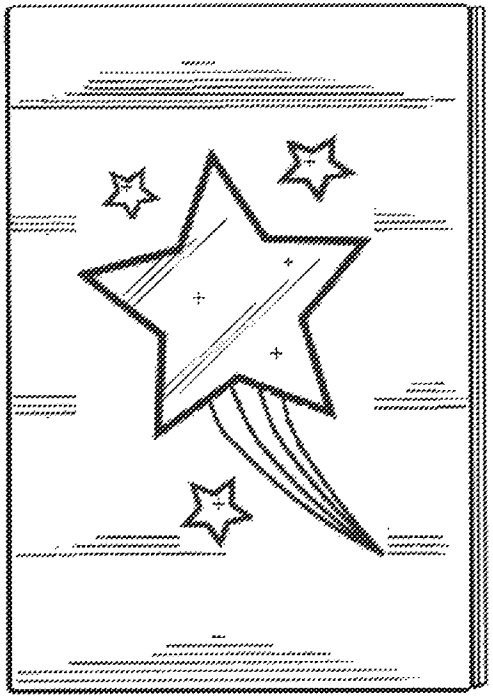
Figure 96:
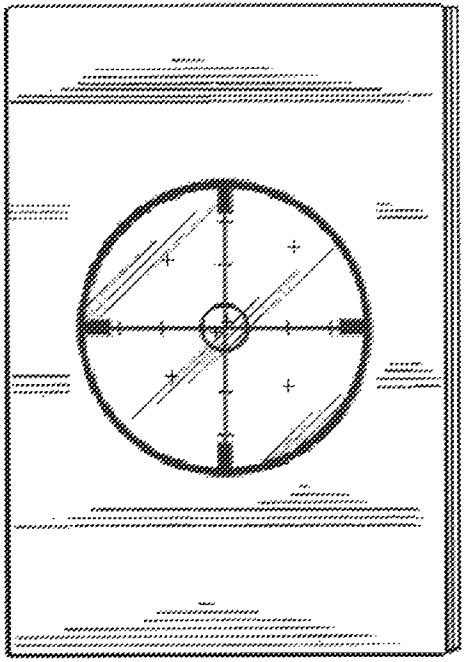
Figure 97:
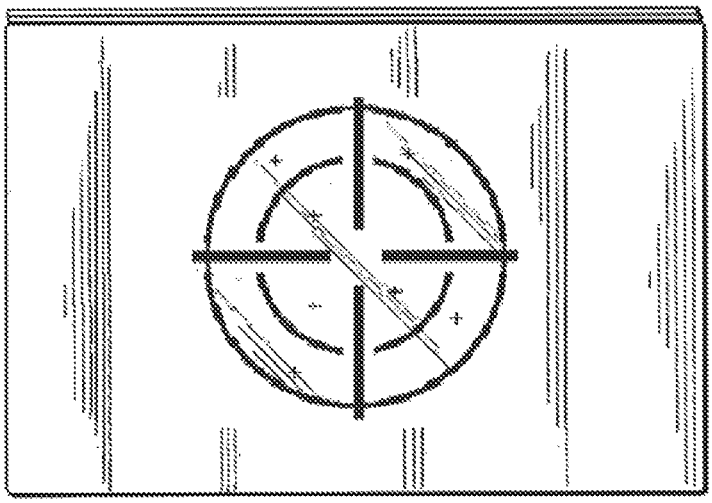
Figure 98:
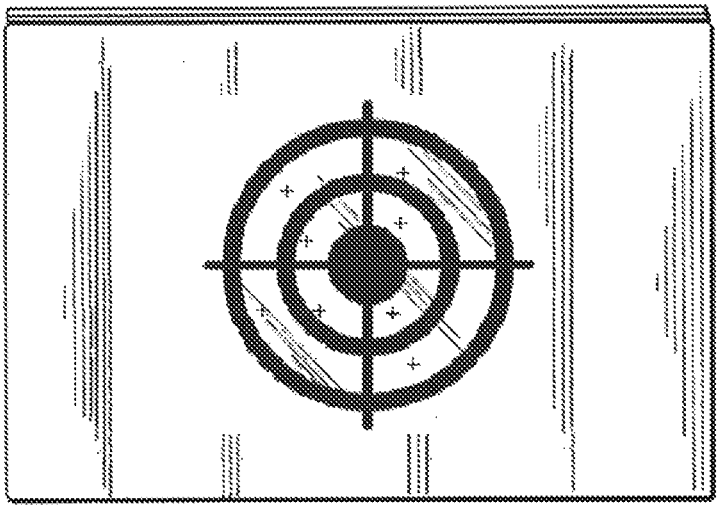
Figure 99:
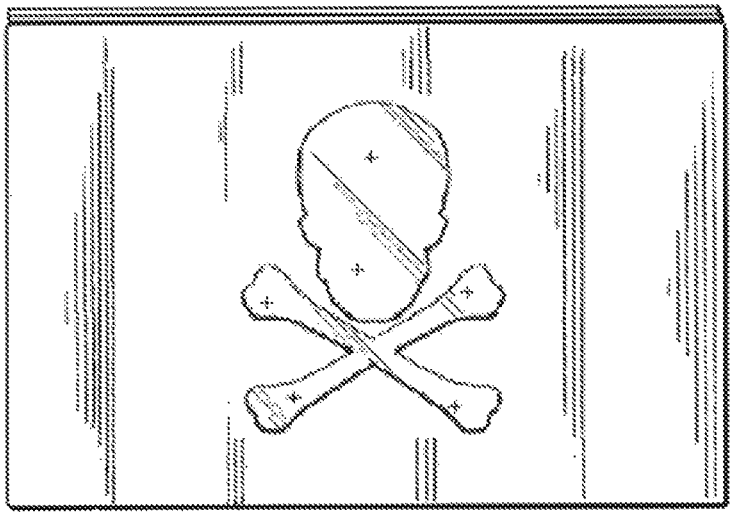
Figure 100:
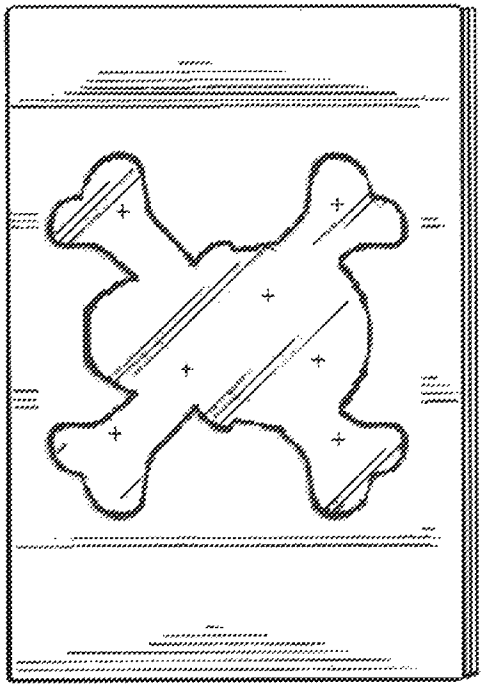
Figure 101:
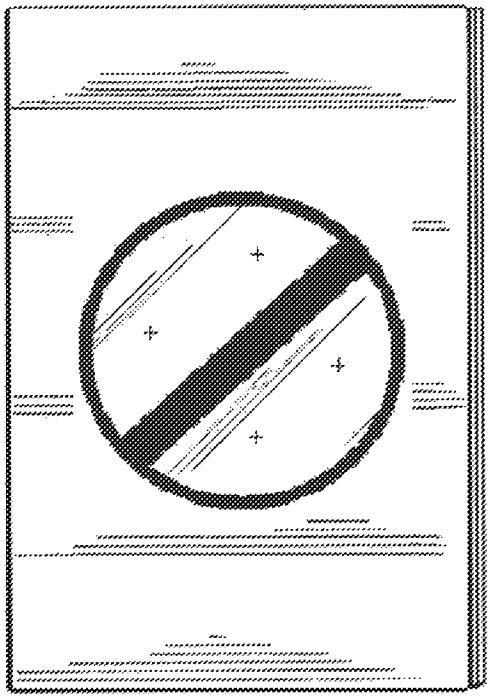
Figure 102:
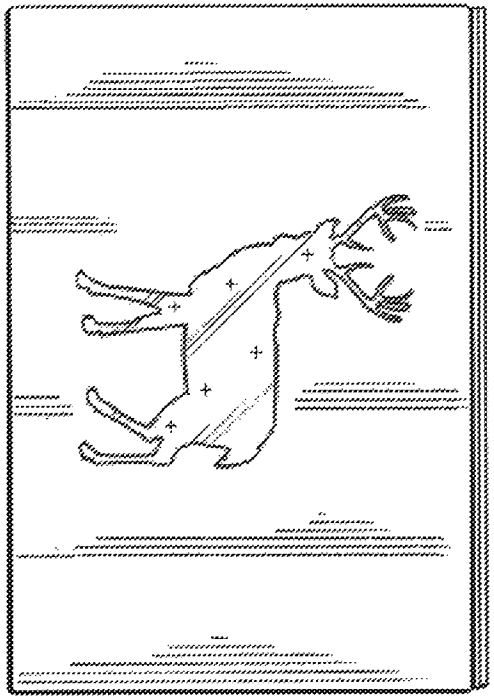
Figure 103:
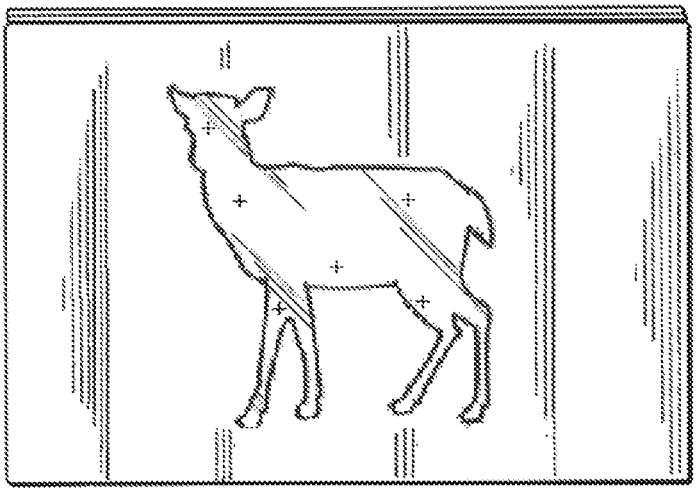
Figure 104:
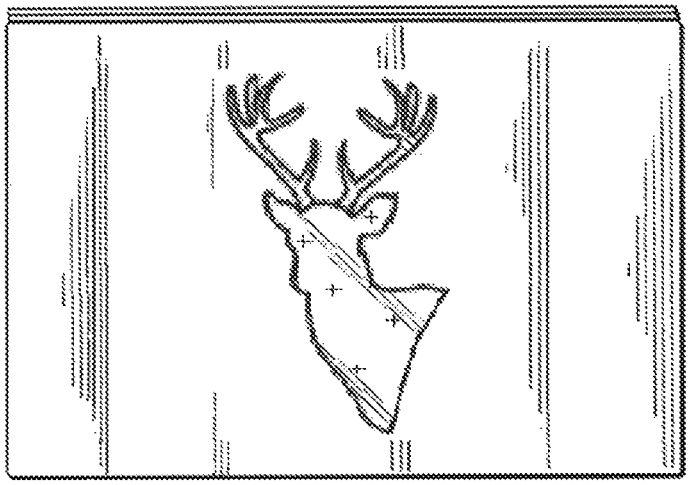
Figure 105:
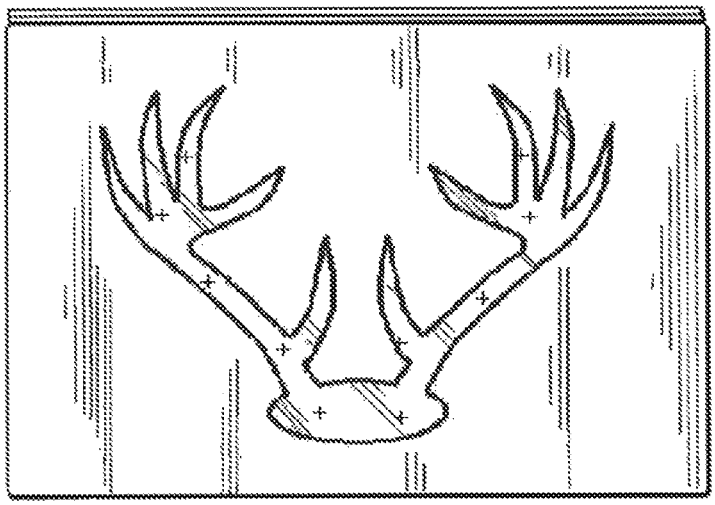
Figure 106:
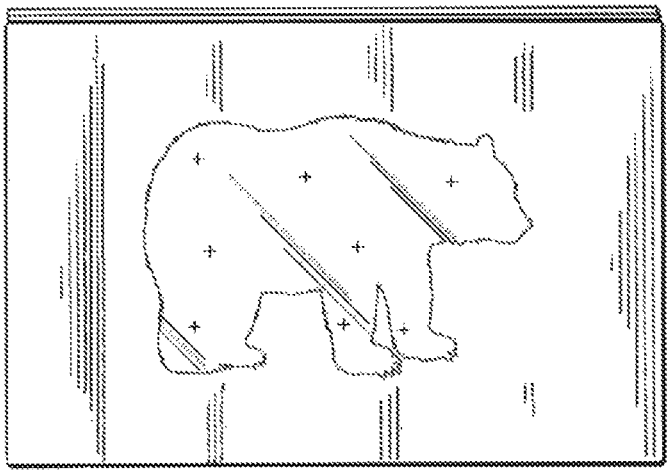
Figure 107:
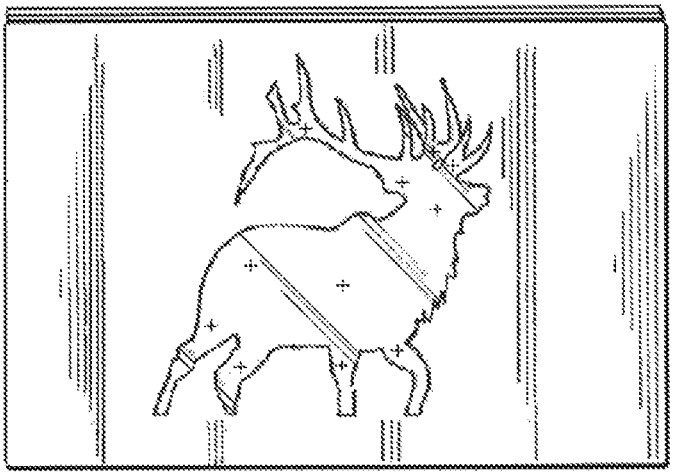
Figure 108:
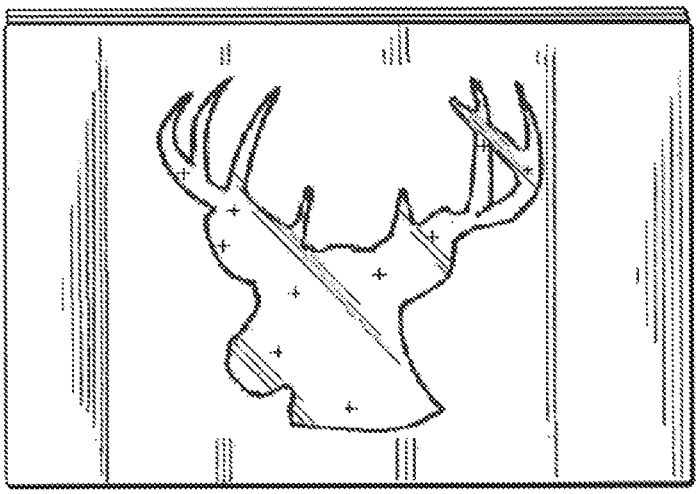
Figure 109:
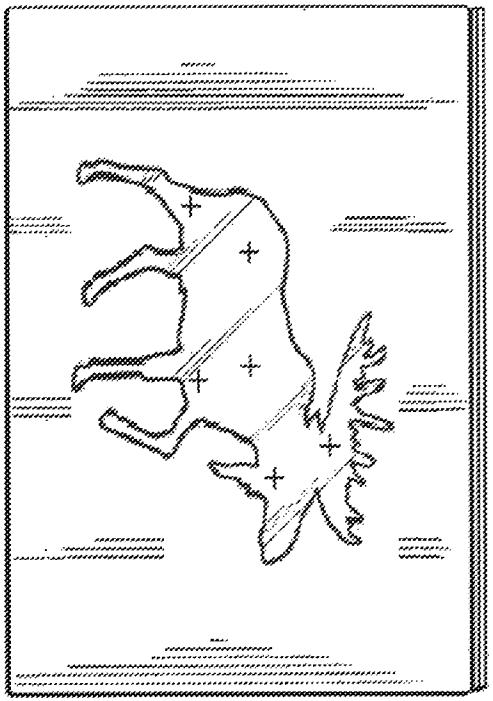
Figure 110:
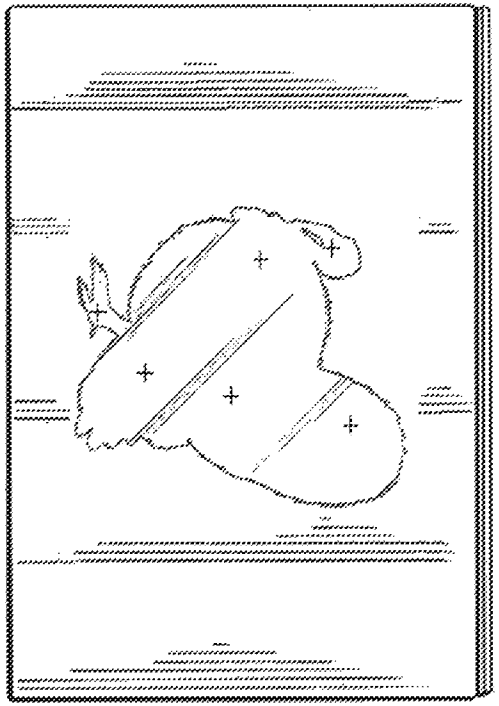
Figure 111:
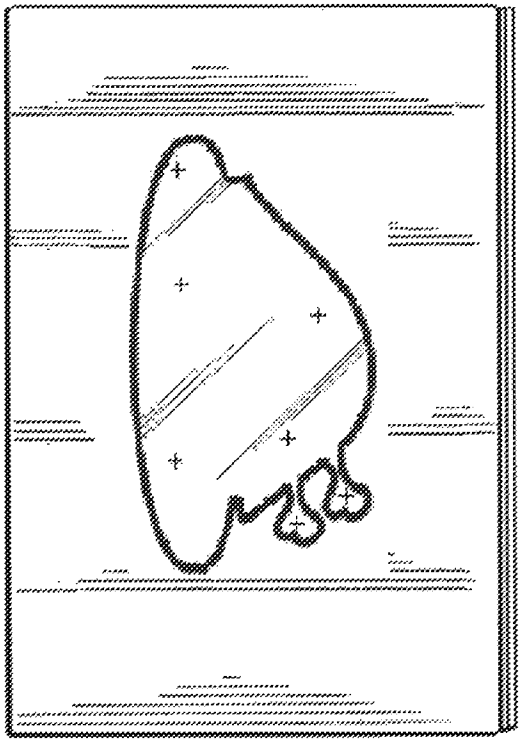
Figure 112:
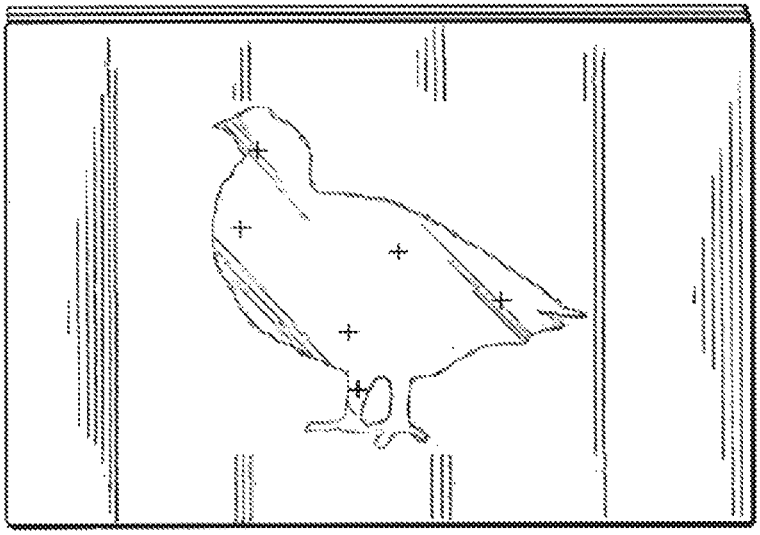
Figure 113:
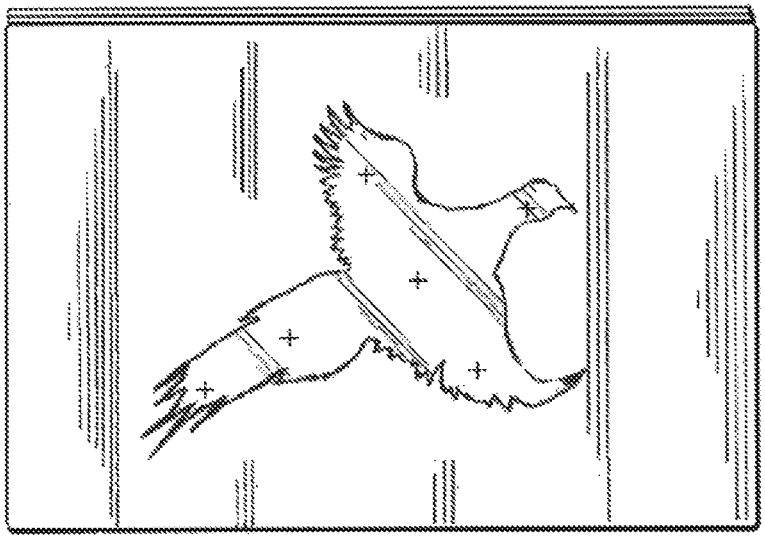
Figure 114:
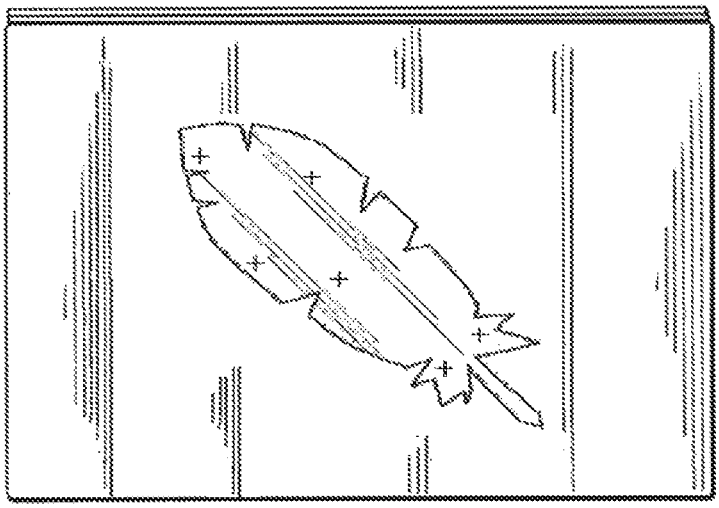
Figure 115:
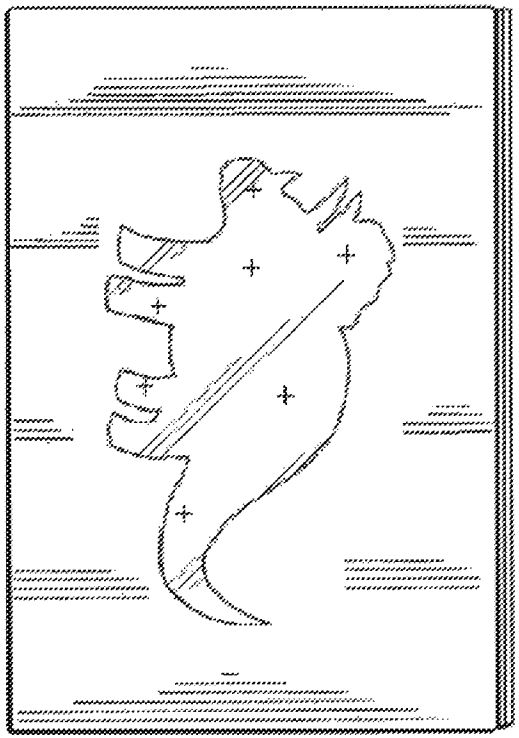
Figure 116:
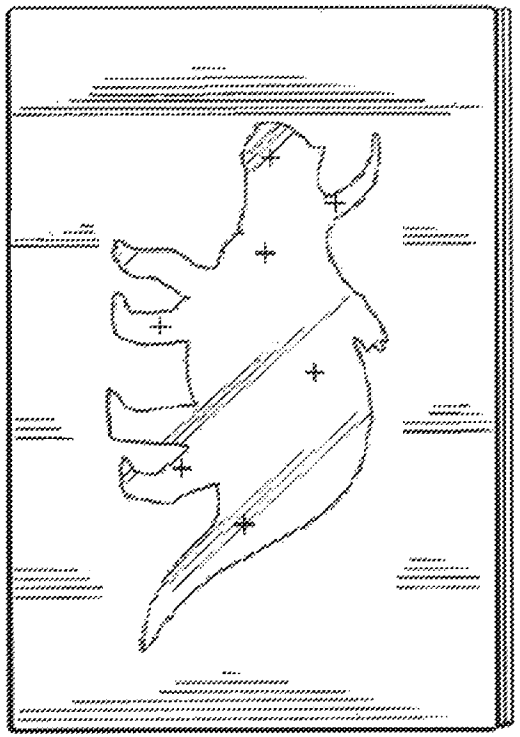
Figure 117:
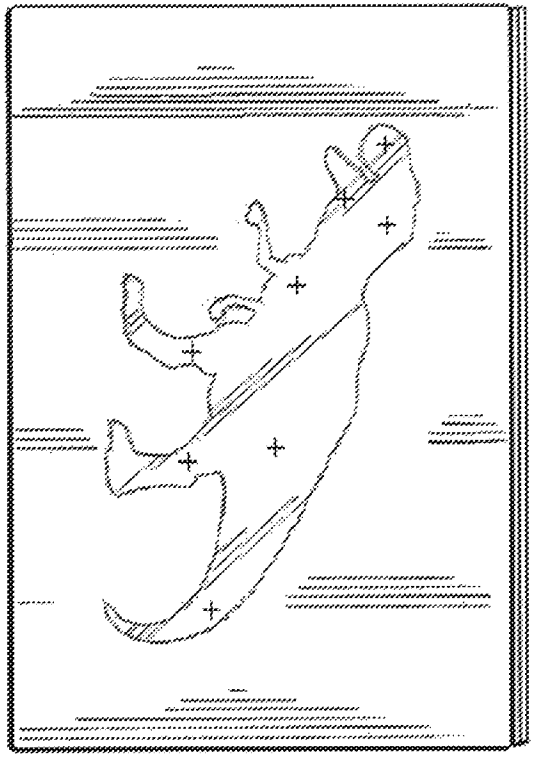
Figure 118:
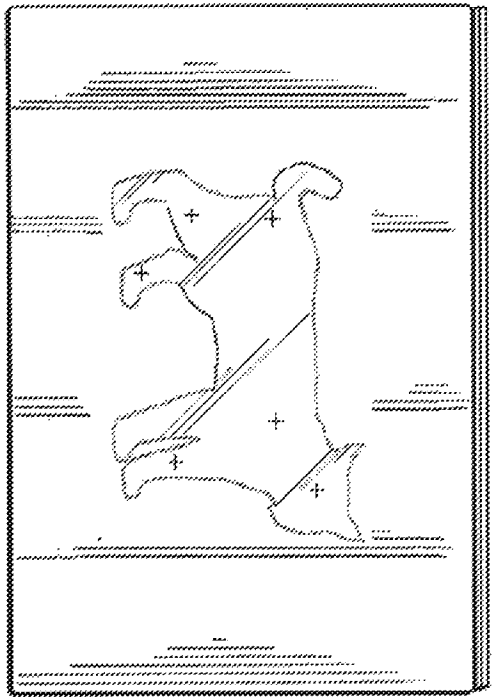
Figure 119:
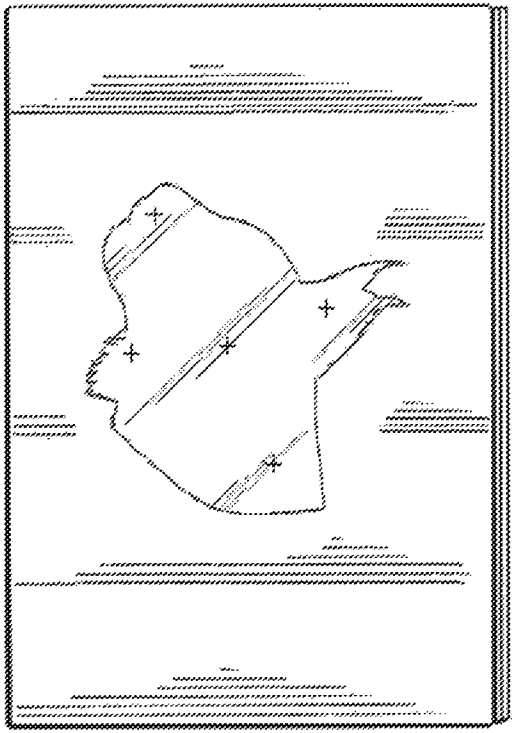
Figure 120:
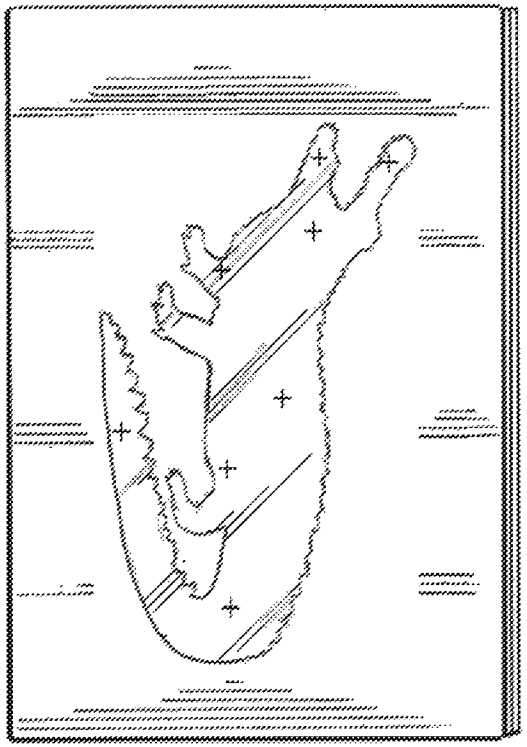
Figure 121:
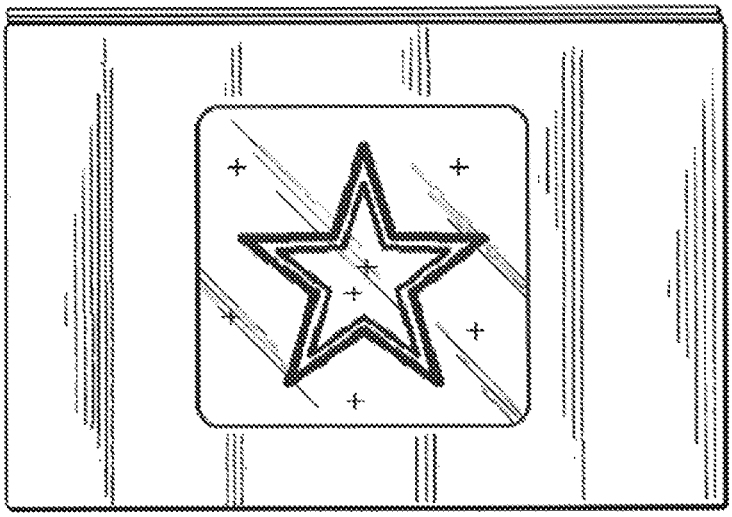
Figure 122:
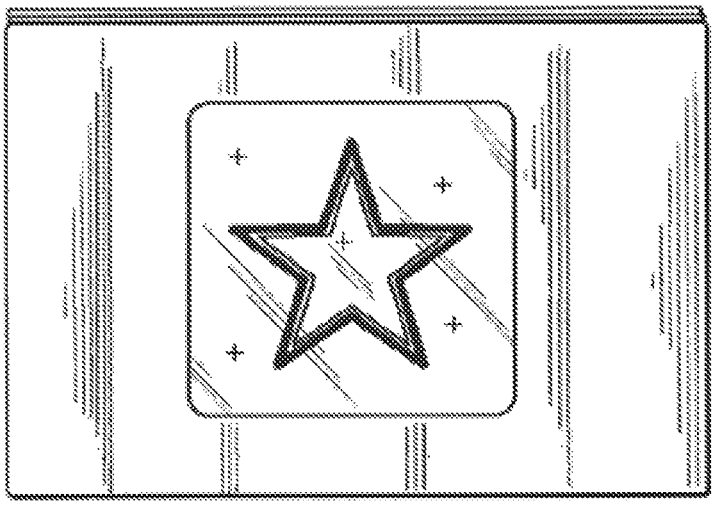
Figure 123:
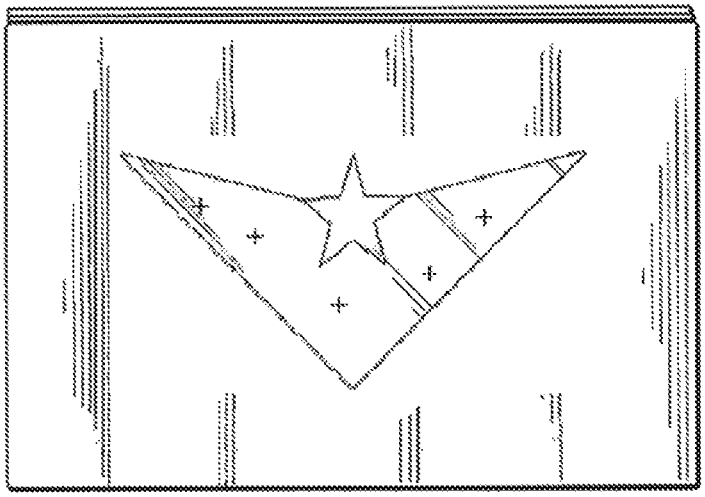
Figure 124:
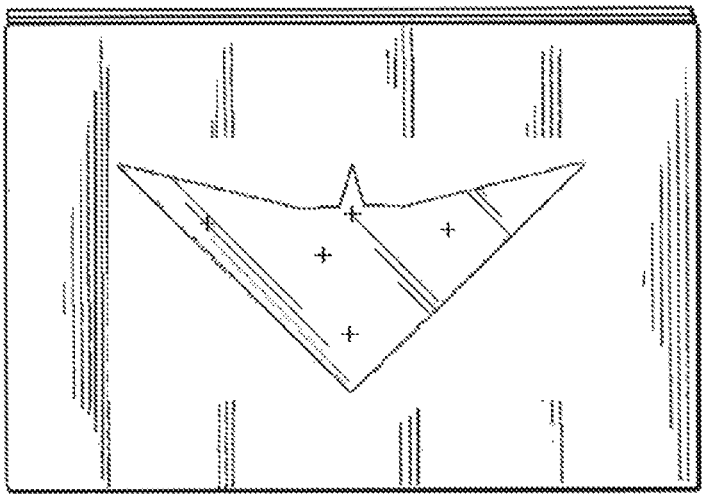
Figure 125:
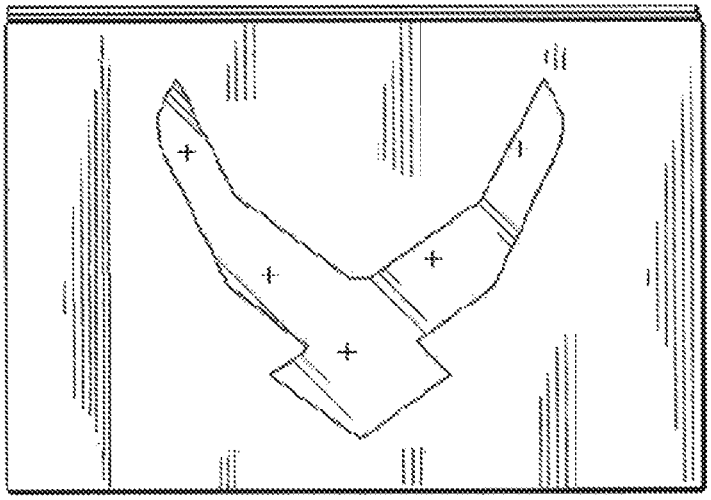
Figure 126:
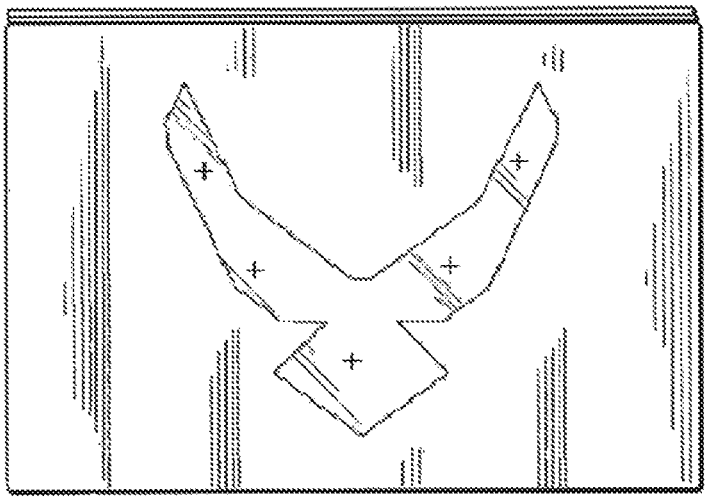
Figure 127:
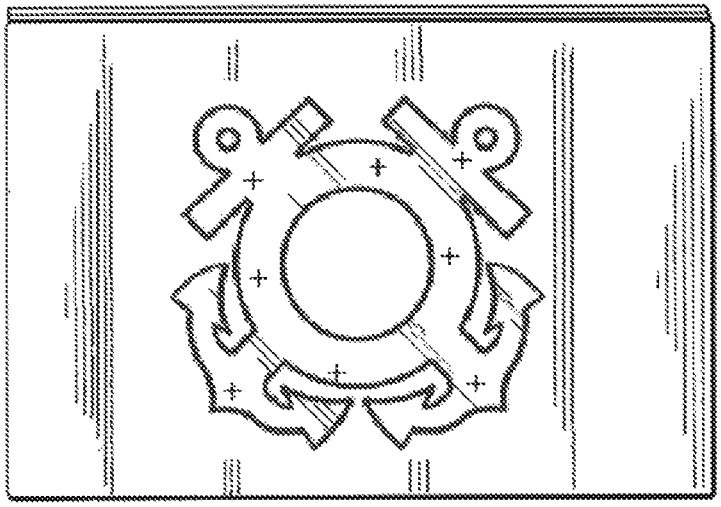
Figure 128:
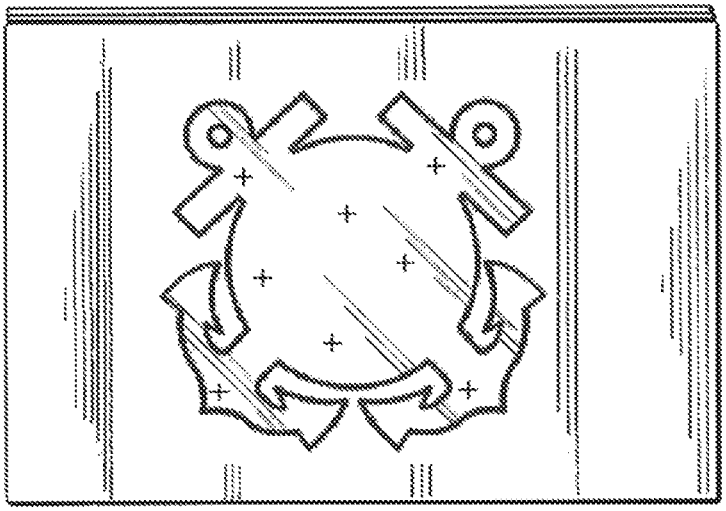
Figure 129:
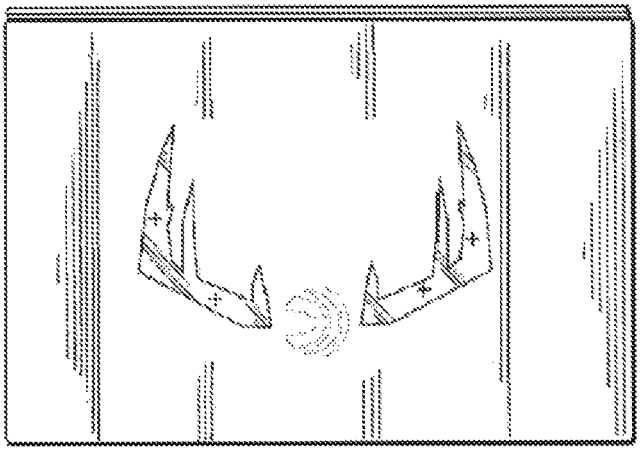
Figure 130:
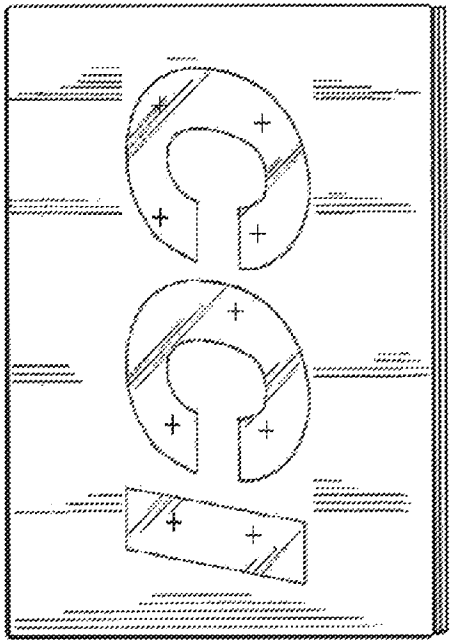

In all of the figures, a window portion in the front panel is shown. The window portion is shown in different shapes and sizes. The transparent material covering the window portion is shown in different shapes and sizes. The transparent material covering the window portion can include printing. Cartridges inside the cartridge packaging are viewable through the transparent material at the window portion of the front panel. The bullet portions of the cartridges as seen in various figures and FIGS. 40-41 are shown with stippling and represent contrasting colors. The internal arrangement of the cartridges is not claimed.

FIGS. 12-37 show cartridges viewable through the transparent material within the outline of the panel window. However, FIGS. 42-131 include plus signs ("+") within the boundaries of the outline of the front panel windows to represent cartridges that are viewable through the transparent material in such boundaries. FIGS. 40 and 41 (further described below) show the cartridges represented by the plus signs as seen through the respective windows. FIGS. 40-41 show bullet cartridges loosely and randomly mixed. FIG. 40 shows cartridges comprising bullets of two or more colors. FIG. 41 shows cartridges comprising bullets of three or more colors.

Figure 38:
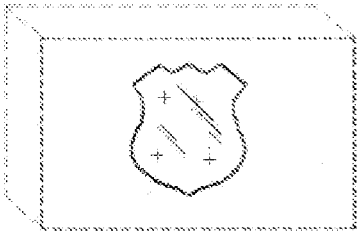
FIGS. 38 and 39 are a front, left, top, perspective views of cartridge packaging according an embodiment of the invention.
Figure 39:
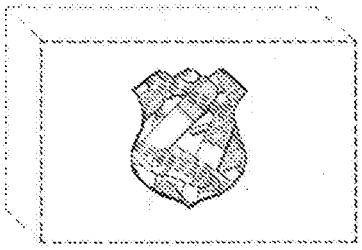

As mentioned above, FIGS. 42-131 include pluses ("+") in the windows representing the areas through which cartridges (as shown in FIGS. 40 and 41) can be seen. As an example. FIG. 38 below show a front panel with a window in the shape of a shield. The window includes a transparent material and plus signs ("+") within the closed boundaries of the window. The portion closed by the boundaries including "+'s " contains the bullets seen in FIGS. 40 or 41. FIG. 39 shows the viewable cartridge represented by the plus sign signs. Each figure showing a front panel window represents embodiments including the cartridges including the cartridges of FIGS. 40 and embodiments including the cartridges of FIG. 41.

The following patents and patent publications are incorporated herein by reference in their entireties for all purposes. The patents include coated bullets and methods of coating bullets, and inventive aspects relating to sports and sports team themes.

U.S. Pat. No. 9,254,503; US Pat. Publ. 20090254171; US Pat. Publ. 20030101891; U.S. Pat. No. 5,038,684; US Pat. Pub. 20050257308; U.S. Pat. Nos. 4,196,670; 4,328,750; US Pat. Publ. 20070095241; U.S. Pat. No. 5,105,744; US Pat. Publ. 20160377397; U.S. Pat. Nos. 7,032,492; 6,090,756; 4,731,189; 5,592,986; US Pat. Publ. 20120199033; US Pat. U.S. Pat. Nos. 5,275,108; 5,535,495; 3,580,178; 4,080,899; 4,454,175; 5,910,345; 3,553,804; 6,279,214; 5,062,974; 3,363,561; US Pat.; U.S. Pat. Nos. 3,340,216; 2,507,665; 8,561,542; 6,550,066; US Pat. Pub. 20140023800.

Other methods of coating bullets with coatings of different colors conventionally known are included herein.

Cartridges included herein can be those used in various types of small arm weapons, including hand guns, pistols, rifles, and the like. Examples include, but are not limited to, .380, .22, .40, 9 mm, 10 mm, .45, .38, 5.7×28 mm, .357, .30 Carbine, .300 Blackout, 7.62×39 mm, 5.56×45 mm, 0.308, 7.62×54 mm and .30-06. Examples of bullet materials can include lead, lead alloys, copper, brass, or other conventional metals that is inserted at its base end within the open end of a casing. Examples of case materials can include brass, steel, copper, aluminum, or other conventional materials.

Suitable overall dimensions of bullet cartridges include to those illustrated in the Sporting Arms and Ammunition Manufacturers Institute, Inc. (SAAMI) specification.

Figure 11:
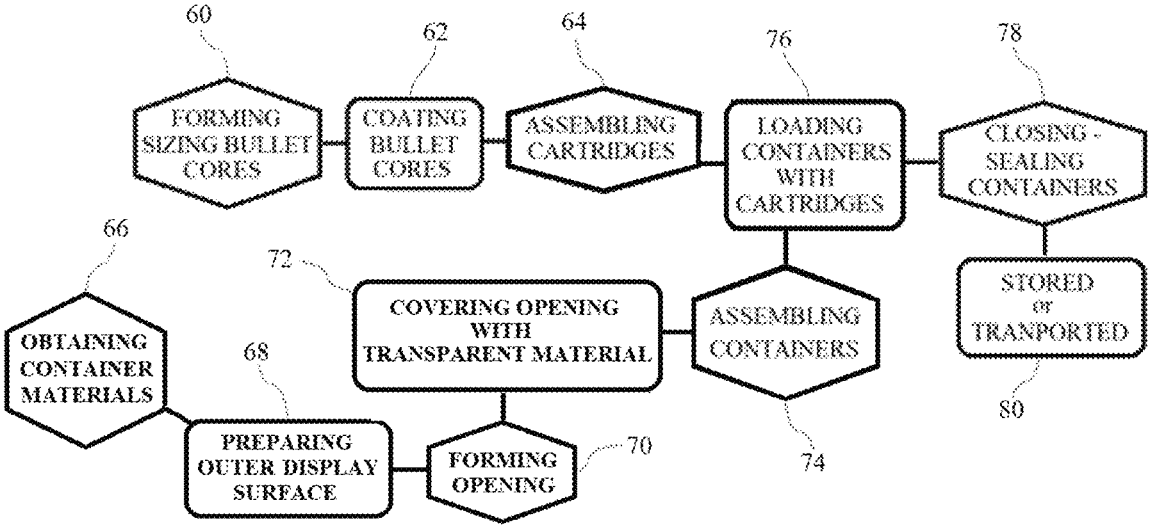
FIG. 11 is a flow chart of a process for producing cartridge packaging according to embodiments of the invention.

In at least some embodiments, there is disclosed herein a method of assembling cartridge packaging. Referring to FIG. 11, the method can include the following steps: 1) Forming and sizing a plurality of bullet cores 60. 2) Coating the bullet cores with a color coating. In embodiments, two or more color coatings can be used such that bullet cores of different colors are produced. The color(s) chosen can reflect, relate or correspond to a theme, as discussed above. The coating can be a polymer coating. 3) Assembling cartridges 64 by loading and securing the coated bullets 38 into cartridge cases 40 containing propellant 43. 4) Obtaining container materials 66. An example of container materials includes cardboard box preforms, as shown in FIGS. 2A-2B, and transparent material. Preparing outer display surface of the container 68 by printing designs, images, text, writing, indicia and/or colors on the container preform consistent with the type of bullet cartridges being packaged, including information about the bullet cartridges, required regulatory information and marketing text, indicia and/or imagery. The designs, images, text, writing, indicia and/or colors printed on the container can reflect, relate or correspond to a theme, as discussed above. Forming an opening in a front panel of the container preform 70. As discussed above, the shape of the opening 18 can be of any shape or size. The shape of the opening can reflect, relate or correspond to the theme, as discussed above. 7) Covering the opening 18 with a transparent material 72. As discussed above, the transparent material is secured, for example by adherence, to the inside surface of the front panel, covering the opening 18. 8) Assembling packaging containers 74, wherein the containers include the front panel having the opening covered by the transparent material, such that the inside space is viewable. 9) Loading an allotted amount of the assembled bullet cartridges into each container 76, such that the loaded containers contain bullets of two or more colors. 10) Closing and securing the containers 78. The markings, color(s) and/or imagery on the container/box, the shape of the opening 18 and the color of the bullets can all relate, reflect or correspond to a theme. The cartridge packaging can then be placed in storage or transported 80 to an intermediary customer, such as a wholesale or retail entity, or to an end user or final customer for display, sale or use.

The bullets can be packaged in bulk and loose into the containers, randomly mixed and oriented in the container, as seen in FIGS. 4A and 4B. Various amounts of bullet cartridges can be packaged in containers of various sizes. An example of an allotted amount is 300 bullet cartridges.

In at least some embodiments, containers having a predetermined size are each filled with an allotted amount of the bullet cartridges 6. The containers are then either placed in storage or transported to an intermediary customer, such as a wholesale or retail entity, or to an end user or final customer. In the case of a retail entity customer, after receipt by the entity customer, the containers 4 of cartridges 6 are placed for in-store or on-line display and/or sale. Customer can see the multi-colored bullet cartridges 6 through the opening 18 and transparent material 20 of the front panel 12 of the container 4.

As used herein, a method step recited in the singular and preceded with the word "a" or "an" should be understood as not excluding plural of said steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed. For example cartridges other than 22 caliber cartridges may be included in embodiments of the invention. In embodiments, cartridges may be shotshell cartridges, and the cartridges may be visible through the window and may be in an ordered presentation. Rather than having bullets of different colors, the shotgun shell polymer casings may be of a plurality of colors viewable through a window in a box. In such a case, transparent material may not be necessary. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention. Further, the limitations of the following claims are not written in means-plus-function format and are not intended to be interpreted based on 35 U.S.C. § 112(f) unless and until such claim limitations expressly use the phrase "means for" followed by a statement of function void of further structure.

The invention claimed is:

1. A package of 22 caliber rimfire cartridges comprising;

a six sided cardboard box having an outer surface and an interior with a volume of about 12 cu. in. to about 36 cu. in, the box having a front panel, a pair of top panels inwardly extending in opposite directions and adhered together, each defining an exposed portion of a top side of the box, a plurality of bottom panels adhered together, a rearward panel, and a pair of lateral panels, the box having graphics on at least an exposed portion of the pair of top panels, the front panel and the pair of lateral panels, the front panel having a non-rectangular opening therein defining a non-rectangular window, transparent sheet material spanning the non-rectangular opening, the transparent sheet material being secured to the box; and a multiplicity of 22 caliber rimfire cartridges, comprising at least about 100 cartridges, randomly mixed in disordered state in the interior of the cardboard box, each of the rimfire cartridges comprising a bullet seated in a brass case containing propellant, wherein each bullet of each cartridge has an outer polymer coating, the outer polymer coating substantially covering the entirety of the bullet and having a color, and the multiplicity of rimfire cartridges comprise bullets of two or more different colors, wherein the box with the multiplicity of 22 caliber rimfire cartridges weighs from about 1 lb. to about 3.5 lbs.;

wherein the rimfire cartridges and bullets of two or more different colors are viewable through the transparent material spanning the non-rectangular opening, wherein at least 20 cartridges are viewable through the transparent window and less than one half of the cartridges viewable in the window are viewable from a forward end of the cartridge to a rearward end of the cartridge due to their disordered state; and wherein at least one of the two or more different colors are present on the graphics.

2. The cartridge packaging of claim 1, wherein the non-rectangular opening is in the shape of the outline of a Christmas tree and the two or more different colors of the polymer coatings of the bullets comprise red and green.

3. The cartridge packaging of claim 1, wherein the shape of the non-rectangular opening is in the shape of the silhouette of an animal.

4. The cartridge packaging of claim 1, wherein the different colors comprise red, white, and blue.

5. The cartridge packaging of claim 1, wherein the shape of the non-rectangular opening corresponds to a theme associated with the two or more different colors, and wherein the graphics on the box has words associated with the theme, and wherein the theme is one of a patriotic theme, a hunting theme, and a sports theme.

6. The cartridge packaging of claim 1, wherein the shape of the non-rectangular opening is the shape of a silhouette of a sports ball or sports helmet and the two or more different colors.

7. The cartridge packaging of claim 1, wherein there are at least 250 cartridges in the box.

8. The cartridge packaging of claim 1, wherein the colors are associated with a particular sports team and the shape of the opening of the box is associated with the sport of the particular sports.

9. A package of 22 caliber long rifle rimfire cartridges comprising;

a six sided cardboard box having an interior with a volume of about 12 cu. in. to about 36 cu. in, the box having a front panel, a top panel, a bottom panel, a rearward panel, and a pair of lateral panels, the box having graphics on at least an exposed portion of the top panel, the front panel and the pair of lateral panels, the top panel or front panel having an opening therein defining a window, the opening in the shape of a non-rectangular silhouette of one of an animal, a tree, a sports item, a caricature, and a mountain landscape, transparent material spanning the opening, the transparent material being secured to the box; and a multiplicity of 22 caliber long rifle rimfire cartridges, comprising at least about 100 cartridges, in disordered state in the interior of the cardboard box, each of the rimfire cartridges comprising a bullet seated in a brass case containing propellant, wherein each bullet of each cartridge has an outer polymer coating, the outer polymer coating substantially covering the entirety of the bullet and having a color, and the multiplicity of rimfire cartridges comprise bullets having polymer coatings of two or more different colors, wherein the box with the multiplicity of 22 caliber long rifle rimfire cartridges weighs from about 1 lb. to about 3.5 lbs.;

wherein the rimfire cartridges with bullets of two or more different colors are viewable through the transparent material spanning the non-rectangular opening, wherein at least 20 cartridges are viewable through the transparent window and less than one half of the cartridges that are viewable through the transparent window are viewable through the transparent window from a forward end of the cartridge to a rearward end of the cartridge due to their disordered state; and wherein the transparent material is sufficiently adhered to the cardboard about the window to prevent breech of the window by the bullets during handling.

10. The cartridge packaging of claim 9, the two or more different colors including red and green.

11. The cartridge packaging of claim 9, the front panel opening having a shape, the box having an image in the graphics, wherein the image, the shape of the front panel opening, and the rimfire cartridges with bullets of two or more different colors are related in a theme.

12. The cartridge packaging of claim 9, wherein the shape of the opening is one of a pine tree, a reindeer, a sled, and a Santa Claus, and the two or more different colors are green and red.

13. The cartridge packaging of claim 9, wherein the two or more different colors are associated with a particular sports team and the shape of the opening on the top panel or front panel of the box is associated with the sport of the sports team.

14. The cartridge packaging of claim 13, wherein the shape of the opening of the front panel or top panel is a ball or helmet.

* * * * *